US012246940B2

(12) United States Patent
Watanabe et al.

(10) Patent No.: US 12,246,940 B2
(45) Date of Patent: Mar. 11, 2025

(54) ENCLOSING DEVICE, ENVELOPE PROCESSING APPARATUS, AND IMAGE FORMING SYSTEM

(71) Applicants: Takahiro Watanabe, Kanagawa (JP); Michitaka Suzuki, Kanagawa (JP); Nobuyoshi Suzuki, Tokyo (JP); Yuusuke Shibasaki, Tokyo (JP); Takahiro Matsuda, Kanagawa (JP); Atsushi Shinoda, Kanagawa (JP); Shingo Yoshizawa, Kanagawa (JP); Takuya Morinaga, Tokyo (JP)

(72) Inventors: Takahiro Watanabe, Kanagawa (JP); Michitaka Suzuki, Kanagawa (JP); Nobuyoshi Suzuki, Tokyo (JP); Yuusuke Shibasaki, Tokyo (JP); Takahiro Matsuda, Kanagawa (JP); Atsushi Shinoda, Kanagawa (JP); Shingo Yoshizawa, Kanagawa (JP); Takuya Morinaga, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 121 days.

(21) Appl. No.: 18/332,943

(22) Filed: Jun. 12, 2023

(65) Prior Publication Data

US 2023/0399192 A1 Dec. 14, 2023

(30) Foreign Application Priority Data

Jun. 14, 2022 (JP) ..... 2022-095896

(51) Int. Cl.

| | |
|---|---|
| ***B43M 7/00*** | (2006.01) |
| ***B65H 45/14*** | (2006.01) |
| ***B65H 45/30*** | (2006.01) |

(52) U.S. Cl.
CPC ..... *B65H 45/142* (2013.01); *B65H 45/30* (2013.01); *B65H 2301/54* (2013.01);
(Continued)

(58) Field of Classification Search
CPC ..... B43M 3/00; B43M 7/00; B65H 45/30; B65H 45/142; B65H 2301/54;
(Continued)

(56) References Cited

U.S. PATENT DOCUMENTS 7,454,882 B2 * 11/2008 Kapturowski ..... B43M 3/045 53/381.5
7,637,490 B2 * 12/2009 Kapturowski ..... B65H 39/10 270/58.23

(Continued)

FOREIGN PATENT DOCUMENTS

| | | |
|---|---|---|
| JP | 10-287095 | 10/1998 |
| JP | 2003-020012 | 1/2003 |
| JP | 2011-186041 | 9/2011 |

OTHER PUBLICATIONS

U.S. Appl. No. 18/174,919, filed Feb. 27, 2023, takahiro matsuda, et al.

*Primary Examiner* — Leslie A Nicholson, III
(74) *Attorney, Agent, or Firm* — IPUSA, PLLC

(57) ABSTRACT

An enclosing device to insert an enclosure into an envelope conveyed to an enclosing position includes an envelope conveyor and an enclosing unit. The envelope conveyor conveys the envelope to the enclosing position. The enclosing unit opens a frontage of the envelope such that the enclosure is inserted into the envelope that has reached the enclosing position and includes an opening amount adjuster to adjust an opening amount of the frontage when the enclosure is inserted into the envelope. The opening amount adjuster adjusts the opening amount, depending on a flap length and a body length. The flap length is a length of a flap
(Continued)

of the envelope in a conveyance direction in which the envelope is conveyed to the enclosing position. The body length is a length of a body of the envelope in the conveyance direction.

15 Claims, 49 Drawing Sheets

(52) U.S. Cl.
CPC ..... *B65H 2405/60* (2013.01); *B65H 2601/30* (2013.01); *B65H 2701/1916* (2013.01)

(58) Field of Classification Search
CPC ..... B65H 2405/60; B65H 2601/30; B65H 2701/1916; B65H 2801/66
USPC ..... 270/58.06
See application file for complete search history.

(56) References Cited

U.S. PATENT DOCUMENTS

| | | | | |
|---|---|---|---|---|
| 10,227,151 | B2 * | 3/2019 | Kawano | B43M 7/00 |
| 11,897,279 | B2 * | 2/2024 | Yoshizawa | B43M 3/045 |
| 11,919,325 | B2 * | 3/2024 | Kunieda | B43M 3/045 |
| 11,970,019 | B2 * | 4/2024 | Suzuki | B41J 3/28 |
| 2012/0322641 | A1 | 12/2012 | Matsushita et al. | |
| 2022/0379653 | A1 | 12/2022 | Kunieda et al. | |
| 2022/0380168 | A1 | 12/2022 | Shibasaki et al. | |

* cited by examiner

ENCLOSING DEVICE, ENVELOPE PROCESSING APPARATUS, AND IMAGE FORMING SYSTEM

CROSS-REFERENCE TO RELATED APPLICATION

This patent application is based on and claims priority pursuant to 35 U.S.C. § 119(a) to Japanese Patent Application No. 2022-095896, filed on Jun. 14, 2022, in the Japan Patent Office, the entire disclosure of which is hereby incorporated by reference herein.

BACKGROUND

Technical Field

Embodiments of the present disclosure relate to an enclosing device, an envelope processing apparatus, and an image forming system.

Related Art

An enclosing device is known that encloses an enclosure in an envelope. An enclosing processing device is also known that encloses an enclosure in an envelope, and further seals the envelope in which the enclosure is enclosed. An image forming apparatus is known that forms an image on a sheet serving as an enclosure to be enclosed in an envelope. An image forming system is known that coordinates with the image forming apparatus and the enclosing device or the enclosing processing device to enclose the envelope in which the enclosure on which the image is formed and seal the envelope. Note that an image forming system is also known that coordinates with the image forming apparatus and a folding device that performs folding on a sheet on which an image is formed, to perform folding on the sheet on which the image is formed and enclose the folded sheet.

SUMMARY

In an embodiment of the present disclosure, there is provided an enclosing device to insert an enclosure into an envelope conveyed to an enclosing position that includes an envelope conveyor and an enclosing unit. The envelope conveyor conveys the envelope to the enclosing position. The enclosing unit opens a frontage of the envelope such that the enclosure is inserted into the envelope that has reached the enclosing position and includes an opening amount adjuster to adjust an opening amount of the frontage when the enclosure is inserted into the envelope. The opening amount adjuster adjusts the opening amount, depending on a flap length and a body length. The flap length is a length of a flap of the envelope in a conveyance direction in which the envelope is conveyed to the enclosing position. The body length is a length of a body of the envelope in the conveyance direction.

In another embodiment of the present disclosure, there is provided an envelope processing apparatus that includes the enclosing device and a sealer to seal the envelope in which the enclosure has been inserted.

In still another embodiment of the present disclosure, there is provided an image forming system that includes an image forming apparatus and the enclosing device.

In still further another embodiment of the present disclosure, there is provided an image forming system that includes a folding processing device and the enclosing device.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
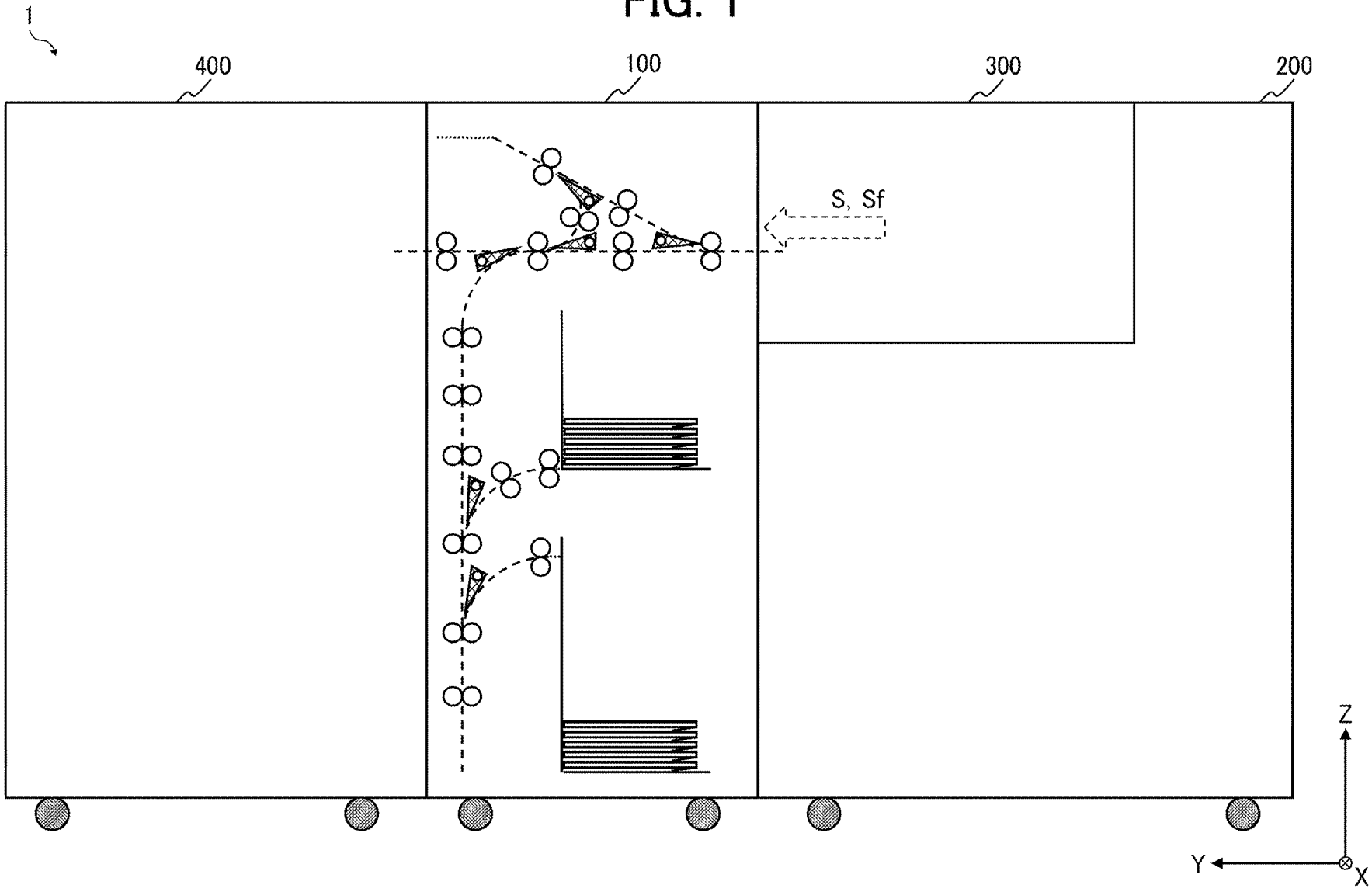
FIG. 1 is an external front view of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

First, a description is given of an image forming system according to an embodiment of the present disclosure. FIG. 1 is a front view of an internal configuration of an image forming The envelope processing controller 150 includes an interface that outputs control signals to the conveying rollers and inputs signals from the conveying rollers, and an interface that receives output signals from sensors. system 1 as an example of the image forming system. The printer system 1 includes an image forming apparatus 200, a folding apparatus 300 as a sheet processing apparatus, an envelope processing apparatus 100 as an envelope device according to an embodiment of the present disclosure, and a post-processing apparatus 400.

The image forming apparatus 200 is an example of an apparatus that forms an image on a sheet-shaped medium by a specified image forming method and ejects the sheet-shaped medium disposed downstream from the image forming apparatus 200. The sheet-shaped medium (hereinafter, simply referred to as a "sheet S") on which the image is formed is ejected to the folding apparatus 300. The "folded sheet Sf" on which specified folding processing is performed in the folding apparatus 300 and ejected toward the envelope processing apparatus 100. Note that the sheet S may be ejected to the envelope processing apparatus 100 without being folded in the folding apparatus 300.

An instruction on whether to perform folding processing on the sheet S is based on information that a user of the printer system 1 inputs into a controller (a printer controller 260 to be described below) included in the image forming apparatus 200. The printer controller 260 sends a signal (control signal) for instructing the content of operation control to the image forming apparatus 200 and the folding apparatus 300 based on an instruction input by a user. Note that the "instruction on whether to perform folding processing" may be input by a user of the printer system 1 to a sheet folding controller 320 included in the folding apparatus 300.

The envelope processing apparatus 100 performs processing (enclosing processing) that encloses an enclosure (a sheet S or a folded sheet Sf), which is ejected from an apparatus (the image forming apparatus 200 or the folding apparatus 300) disposed on an upstream side in a conveyance direction of the sheet S, into an envelope E. The envelope processing apparatus 100 also performs sealing processing that seals the envelope E in which the enclosure is enclosed after the enclosing processing. Note that when the enclosing processing and the sealing processing are described together, this specification may refer to as "enclosing and sealing processing".

In the present specification, the term "enclosure" refers to an object being conveyed to an enclosing position to be described below. Accordingly, the term "enclosure" according to the present embodiment includes not only the "folded sheet Sf" conveyed to the enclosing position but also the "sheet S" conveyed to the envelope processing apparatus 100 without being subjected to folding processing. Note that the envelope processing apparatus 100 may also perform an operation of ejecting the folded sheet Sf or the sheet S to an apparatus disposed on a downstream side in a conveyance direction without conveying the folded sheet Sf or the sheet S to the enclosing position. In other words, the envelope processing apparatus 100 can also perform processing of ejecting the sheet S or the folded sheet Sf conveyed from the upstream side in the conveyance direction as it is without using the sheet S or the folded sheet Sf for the enclosing and sealing processing.

The post-processing apparatus 400 is an example of an apparatus disposed downstream from the folding apparatus 300 and the envelope processing apparatus 100. The post-processing apparatus 400 is an apparatus that performs post-processing instructed via a controller, such as stapling processing, on the sheet S or the folded sheet Sf ejected by the folding apparatus 300 or the envelope processing apparatus 100 corresponding to the upstream apparatus from the post-processing apparatus 400 in the conveyance direction.

The envelope processing apparatus 100 can perform processing (reverse processing) of replacing a leading end of the envelope E in the conveyance direction, while the folded sheet Sf is being conveyed toward the envelope E, to enclose the folded sheet Sf in the envelope E in a proper orientation. Some of the envelopes E are provided with a transparent window ew at a specified position in advance. The transparent window ew is a portion where information such as an address formed on the folded sheet Sf as an enclosure is oriented, and the information can also be viewed from the outside of the envelope E after enclosing processing. The transparent window ew has a hole of a specified size on one surface of the envelope E. For example, a transparent film is attached to the hole of the transparent window ew.

The "proper orientation" with respect to the envelope E corresponds to a state in which a specific portion (which may be one side of the enclosure) whose enclosure inserted into the envelope E is to face the transparent window ew faces the outside of the envelope E via the transparent window ew. For example, a specific portion in which information such as a mailing address formed in advance on the enclosure is formed includes information that is visible from the outside of the envelope E without opening the envelope E. In other words, the proper orientation refers to a direction in which information of a sending destination faces the transparent window ew.

A plurality of kinds (folding types) of folding processing are performed to the folded sheet Sf. The specific portion where information such as an address is formed takes a different position or orientation with respect to the conveyance direction, depending on the folding type. In the envelope processing apparatus 100, control such as replacement of the leading end of the enclosure in the conveyance direction of the enclosure in the conveyance processing before the enclosure reaches the enclosing position is performed so that the orientation of the folded sheet Sf at the time of enclosing is set to a "proper orientation" depending on the folding type of the folded sheet Sf being conveyed as an enclosure to be subjected to the enclosing processing. In other words, control determines whether to reverse the sheet by replacing the leading portion of the conveyance direction during conveyance of the folded sheet Sf or not to perform reverse processing in a case where the folded sheet Sf is in a proper orientation without reverse processing.

The envelope processing apparatus 100 includes a conveying mechanism that allows the folded sheet Sf being conveyed to be reversed. In a case where reverse processing is to be performed, the folded sheet Sf is reversed by using a conveyance path on the upstream side of the enclosing position and then conveyed to the enclosing position. The envelope processing apparatus 100 can also determine whether a sheet S as an enclosure that has not been subjected to folding processing is to be reversed before the sheet S is conveyed to the enclosing position, and enclose the sheet S in the envelope E, depending on the relative positional relationship between the position where information such as an address is formed and the transparent window ew of the envelope E.

A description is given of the "coordinate axes" to be referred to in the description of an embodiment of the present disclosure. As illustrated in FIG. 1, the axis parallel to a mounting surface of the printer system 1 is defined as Y axis. The Y axis is also an axis extending along a direction in which the image forming apparatus 200, the envelope processing apparatus 100, and the post-processing apparatus 400 of the printer system 1 are arranged side by side. In the present specification, the direction of an arrow indicating the Y axis is referred to as "+Y direction" and an opposite direction thereof is referred to as "−Y direction". Accordingly, the sheet S on which an image is formed in the image forming apparatus 200 is conveyed in the +Y direction, and then conveyed to each apparatus disposed downstream from the image forming apparatus 200 in the +Y direction.

Similarly, an X axis defines an axis that is parallel to the placement surface on which the printing system 1 is placed and extends in a front-rear direction of the printing system 1. The direction of an arrow indicating the X axis is referred to as "+X direction" and an opposite direction thereof is referred to as "−X direction".

A Z axis defines an axis that is perpendicular to the X axis and the Y axis and extends in a height direction of the printing system 1. The direction of an arrow indicating the Z axis is referred to as "+Z direction" and an opposite direction thereof is referred to as "−Z direction".

When the same coordinate axes as those described above are appended to the drawings used in the following description, the definitions of the directions used in the description are the same as those described above.

The sheet S on which an image is formed in the image forming apparatus 200 is conveyed in the +Y direction, and then conveyed to apparatuses disposed downstream from the image forming apparatus 200. Accordingly, the +Y direction is substantially synonymous with the conveyance direction. In the envelope processing apparatus 100, the entry direction of the sheet S is the +Y direction. However, the conveyance direction in the enclosing-and-sealing operation of the sheet S and the folded sheet Sf is the +Z direction.

In other words, in the envelope processing apparatus 100 constituting the printer system 1, the conveyance directions of the envelope E are "Z directions", the conveyance direction of the envelope E to the enclosing position is the +Z direction, and the conveyance from the enclosing position to the sealing position is the −Z direction.

Figure 2:
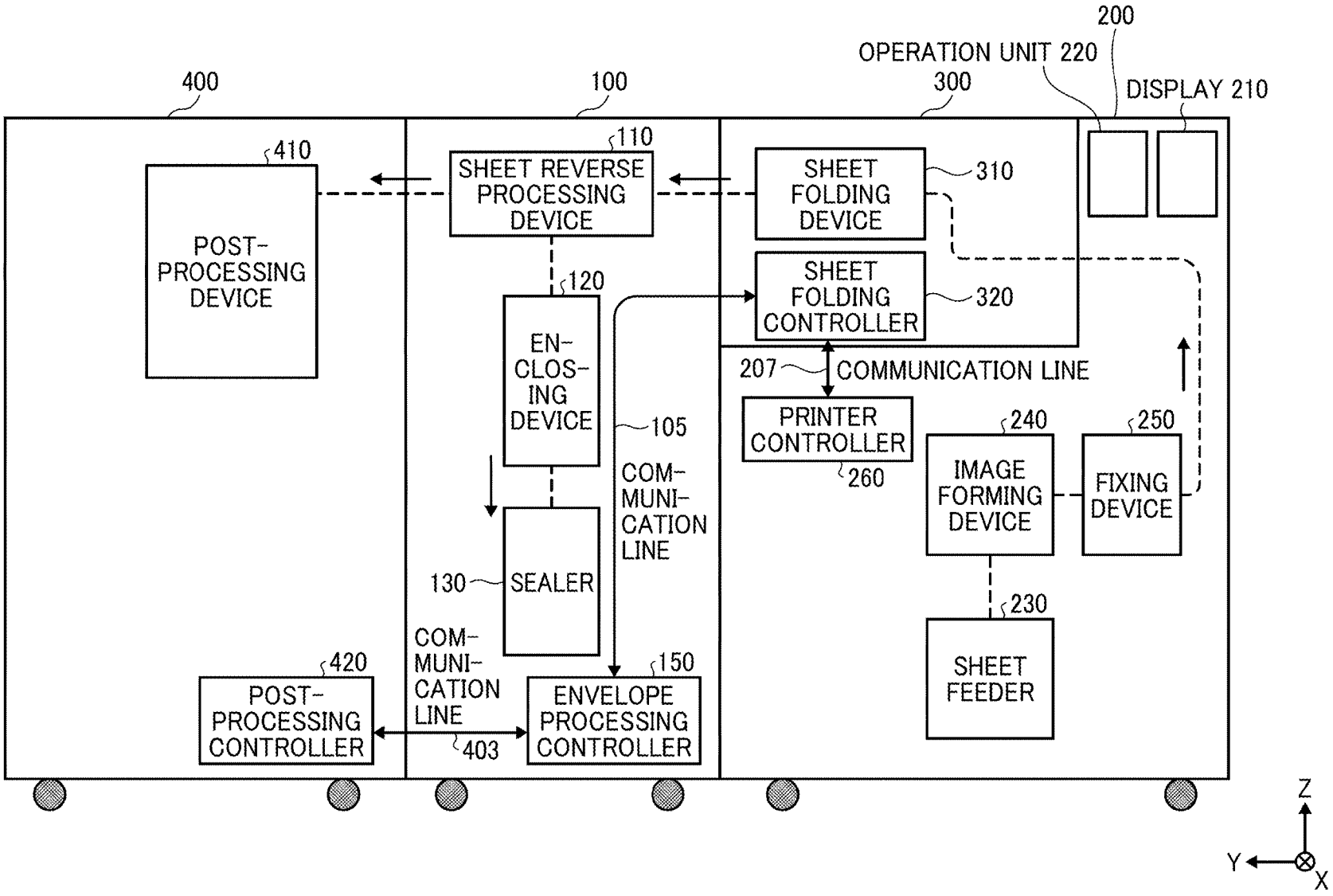
FIG. 2 is a block diagram of a control configuration of the image forming system of FIG. 1.

With reference to FIG. 2, a description is given of overall functional blocks of the printer system 1. In the following descriptions, an enclosure as a medium that is conveyed and enclosed in the envelope E is a folded sheet Sf on which an image is formed in the image forming apparatus 200 and on which specified folding processing is performed in the folding apparatus 300. In FIG. 2, a movement path (conveyance path) of the folded sheet Sf is indicated by a broken line. A communication line used for sending and receiving of signals between the functional blocks is indicated by a solid line. Note that a movement path (conveyance path) of the sheet S is also indicated by a broken line.

The image forming apparatus 200 is, for example, an apparatus that forms an image on a sheet S by a known electrophotographic process. The image forming apparatus 200 includes a display 210, an operation unit 220, a sheet feeder 230, an image forming device 240, a fixing device 250, and a printer controller 260.

The display 210 displays screens for notifying a user of states of various functions and operation contents. The operation unit 220 corresponds to an operation interface with which a user performs a setting operation of a processing operation mode or the number of prints to be processed, and a setting operation of a setting that requires reverse processing when enclosing processing is performed in the envelope processing apparatus 100. The sheet feeder 230 includes a sheet feeding mechanism that stores sheets S, and separates and feeds the sheets S one by one. The image forming device 240 forms a latent image on a photoconductor and transfers an image onto the sheet S. The fixing device 250 fixes the image transferred on the sheet S. The printer controller 260 controls operations of the above-described functional blocks.

The folding apparatus 300 includes a sheet folding device 310 and the sheet folding controller 320. The sheet folding controller 320 controls folding processing for the sheet S conveyed from the image forming apparatus 200 based on a folding type (folding manner) designated from the printer controller 260 of the image forming apparatus 200 via a communication line 207. The sheet folding controller 320 also controls communication with the printer controller 260 and an envelope processing controller 150 connected downstream from the sheet folding controller 320. The sheet S may be conveyed to the envelope processing apparatus 100 without being folded in the sheet folding device 310.

Multiple types are assumed as the detailed structure of the sheet folding device 310. This difference in structure may cause a difference in the state of the folded sheet Sf after the folding processing. More specifically, an end portion corresponding to the leading end of the folded sheet Sf at a "specified position" of an enclosing device 120 to be described below in the enclosing direction in which the folded sheet Sf is enclosed into the envelope E may be different depending on the type of folding processing. Even in the same folding processing, an end portion corresponding to the leading end of the folded sheet Sf in the conveyance direction may be replaced with another end portion depending on an internal configuration of the sheet folding device 310. In other words, the determination result whether reverse processing for turning an enclosure into the "proper orientation" is to be performed may be different depending on the type of the sheet folding device 310. Accordingly, the sheet folding controller 320 notifies the envelope processing controller 150 of information indicating the type of the sheet folding device 310 in advance.

Embodiments of the sheet folding device 310 that perform different folding manners are described with reference to FIGS. 3A to 3E and FIGS. 4A to 4F. In the following description, the sheet folding device 310 illustrated in FIGS. 3A to 3E is referred to as "type A". The sheet folding device 310 illustrated in FIGS. 4A to 4F and FIGS. 5A to 5D is referred to as "type B". In FIGS. 3A to 3E, FIGS. 4A to 4F, and FIGS. 5A to 5D, the sheet S is attached with symbols Δ. The symbol Δ indicates a printing surface of the sheet S on which an image is formed (hereinafter, also referred to as an "image forming surface Ps"). In other words, in the following description, it is assumed that an image forming process is performed on one surface of the sheet S.

In FIGS. 3A to 3E, 4A to 4F, and 5A to 5D, the components of the sheet folding device 310 may be denoted by different reference numerals even if the components have the same function, operation, and effect. In the respective ranges of A type and B type, the components are consistently given reference signs. However, reference numerals of the components are different from the reference signs in the other drawings.

As illustrated in FIGS. 3A to 3E, a lower surface of the sheet S in the conveyance direction of the sheet S conveyed from the image forming apparatus 200 to the sheet folding device 310 corresponds to the image forming surface Ps.

Figure 3A:
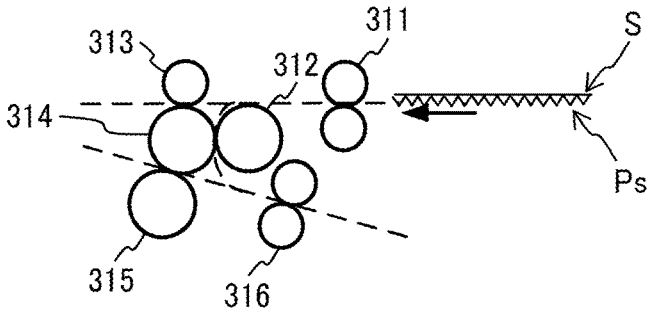
FIGS. 3A to 3E are diagrams illustrating an internal configuration of a folding processing section applicable to the image forming system of FIG. 1, according to an embodiment of the present disclosure.

First, as illustrated in FIG. 3A, the sheet S is conveyed from the image forming apparatus 200 toward a conveying roller pair 311.

Figure 3B:
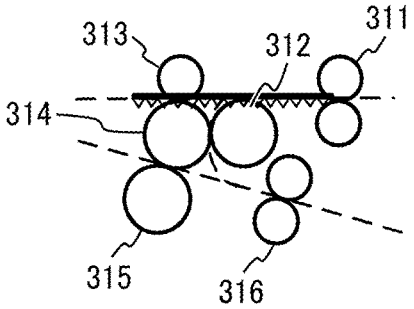

As illustrated in FIG. 3B, the sheet S conveyed downstream by the conveying roller pair 311 is conveyed to a specified position by a first folding roller 312, a first folding conveying roller 313, and a second folding roller 314.

Figure 3C:
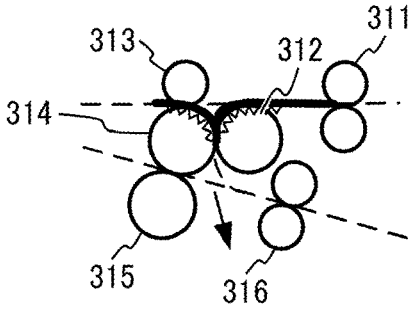

Subsequently, as illustrated in FIG. 3C, the first folding conveying roller 313 and the second folding roller 314 are rotated in reverse to form a first crease on the sheet S.

Figure 3D:
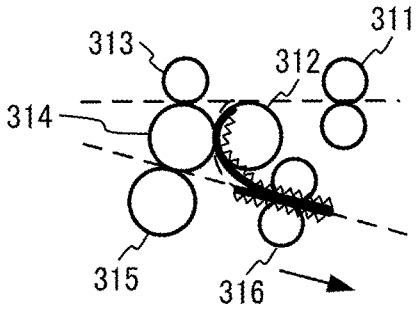

As illustrated in FIG. 3D, the first folding roller 312, the second folding roller 314, and a second folding conveying roller pair 316 conveys the sheet S, on which the first crease is formed, to a passage different from a passage through which the sheet S enters, and stops the sheet S at a specified position.

Figure 3E:
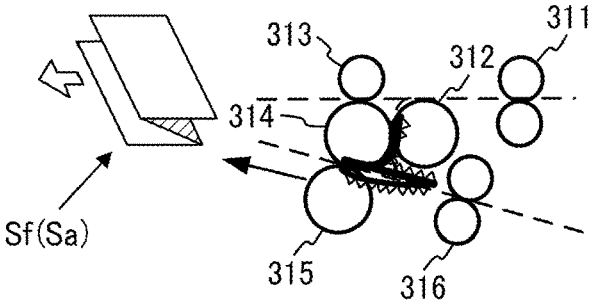

Subsequently, as illustrated in FIG. 3E, the second folding conveying roller pair 316 is rotated in reverse, and a third folding roller 315 is also rotated to convey the sheet S in a downstream direction. By this operation, a second crease is formed. Thus, the folded sheet Sf of outer three-folding or 6-page accordion is completed. In this case, the image forming surface Ps of the folded sheet Sf is positioned on a lower surface of the folded sheet Sf in the conveyance direction.

Figure 4A:
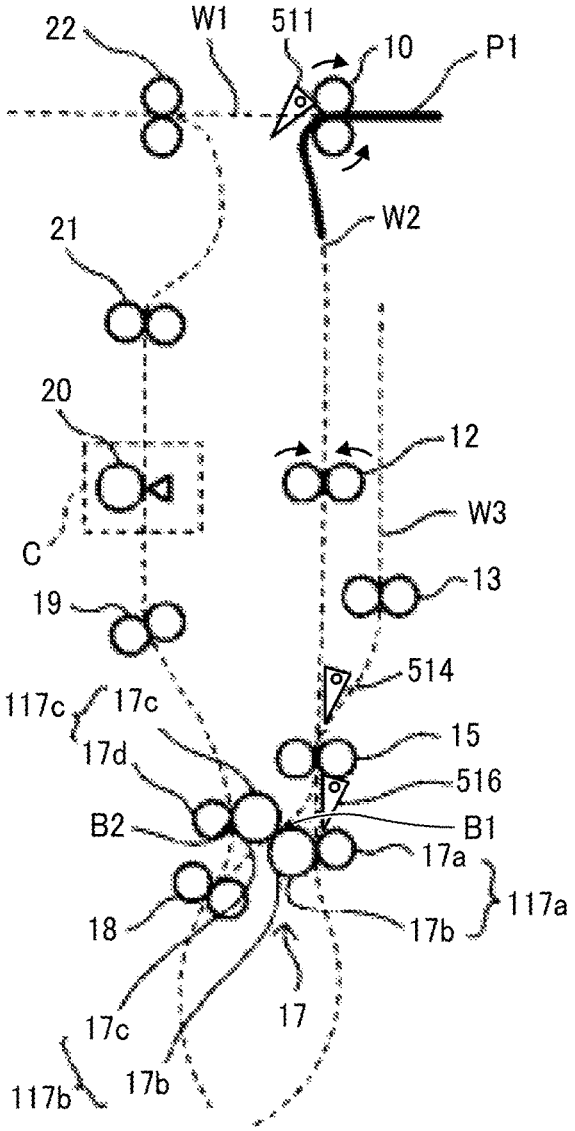
FIGS. 4A to 4F are diagrams illustrating an internal configuration of a folding processing section applicable to the image forming system of FIG. 1, according to another embodiment of the present disclosure.

Next, a description is given of the sheet folding device 310 of type B. FIGS. 4A to 4F are diagrams illustrating a sheet overlay operation performed by an overlay section of the sheet folding device 310. As illustrated in FIG. 4A, a first preceding sheet P1 is conveyed to a folding processing conveyance path W2. A leading end of the first preceding sheet P1 conveyed to the folding processing conveyance path W2 contacts a registration roller pair 15 to correct a skew of the first preceding sheet P1. This skew correction may not be performed.

Next, the registration roller pair 15 and a first conveying roller pair 117*a* serving as a first conveyor including a first pressing roller 17*a* and a first folding roller 17*b* convey the first preceding sheet P1 forward (i.e., conveys in a specified direction). When a trailing end of the first preceding sheet P1 has passed through a branching portion between the folding processing conveyance path W2 and a switchback conveyance path W3, the conveyance of the first preceding sheet P1 is stopped. Subsequently, a second branching member 514 is rotated in a clockwise direction in FIG. 4A, and the posture of the second branching member 514 is switched to guide the first preceding sheet P1 to the switchback conveyance passage W3.

Figure 4B:
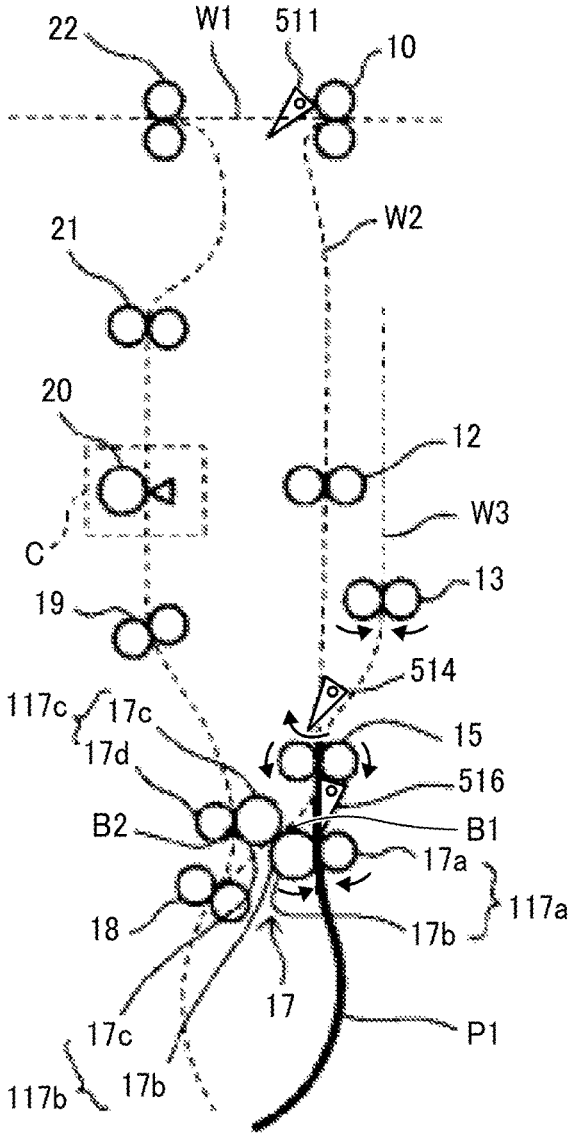

Then, as illustrated in FIG. 4B, the registration roller pair 15, the first conveying roller pair 117*a*, and a switchback conveying roller pair 13 are rotated in reverse. As a result, the first preceding sheet P1 is conveyed in reverse (conveyed in a direction opposite to a specified direction), and the first preceding sheet P1 is conveyed to the switchback conveyance passage W3. When the leading end of the first preceding sheet P1 during forward conveyance (i.e., conveyance in a specified direction) is conveyed to the switchback conveyance passage W3, the sheet conveyance of the switchback conveying roller pair 13 is stopped.

Figure 4C:
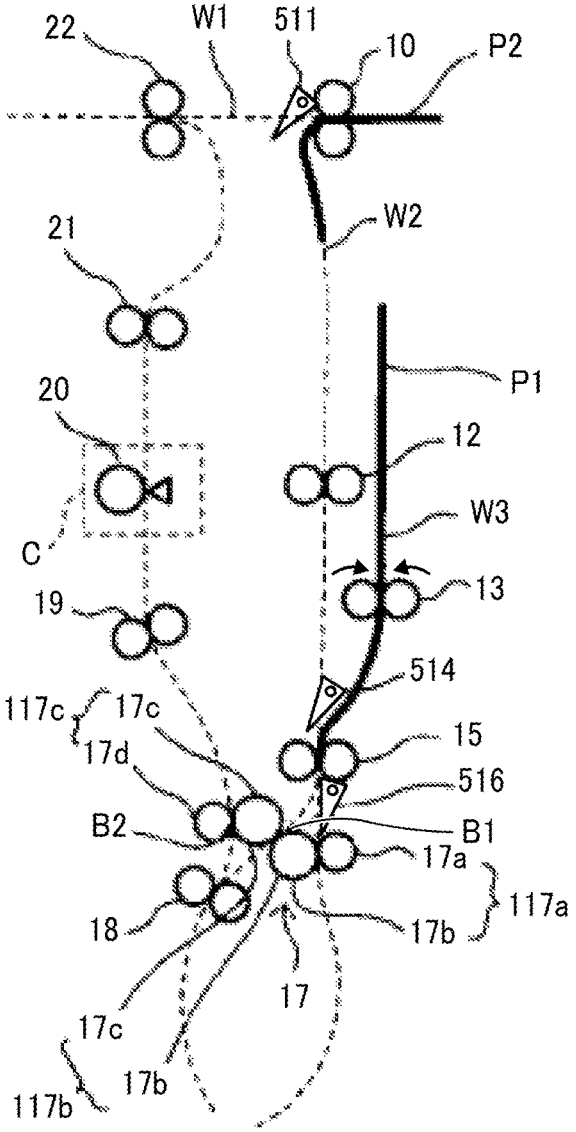

After the conveyance of the first preceding sheet P1 has stopped, as illustrated in FIG. 4C, the switchback conveying roller pair 13 conveys the first preceding sheet P1 forward (conveys the first preceding sheet P1 in the specified direction), causes the leading end of the first preceding sheet P1 to contact against the registration roller pair 15, and causes the first preceding sheet P1 to be on standby with skew corrected.

In this way, the preceding sheet P1 is conveyed to the switchback conveyance path W3 to evacuate from the folding processing conveyance path W2. The first preceding sheet P1 does not obstruct the conveyance of a subsequent sheet P2, thereby enabling smooth conveyance of the subsequent sheet P2.

Figure 4D:
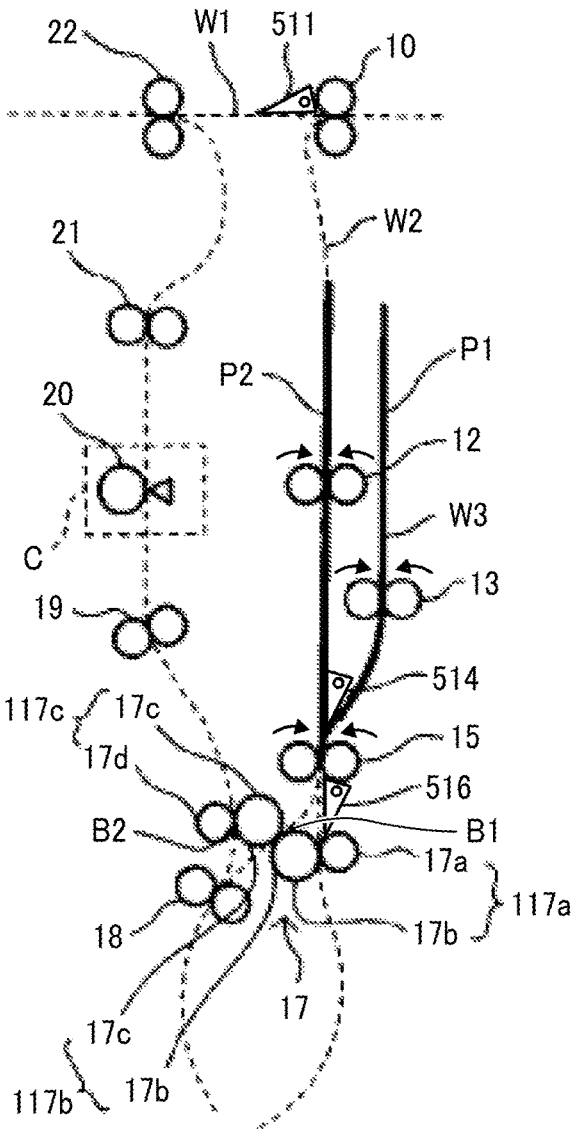

Next, a leading end of the second subsequent sheet P2 contacts the registration roller pair 15. As illustrated in FIG. 4D, after the leading end of the subsequent sheet P2 contacts the registration roller pair 15, a conveying roller pair 12 continues to convey the subsequent sheet P2 to bend the subsequent sheet P2 and perform skew correction.

Figure 4E:
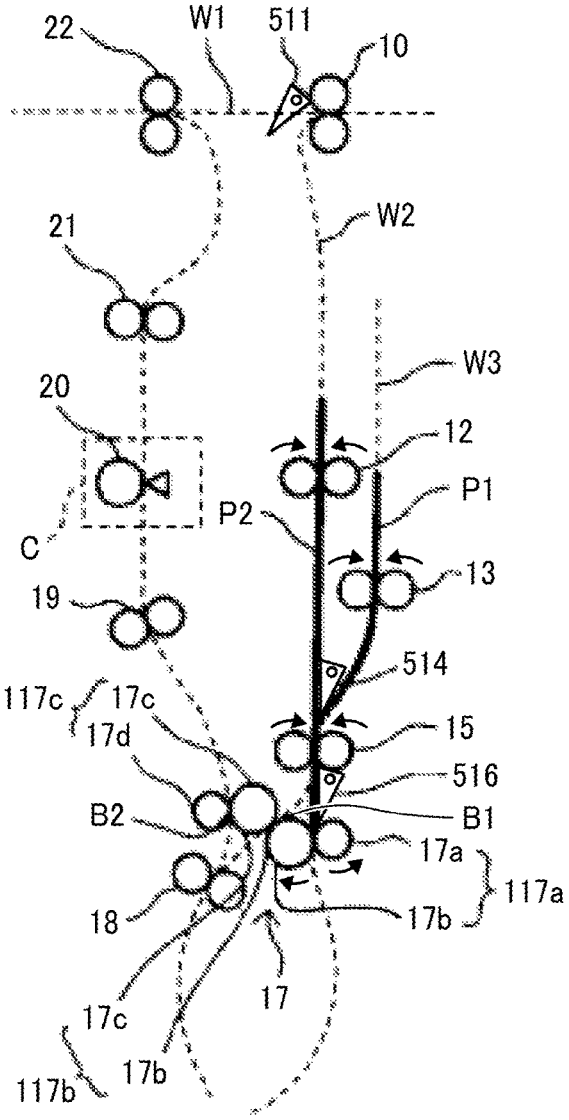
Figure 4F:
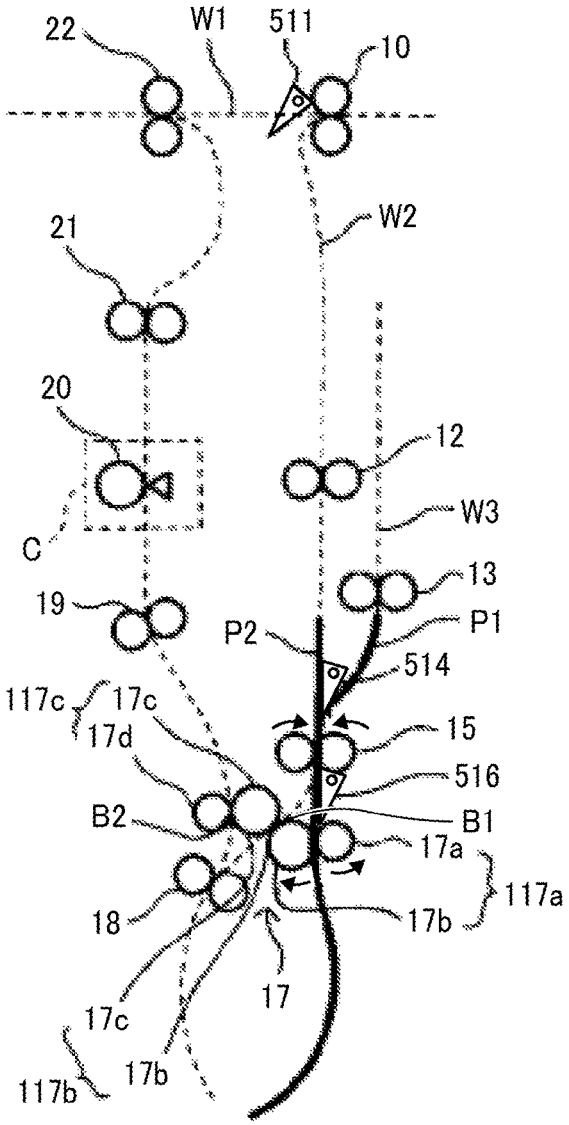

After a specified time in which the subsequent sheet P2 is bent by a specified deflection amount has passed, as illustrated in FIG. 4E, the registration roller pair 15, the switchback conveying roller pair 13, and the first conveying roller pair 117*a* rotate. The registration roller pair 15 conveys the first preceding sheet P1 and the second subsequent sheet P2 in an overlaid manner.

When the number of overlaid sheets reaches the number set by a user, a folding section B starts to perform multi-folding processing. On the other hand, when the number of overlaid sheets does not reach the number set by a user, the overlaid sheets are conveyed in reverse (conveyed in a reverse direction of the specified direction) when the trailing ends of the overlaid sheets have passed through the second branching member 514. Thus, the overlaid sheets are evacuated to the switchback conveyance passage W3. The sheets can be overlaid by repeating the above-described operation depending on the number of sheets to be overlaid.

In the present embodiment, as described above, the skew of the subsequent sheet P2 is corrected without stopping the rotation of the conveying roller pair 12, and the registration roller pair 15 starts to rotate when the bending amount of the subsequent sheet P2 has reached a specified amount. Thus, the preceding sheet P1 and the subsequent sheet P2 are overlaid without reducing productivity.

While the number of overlaid sheets does not reach the number set by a user, overlay processing without the skew correction by the registration roller pair 15 may be performed. When the number of overlaid sheets reaches the number set by the user, overlay processing with the skew correction by the registration roller pair 15 may be performed. In the registration processing with skew correction, a leading end of a preceding sheet (sheet bundle) is contacted against a registration roller pair to wait in a state where skew correction is performed, and a subsequent sheet is contacted against the registration roller pair to perform skew correction, and then, the subsequent sheets are overlaid and conveyed. On the other hand, in the overlay processing without the skew correction, the leading end of the preceding sheet P1 (sheet bundle) is on standby in a state where the preceding sheet P1 is evacuated in the switchback conveyance passage W3. The switchback conveying roller pair 13 starts to convey the preceding sheet P1 (sheet bundle) so that the preceding sheet P1 evacuated in the switchback conveyance passage W3 reaches the registration roller pair 15 when the subsequent sheet P2 reaches the registration roller pair 15. Thus, the switchback conveying roller pair 13 overlays the sheets, and the registration roller pair 15 conveys the overlaid sheets.

FIGS. 5A to 5D are diagrams illustrating a typical operation when the folding section of type B performs Z folding processing against a sheet S. The leading end of a sheet bundle Pt conveyed by the registration roller pair 15 after the overlay processing enters the first conveying roller pair 117*a* including the first folding roller 17*b* and the first pressing roller 17*a*. When the sheet bundle Pt is conveyed by a predetermined conveyance amount Δ1, a drive motor to drive a folding mechanism 17 rotates in reverse. The protrusion amount is appropriately determined depending on the length of the sheet bundle Pt in the sheet conveyance direction and the content of the folding processing such as folding manner.

Figure 5A:
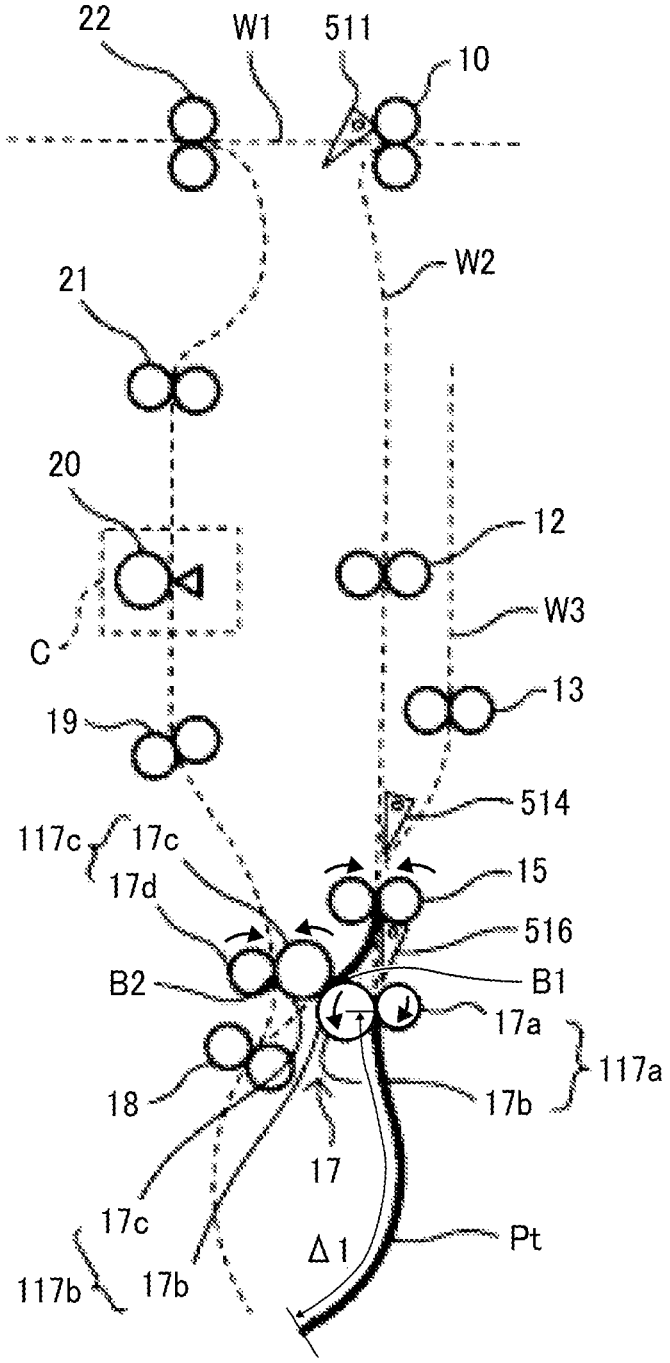
FIGS. 5A to 5D are diagrams illustrating an internal configuration of a folding processing section applicable to the image forming system of FIG. 1, according to still another embodiment of the present disclosure.

The drive motor to drive the folding mechanism 17 is rotated in reverse to convey the sheet bundle Pt, which is nipped by the first conveying roller pair 117*a*, in reverse (convey the sheet bundle Pt in a direction opposite to a specified direction). This operation forms a bend in the sheet bundle portion between the registration roller pair 15 and the first conveying roller pair 117*a* as illustrated in FIG. 5A. This bend portion, which is also called a folded-back portion, enters a nip of a first folding roller pair 117*b* serving as a first folding unit including the first folding roller 17*b* and a second folding roller 17*c* to form a first folded portion in the folded-back portion. The first folded portion that has passed through the nip of the first folding roller pair 117*b* is conveyed toward a second conveying roller pair 18 serving as a second conveyor.

The first folded portion of the sheet bundle Pt enters the nip of the second conveying roller pair 18. When the second conveying roller pair 18 conveys the sheet bundle Pt by a predetermined conveyance amount Δ2, the second conveying roller pair 18 rotates in reverse and conveys the sheet bundle Pt nipped by the second conveying roller pair 18 in reverse (conveys the sheet bundle Pt in the direction opposite to the specified direction). The conveyance amount Δ2 in this case is appropriately determined depending on the length of the sheet bundle Pt in the sheet conveyance direction and the content of the folding processing such as folding manner.

The reverse conveyance of the sheet bundle Pt nipped by the second conveying roller pair 18 forms a bend in the sheet portion between the first folding roller pair 117*b* and the second conveying roller pair 18.

Figure 5B:
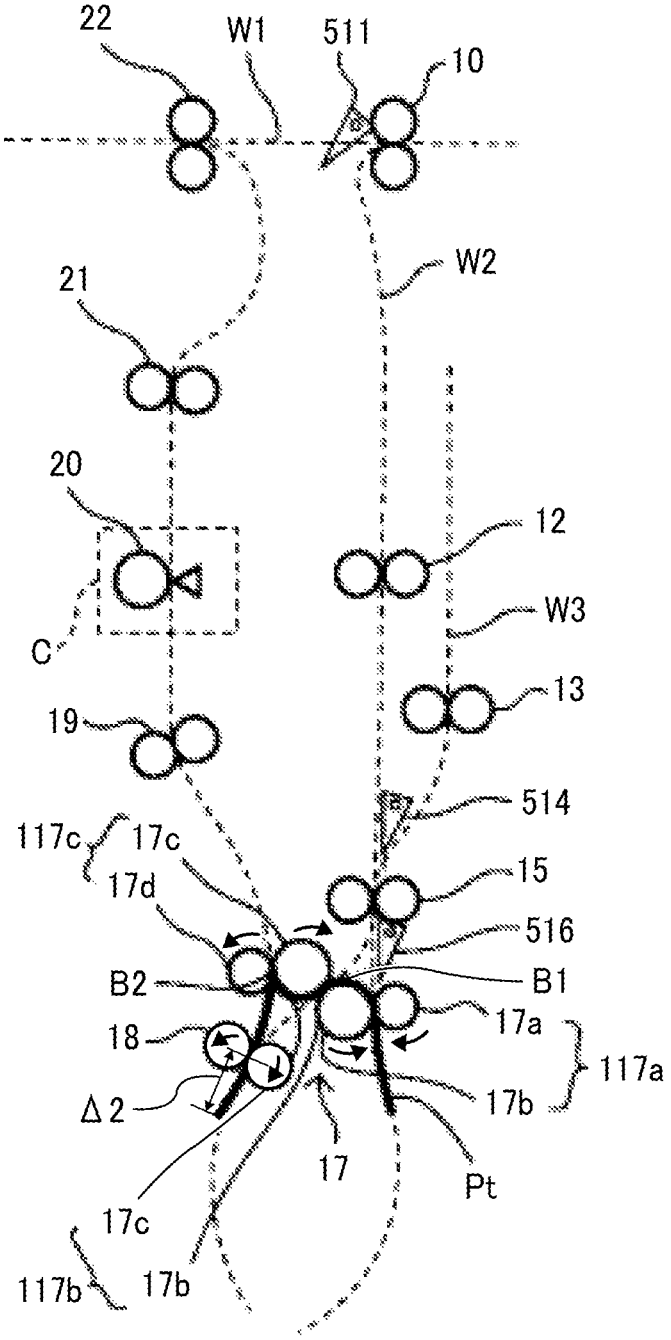

As illustrated in FIG. 5B, this bent portion (a folded-back portion) enters a nip between a second folding roller pair 117*c* serving as a second folding unit including the second folding roller 17*c* and a second pressing roller 17*d* to form a second folded portion in the folded-back portion.

Figure 5C:
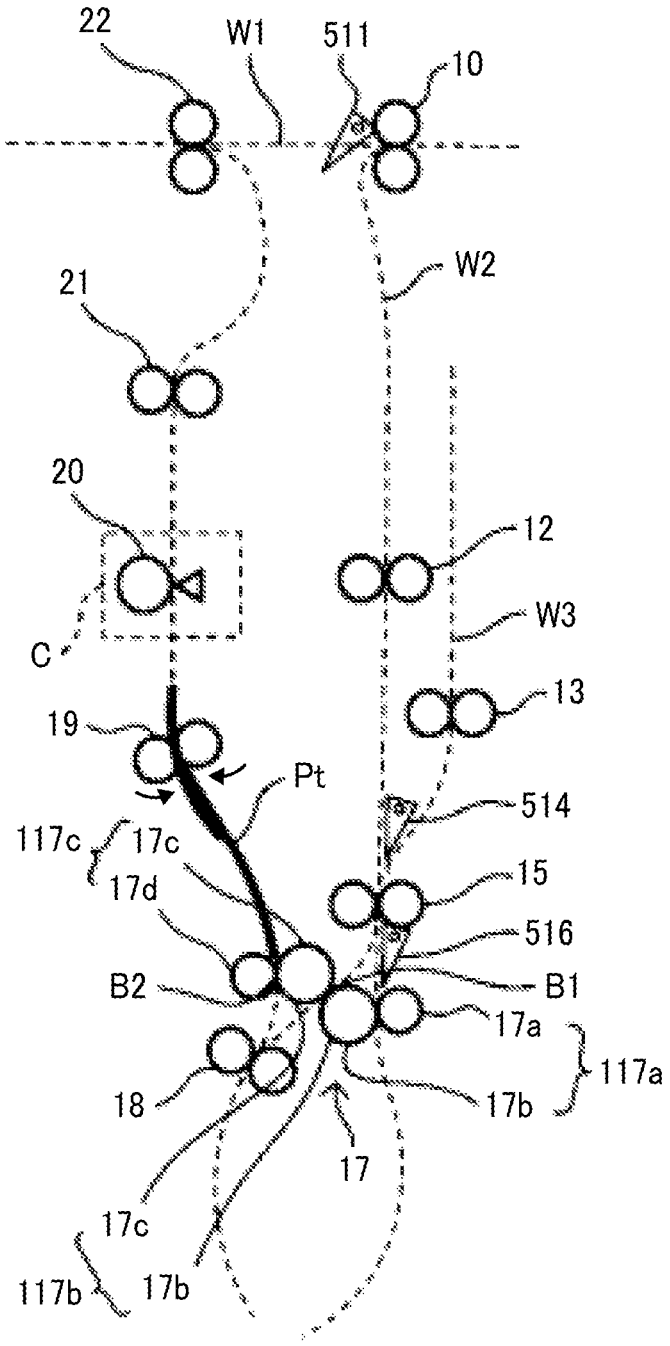

As illustrated in FIG. 5C, an intermediate conveying roller pair 19 conveys the sheet bundle Pt, which has passed through the nip of the second folding roller pair 117*c* and has the two folded portions formed as described above, toward an additional folding roller 20.

Figure 5D:
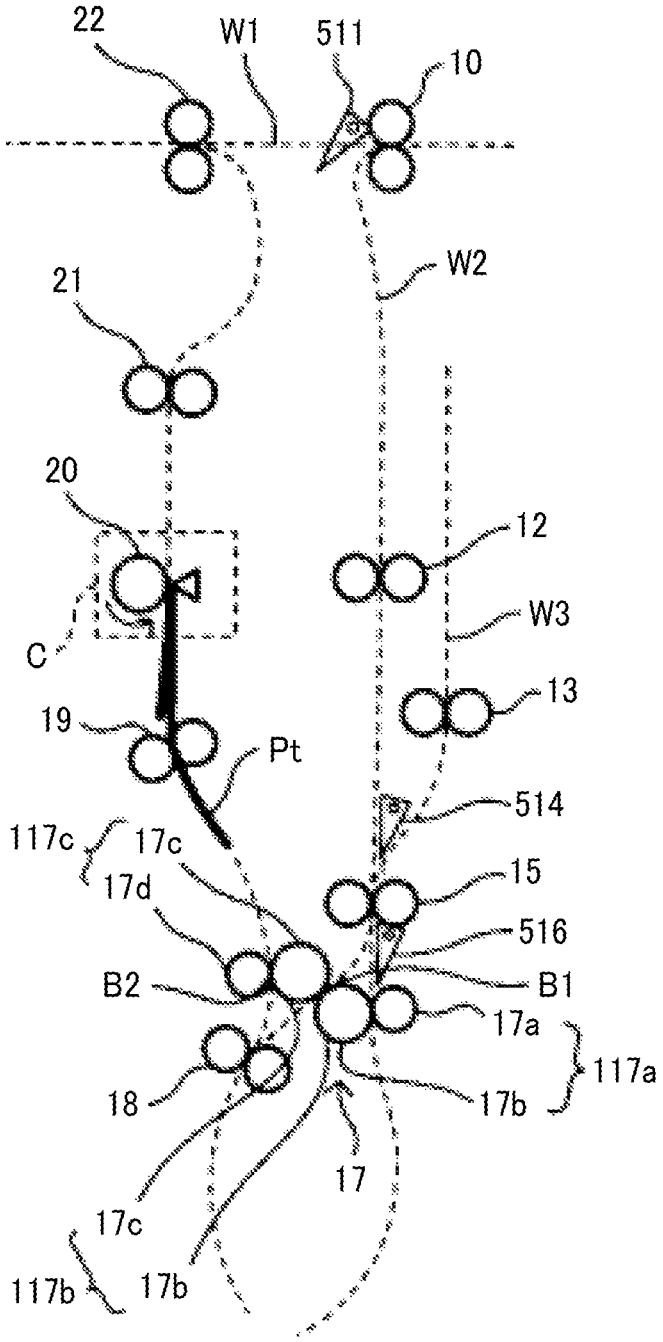

As illustrated in FIG. 5D, when the second folded portion has reached the position opposite the additional folding roller 20, the conveyance of the sheet bundle Pt is stopped. Subsequently, the additional folding roller 20 is rotated to put a sharp crease at the second folded portion, and then, the conveyance of the sheet bundle Pt is resumed. When the first folded portion has reached the position opposite the additional folding roller 20, the conveyance of the sheet bundle Pt is stopped. The additional folding roller 20 is rotated to put a sharp crease at the first folded portion, and then, the conveyance of the sheet bundle Pt is resumed. Two conveying roller pairs 21 and 22 convey the sheet bundle Pt to eject the sheet bundle Pt to the post-processing apparatus 400.

The above description is about the case where the sheet bundle Pt having been subjected to the overlay processing is folded. The folding processing operation of folding one sheet is also performed in a similar manner. In the above description, Z-folding processing is described. The same operation as the Z-folding processing is performed while properly changing the conveyance amount Δ1 and the conveyance amount Δ2, thus enabling inner three-folding and outer three-folding to be performed. In two-folding processing, a third branching member 516 is rotated in a clockwise direction in FIGS. 5A to 5D to take a posture for guiding the sheet to the first folding roller pair 117*b*. The sheet conveyed from the registration roller pair 15 is conveyed to the first folding roller pair 117*b*. The same operation as the above-described operation to form the second folded portion forms the folded portion at the center of the sheet in the sheet conveyance direction, thus enabling the two-folding to be performed.

In other words, the folding apparatus 300 according to the present embodiment includes a folding position adjustor that can adjust the position at which a crease is formed in a plurality of different types of folding processing.

Figure 6A:
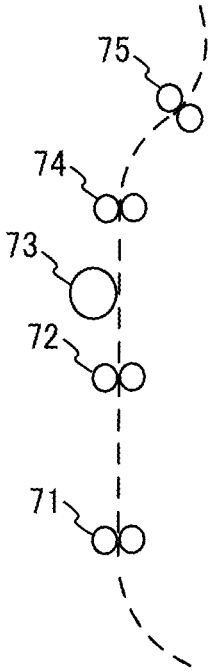
FIGS. 6A to 6D are diagrams illustrating an internal configuration of a folding processing section applicable to the image forming system of FIG. 1, according to still yet another embodiment of the present disclosure.

Next, a description is given of an additional folding mechanism as an additional folding device included in the sheet folding device 310 with reference to FIGS. 6A to 6D. As illustrated in FIG. 6A, the additional folding mechanism includes a plurality of conveying roller pairs (71, 72, 74, and 75). An additional folding roller 73 is disposed in the middle of a conveyance path formed by arrangement of the conveying roller pairs. The additional folding roller 73 includes a mechanism for performing "additional folding processing" as processing to press again a crease once formed on a sheet S.

Figure 6B:
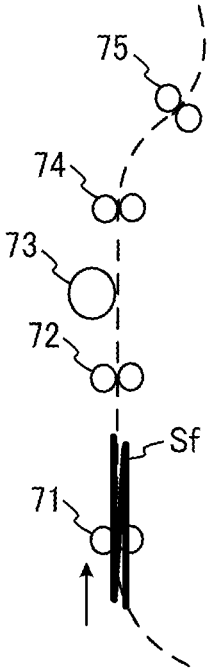
Figure 6C:
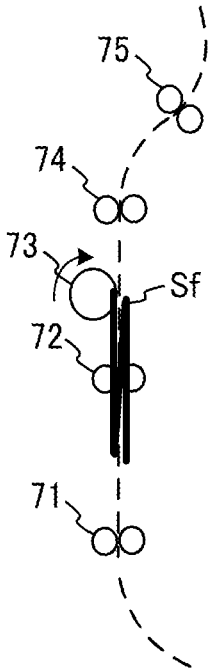

As illustrated in FIG. 6B, the folded sheet Sf, which has been ejected from the image forming apparatus 200 and has been subjected to folding processing in the sheet folding device 310, is conveyed from upstream from the additional folding mechanism in the conveyance direction of the folded sheet Sf. For convenience of explanation, it is assumed that the folded sheet Sf has been subjected to the "outer three-folding" processing.

When the leading end of the folded sheet Sf in the conveyance direction has reached the additional folding roller 73, the conveyance of the folded sheet Sf is temporarily stopped. In a state where the crease at the leading end of the folded sheet Sf is placed at the position of the additional folding roller 73, the additional folding roller 73 is rotated to press the crease at the leading end of the folded sheet Sf. This pressing applies a pressure to the once-formed crease in a direction to fold the once-formed crease again. Thus, the crease is formed more clearly. This additional folding processing can lower the height (reduce the thickness) of the crease of the folded sheet Sf. As the rotation amount of the additional folding roller 73 is increased, the height of the crease can be reduced.

Figure 6D:
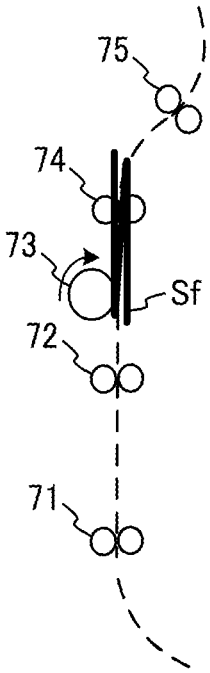

After the additional folding is performed on the crease at the leading end portion in the conveyance direction, as illustrated in FIG. 6D, the conveyance of the folded sheet Sf is resumed. The folded sheet Sf is conveyed downstream by this conveyance. When the crease at the trailing end portion (rearmost end) of the folded sheet Sf in the conveyance direction has reached the additional folding roller 73, the conveyance is stopped again. In a state where the crease at the trailing end portion of the folded sheet Sf is placed at the position of the additional folding roller 73, the additional folding roller 73 is rotated to press the crease of the folded sheet Sf.

When the processing of additionally pressing the crease of the folded sheet Sf by the additional folding roller 73 has completed, the conveyance of the folded sheet Sf is resumed, and the folded sheet Sf is conveyed downstream from the additional folding roller 73. As described above, after the crease formed on the folded sheet Sf is pressed and the additional folding processing is performed, the folded sheet Sf is delivered to the envelope processing apparatus 100.

The number of times of the additional folding is not limited to one. For example, if the printer system 1 has the function of allowing a user to set the number of times of additional folding to the printer controller 260 via the operation unit 220, the printer controller 260 notifies the sheet folding controller 320 of information indicating the set number of times of additional folding. The sheet folding controller 320 repeatedly performs the operations illustrated in FIGS. 6C and 6D depending on the notified number of times of additional folding. In this case, the information indicating the number of times of additional folding is also notified from the sheet folding controller 320 to the envelope processing controller 150. As described below, the envelope processing controller 150 may refer to the information of the thickness of the enclosure when the opening amount of the envelope E is adjusted. Accordingly, when the information for adjusting the opening amount of the envelope E is calculated, the thickness of the enclosure is calculated from the number of times of additional folding, and the information of the thickness of the enclosure may be used in some cases.

Returning to FIG. 2, a description is given below. The envelope processing apparatus 100 includes a sheet reverse processing device 110, the enclosing device 120, a sealer 130, and the envelope processing controller 150.

The sheet reverse processing device 110 performs sheet conveyance processing for conveying the folded sheet Sf, which is conveyed from the sheet folding device 310, to the enclosing position, depending on the orientation of the image forming surface of the folded sheet Sf Here, the "sheet conveyance processing" is conveyance processing corresponding to various adjustment values (data used for execution of a print job instructed by a user, including, e.g., the type of folding and the position of a printed surface) transmitted from the sheet folding controller 320 to the envelope processing controller 150 through a communication line 105. The sheet reverse processing device 110 performs, for example, the conveyance processing for conveying the folded sheet Sf downstream in the conveyance direction or the reverse conveyance processing for replacing ends of the folded sheet Sf in the conveyance direction. The folded sheet Sf is conveyed to the enclosing device 120 or the post-processing apparatus 400 by the conveyance processing or the reverse conveyance processing.

The enclosing device 120, which is an enclosing device and serves as an enclosing section, includes a mechanism that moves the envelope E to a position where the folded sheet Sf conveyed from the sheet reverse processing device 110 can be enclosed, causes the envelope E to be on standby at the enclosing position, and encloses an enclosure into the envelope E which is on standby. The enclosing device 120 includes a mechanism that opens a flap ef so that the opening of the envelope E is opened before the envelope E reaches the enclosing position. The enclosing device 120 also includes a mechanism that calculates the length of the envelope E (the dimension in the direction in which the enclosure is enclosed) and the length of the flap ef before the envelope E has reached the enclosing position. With these mechanisms, the enclosing processing of the folded sheet Sf is performed on the envelope E that is held at the enclosing position with an opening of the envelope E open. This enclosing processing can be properly performed on envelopes E of various types and sizes.

The sealer 130 performs processing of ejecting the sealed envelope E to an envelope ejection tray 134 after the flap ef of the envelope E in which the folded sheet Sf has been enclosed is closed.

The envelope processing controller 150 controls operations of a plurality of conveying rollers constituting the sheet reverse processing device 110, the enclosing device 120, and the sealer 130 and operations of a plurality of switching members that change the conveyance path of the envelope E. The configuration of the envelope processing controller 150 that controls the enclosing processing may be a configuration included in the enclosing device 120 serving as an enclosing device.

The envelope processing controller 150 is a controller that performs conveyance control including reversing control and enclosing control of the folded sheet Sf. The envelope processing controller 150 receives "enclosing target information", which is data included in various adjustment values and information related to the folded sheet Sf, from the printer controller 260 and the sheet folding controller 320. The conveyance control is performed based on the content indicated by each piece of information included in the received enclosing target information.

Note that the "enclosing target information" is information related to the sheet S or the folded sheet Sf as enclosures to be enclosed. More specifically, the "enclosing target information" includes information for controlling an end (a leading end in a conveyance direction) that is a top of the sheet S or the folded sheet Sf when the sheet S or the folded sheet Sf is enclosed in the envelope E to be an end on a desired side. Examples of the enclosing target information include "folding type information" that indicates the type of folding processing having been subjected to the folded sheet Sf and whether additional folding is performed on the folded sheet Sf Examples of operation instruction information from the image forming apparatus 200, which is one of upstream side apparatuses, include "reversal necessity information" which defines necessity of the reversal conveyance processing described below. Examples of the operation instruction information also include print surface information indicating an image forming surface on which an image is formed on the folded sheet Sf Examples of the operation instruction information further include "processing device information" indicating the type of the sheet folding device 310 that has performed the folding processing.

The post-processing apparatus 400 includes a post-processing device 410 and a post-processing controller 420. The post-processing device 410 executes specified post-processing on the sheet S conveyed from the upstream side under the control of the post-processing controller 420. The post-processing controller 420 controls the post-processing operation in the post-processing controller 420 depending on the operation mode transmitted from the printer controller 260, the sheet folding controller 320, and the envelope processing controller 150 through a communication line 403.

The printer controller 260, the sheet folding controller 320, the envelope processing controller 150, and the post-processing controller 420 are connected to each other to exchange information necessary for control through the communication lines 207, 105, and 403. Accordingly, the controllers 260, 320, 150, and 420 cooperate with each other to share the sheet size and information about the processing mode requested by a user to be performed on the sheet S and the folded sheet Sf. As a result, the entirety of the printer system 1 shares control information that allows each of the mechanisms described above to perform specified processing with specified timing and a specified process.

The envelope processing controller 150 that performs a central control operation in the present embodiment includes a central processing unit (CPU) as an arithmetic processing unit, and a read only memory (ROM) and a random access memory (RAM) as storage units. The envelope processing controller 150 includes an interface that outputs control signals to the conveying roller pairs and inputs signals from the conveying roller pair a type ofs, and an interface that receives output signals from sensors. The operation of the envelope processing apparatus 100 is controlled by a control program that can execute control processing using above-described hardware resources. Details of functional blocks of the envelope processing controller 150 are given below.

Similarly to the envelope processing controller 150, the printer controller 260, the sheet folding controller 320, and the post-processing controller 420 also control the operation of hardware mechanisms by control programs that perform respective functions using hardware resources including, for example, the CPU, the ROM, and the RAM.

In FIGS. 1 and 2, the example in which the post-processing apparatus 400 is coupled to the downstream side of the envelope processing apparatus 100 is illustrated as an example of the configuration of the printer system 1. Typical examples of the post-processing apparatus 400 include a finisher that performs stapling processing, a stacker, and a bookbinding machine. The system configuration of the printer system 1 may be such a configuration in which the envelope processing apparatus 100 is located on the most downstream side.

A control operation according to an embodiment of the printer system 1 is described. In the present embodiment, conveyance control processing for the envelope E is executed based on the envelope length of the envelope E and the flap length of the flap ef calculated by the enclosing device 120 to be described below.

The envelope processing controller 150 executes processing that calculates an "envelope length" corresponding to the length in the conveyance direction by the control processing program before the envelope E is conveyed to the enclosing position. The control processing program also executes processing that calculates a "flap length" corresponding to the length of a flap ef of the envelope E in the conveyance direction. Processing is also executed that calculates a body length corresponding to the length of a body portion of the envelope E. The envelope processing controller 150 also executes processing that notifies the printer controller 260 of the calculated envelope length, flap length, and body length via the sheet folding controller 320, the post-processing controller 420, and the sheet folding controller 320.

In the present embodiment, the envelope length corresponds to a distance between both ends of the envelope E in the conveyance direction when the envelope E is supplied to an envelope conveyance passage 1105 to be described below. In other words, the envelope length refers to a distance between a leading end and a trailing end of the envelope E in a moving direction of the envelope E that is conveyed toward the envelope conveyance passage 1105 via an envelope entry passage 1107 to be described below from the state in which the envelope E is placed on an envelope load tray 127 to be described below.

In the present embodiment, the envelope length includes an envelope length when the envelope is conveyed with the flap ef closed (assumed to be a first envelope length) and an envelope length when the envelope is conveyed with the flap ef open (assumed to be a second envelope length) in the conveyance direction defined as the above-described moving direction.

The first envelope length is a so-called top-bottom dimension of the envelope E, and corresponds to a distance from the bottom of the envelope E to the position at which the flap ef is folded. In other words, the first envelope length corresponds to a "body length" as a length of the body portion of the envelope E in the conveyance direction.

The second envelope length corresponds to a distance from the bottom of the envelope E to an end of the flap ef in a state where the flap ef is open. In addition, a value obtained by subtracting the first envelope length from the second envelope length corresponds to a length from an end of the flap ef in the conveyance direction in a state where the flap ef is open to the folding position at which the flap ef is folded against the envelope E. Thus, this length corresponds to a "flap length".

Figure 7:
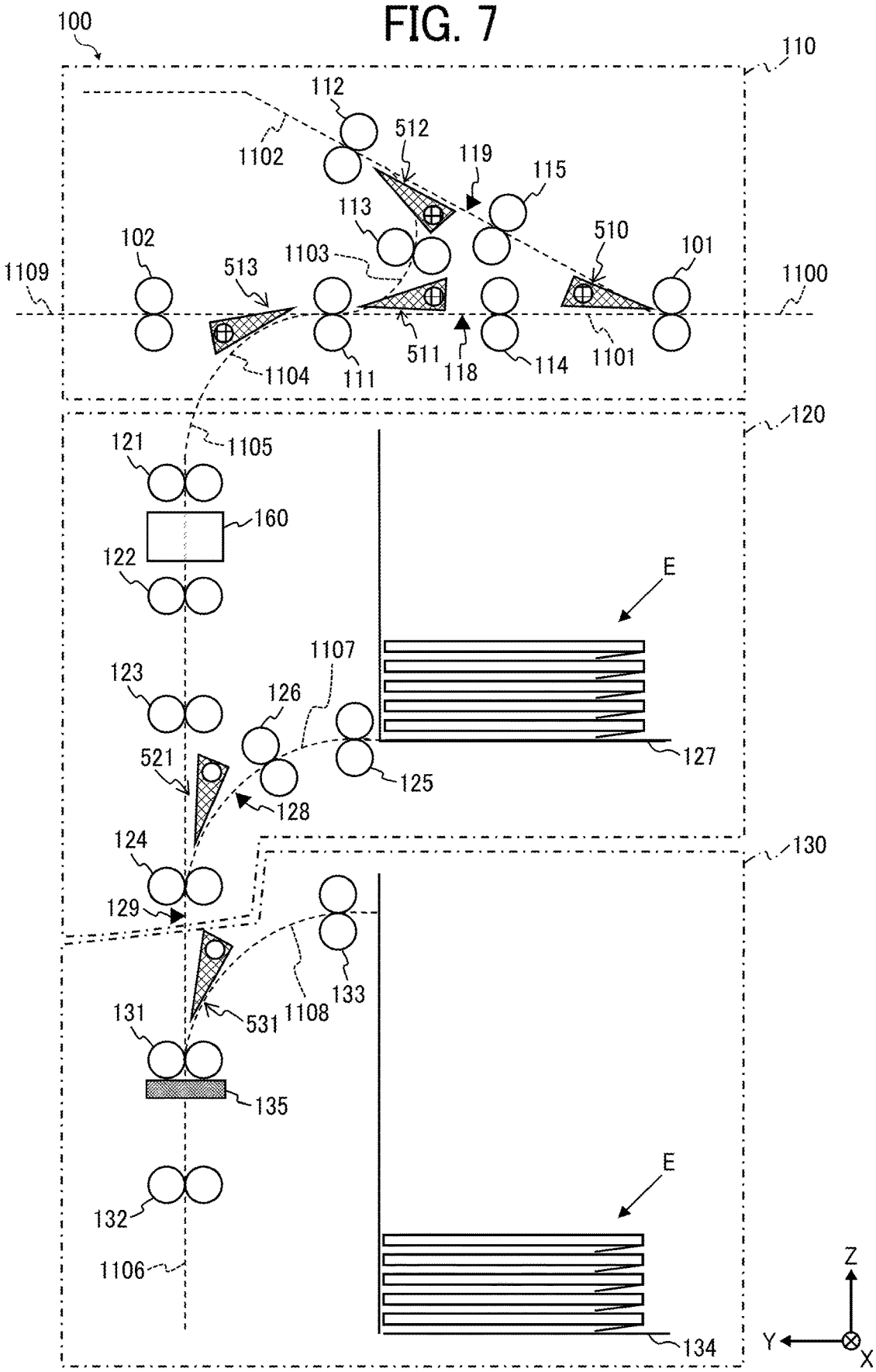
FIG. 7 is a diagram illustrating an internal configuration of an envelope processing apparatus according to an embodiment of the present disclosure.

Next, with reference to FIG. 7, a description is given of conveying roller pairs constituting the sheet reverse processing device 110, the enclosing device 120, and the sealer 130 disposed in the envelope processing apparatus 100, switching members that switch the conveyance direction of a conveyance object, and conveyance passages on which these components are arranged.

As illustrated in FIG. 7, the sheet reverse processing device 110 includes a plurality of conveyance paths mainly distinguished as an entry passage 1100, a first conveyance passage 1101, a second conveyance passage 1102, a switchback conveyance passage 1103, an enclosing conveyance passage 1104 as a fourth conveyance passage, and a sheet exit passage 1109.

The sheet reverse processing device 110 performs processing that turns the conveyed object into a proper direction when the conveyed object is enclosed in the envelope E. When the sheet reverse processing device 110 does not perform enclosing processing to be described below on the folded sheet Sf conveyed from the folding apparatus 300, the sheet reverse processing device 110 passes the folded sheet Sf carried by an entrance roller pair 101, from the entry passage 1100 toward the first conveyance passage 1101. The folded sheet Sf is ejected to an apparatus on the downstream side via the sheet exit passage 1109.

When the sheet reverse processing device 110 performs enclosing processing to be described below on the folded sheet Sf conveyed from the folding apparatus 300, the sheet reverse processing device 110 conveys the folded sheet Sf to the enclosing conveyance passage 1104 serving as the fourth conveyance passage that branches from the first conveyance passage 1101 and communicates with an enclosing roller pair 121 that holds the envelope E. As described below, the enclosing conveyance passage 1104 communicates with an envelope conveyance passage 1105.

As illustrated in FIG. 7, the enclosing device 120 includes the envelope conveyance passage 1105 connected to the enclosing conveyance passage 1104 serving as the fourth conveyance passage that receives the folded sheet Sf as an enclosure from the sheet reverse processing device 110. The envelope conveyance passage 1105 includes an enclosing support 160 serving as an enclosing unit that supports to smoothly enclose the enclosure at the enclosing position where the envelope E is stopped to stand by in order to enclose the enclosure.

A detailed configuration of the enclosing support 160 is described below. The enclosing support 160 is part of an enclosing support mechanism that operates by conveyance control processing for conveying the envelope E to the enclosing position. The enclosing support 160 includes a configuration for evacuating the flap ef, which may be an obstacle for the enclosure conveyed toward the enclosing position to enter the envelope E, from the envelope conveyance passage 1105. The enclosing support 160 holds the flap ef at an evacuating position separated from the envelope conveyance passage 1105. As a result, a state in which the flap ef does not obstruct the entry (enclosing) of the enclosure into the envelope E is formed.

The enclosing support 160 expands the frontage of the envelope E while maintaining the flap ef at the evacuating position, and performs an operation of supporting the enclosing operation so that the enclosing of the enclosure is smoothly performed. The operation that supports the enclosing operation is an operation in which an opening adjustment amount calculated by opening amount adjustment processing is taken into account. The opening amount adjustment processing adjusts the opening amount of the frontage of the envelope E, depending on the body length and the flap length of the envelope E, when the enclosure is inserted into the envelope E. In addition to the above-described processing, the opening amount adjustment processing also includes processing of calculating the opening amount in accordance with the number (number of sheets), thickness, and shape (type of folding processing and type of additional folding) of enclosures enclosed in the same envelope E and adjusting the opening operation based on the calculated opening amount. In other words, the enclosing support 160 functions as FIG. 1 is a front view of an internal configuration of a printer system 1 as an example of the image forming system. FIG. 1 is a front view of an internal configuration of a printer system 1 as an example of the image forming system. an opening amount adjustor.

The envelope conveyance passage 1105 is coupled with a sealing conveyance passage 1106 for performing sealing processing on the envelope E in which the enclosure is enclosed. The envelope conveyance passage 1105, the enclosing conveyance passage 1104, and the sealing conveyance passage 1106 are coupled together in a standing state to form an envelope conveyance path.

A first vertical conveying roller pair 122 and a second vertical conveying roller pair 123 are disposed in the envelope conveyance passage 1105. The first vertical conveying roller pair 122 and the second vertical conveying roller pair 123 serve as envelope conveyors for conveying the envelope E to a position where the folded sheet Sf is received. In the envelope conveyance passage 1105, when the envelope E is conveyed to the position where the folded sheet Sf is received, the envelope E is held by the enclosing roller pair 121. The enclosing support 160 is disposed between the enclosing roller pair 121 and the first vertical conveying roller pair 122.

A flap opening roller pair 124 is disposed at a junction position of the conveyance passage extending from the envelope conveyance passage 1105 to the sealing conveyance passage 1106. The flap opening roller pair 124 includes a flap opening mechanism 180 for opening the flap ef when the envelope E is taken out from the envelope load tray 127 and is conveyed to a position before joining with the envelope conveyance passage 1105 through the envelope entry passage 1107. A detailed description of the flap opening mechanism 180 is given below.

A separation sensor 128 for detecting the first envelope length in a state where the flap ef is closed is disposed upstream from the flap opening roller pair 124 in the conveyance direction. A flap opening detection sensor 129, which is a sensor for detecting whether the flap ef is open (i.e., whether in a state where the flap ef is opened) and for detecting the second envelope length, is disposed downstream from the flap opening roller pair 124 in the conveyance direction.

An envelope switchback switching member 521 is disposed at a junction where the envelope entry passage 1107 joins with the envelope conveyance passage 1105.

An envelope separation roller pair 125, an envelope conveying roller pair 126, and the separation sensor 128 serving as a first envelope detector are disposed in the envelope entry passage 1107 that joins the envelope conveyance passage 1105. The envelope load tray 127 is disposed at an end of the envelope entry passage 1107. Together with the envelope conveyance passage 1105, the envelope entry passage 1107 also constitutes the envelope conveyance path.

Multiple envelopes E are stacked on the envelope load tray 127. The envelope E placed on the envelope load tray 127 is in a state where the bottom which is an opposite end of the flap effaces the envelope separation roller pair 125. When the envelope E is ejected from the envelope load tray 127, the leading end of the envelope E in the conveyance direction corresponds to the bottom portion of the envelope E. Accordingly, the end of the portion where the flap ef is provided is the trailing end of the envelope E.

One envelope E is picked up from multiple envelopes E placed on the envelope load tray 127 by the envelope separation roller pair 125 and passes through the envelope entry passage 1107 by the envelope separation roller pair 125 and the envelope conveying roller pair 126. Thus, the envelope E is conveyed to a position beyond the envelope switchback switching member 521. When the trailing end of the envelope E in the conveyance direction has reached the position beyond the envelope switchback switching member 521 together with the conveyance by the flap opening roller pair 124, the envelope switchback switching member 521 rotates and switches to a state in which the envelope E can be conveyed in a switchback manner.

In other words, the envelope switchback switching member 521 rotates between a position for temporarily conveying the envelope E taken out from the envelope load tray 127 to the sealing conveyance passage 1106 and a position for conveying the envelope E toward the sheet reverse processing device 110 in the envelope conveyance passage 1105. The envelope switchback switching member 521 switches the conveyance direction of the envelope E in the envelope conveyance passage 1105.

The first vertical conveying roller pair 122 and the second vertical conveying roller pair 123 convey and hold the envelope E to an enclosing position as a specified position in the envelope conveyance passage 1105. As described below, the enclosing position is a position where the position of the opening of the envelope E (the position of the flap ef) is lower than the enclosing roller pair 121 and higher than the first vertical conveying roller pair 122.

The enclosing roller pair 121 is a type of conveying roller pairs, each of which rotates in a direction in which the folded sheet Sf conveyed from the sheet reverse processing device 110 is enclosed in the envelope E.

As illustrated in FIG. 7, the sealer 130 includes a third vertical conveying roller pair 131 and a fourth vertical conveying roller pair 132 in the sealing conveyance passage 1106. A sealing device 135 is disposed to close the flap ef of the envelope E in which the enclosure is enclosed between the third vertical conveying roller pair 131 and the fourth vertical conveying roller pair 132.

The third vertical conveying roller pair 131 and the fourth vertical conveying roller pair 132 convey and hold the envelope E to a specified position in the sealing conveyance passage 1106.

An envelope ejection switching member 531 is disposed at a branching position at which an envelope ejection passage 1108 branches from the sealing conveyance passage 1106. An envelope ejection roller pair 133 is disposed at an end of the envelope ejection passage 1108. The envelope ejection roller pair 133 is a roller pair that ejects the envelope E toward the envelope ejection tray 134. The envelope ejection tray 134 is a tray on which the ejected envelope E is placed.

The envelope ejection switching member 531, which is a member that switches the conveyance direction of the envelope E, rotates between a position at which the envelope E is conveyed from the flap opening roller pair 124 to the third vertical conveying roller pair 131 in the enclosing conveyance passage 1104 and a position at which the envelope E is conveyed from the enclosing conveyance passage 1104 to the envelope ejection passage 1108.

As described above, the conveyance paths that convey the folded sheet Sf from the envelope processing apparatus 100 to the enclosing device 120 and the sealer 130 are disposed in connection with each other in the vertical direction (Z direction) in the envelope processing apparatus 100. This connected conveyance path, which serves as both a conveyance path for the folded sheet Sf and a conveyance path for the envelope E, corresponds to a vertical conveyance path in which the envelope conveyance passage 1105 of the enclosing device 120 and the sealing conveyance passage 1106 of the sealer 130 are connected in the vertical direction (Z direction).

Figure 8:
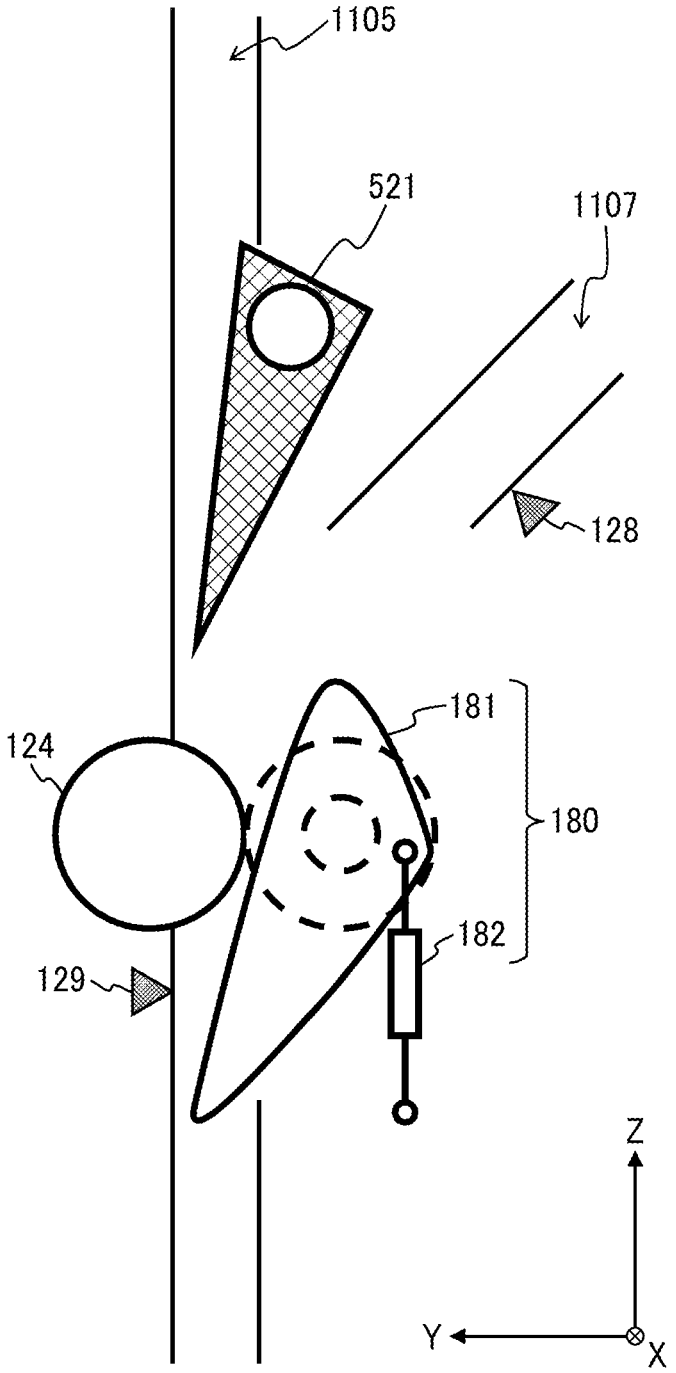
FIG. 8 is diagram illustrating a configuration of a flap opening mechanism included in the envelope processing apparatus of FIG. 7.

Next, a description is given of a flap opener according to the present embodiment is described. The flap opening mechanism 180 as a flap opener is provided with the flap opening roller pair 124. As illustrated in FIG. 8, the flap opening mechanism 180 includes a flap scooping member 181 rotatably attached to a rotation shaft of one of the pair of conveying rollers constituting the flap opening roller pair 124, and a spring 182 for biasing the flap scooping member 181.

The flap scooping member 181 is disposed at a position where the envelope E contacts the flap scooping member 181 when the envelope E placed on the envelope load tray 127 is separated and conveyed through the envelope entry passage 1107 by the envelope conveying roller pair 126. The flap scooping member 181 is biased by the spring 182 such that the envelope E is located at a position where the envelope E blocks the conveyance path for conveying the envelope E from the envelope entry passage 1107 to the envelope conveyance passage 1105 until the envelope E contacts the flap scooping member 181. In a normal state in which the envelope E does not pass through, the flap scooping member 181 is in contact with a conveyance guide constituting the envelope conveyance passage 1105. Thus, the rotation of the flap scooping member 181 by the spring 182 is restricted. When the envelope E brings into contact with and presses the flap scooping member 181, the flap scooping member 181 rotates against the biasing of the spring 182 into a state in which the envelope E can proceed to the envelope conveyance passage 1105.

The flap scooping member 181 includes a top portion that is pressed and rotated by the envelope E to hook the flap ef when the conveyed envelope E passes through the flap scooping member 181. When the flap ef is moved in the −Z direction by the flap opening roller pair 124 in a state where the flap ef is caught at the top portion, the flap ef changes from a closed state to an open state.

As illustrated in FIG. 8, the separation sensor 128 as a first envelope detector is disposed upstream from the flap opening roller pair 124 in the conveyance direction. The flap opening detection sensor 129 as a second envelope detector is disposed downstream from the flap opening roller pair 124 in the conveyance direction.

Next, an example of a series of processes of the enclosing operation and the sealing operation in the envelope processing apparatus 100 is described with reference to FIGS. 9 to 22. In FIGS. 9 to 22, reference signs are mainly assigned to elements used in the description of each of operation steps.

Figure 9:
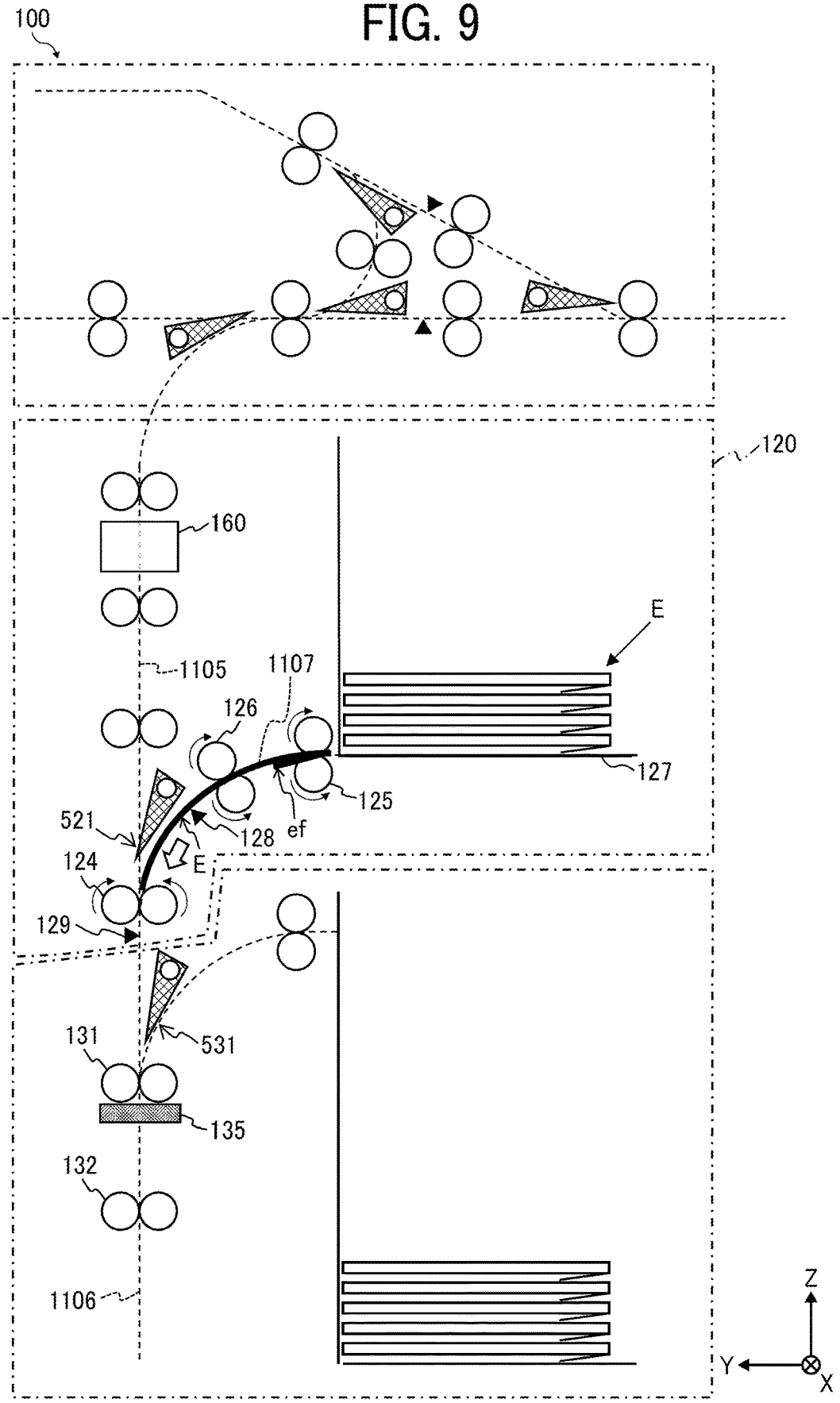
FIG. 9 is a cross-sectional view of the envelope processing apparatus, illustrating one step of an enclosing operation performed by the envelope processing apparatus according to an embodiment of the present disclosure.

First, as illustrated in FIG. 9, multiple envelopes E are separated one by one by the rotation of the envelope separation roller pair 125 from the envelope load tray 127 on which the envelopes E are stacked, and are conveyed to the envelope conveying roller pair 1107. The separated envelope E is conveyed to the flap opening roller pair 124 by the envelope conveying roller pair 126 disposed in the envelope entry passage 1107.

At this time, a leading end and a trailing end of the envelope E in the conveyance direction of the envelope E are detected by the separation sensor 128. An envelope length is calculated based on the detection results of the separation sensor 128.

When the envelope E is conveyed through the envelope entry passage 1107, as illustrated in FIG. 9, the envelope switchback switching member 521 is directed such that the envelope E can be conveyed from the envelope entry passage 1107 to the envelope conveyance passage 1105. As illustrated in FIG. 9, the envelope ejection switching member 531 is oriented in a direction in which the envelope E can enter the sealing conveyance passage 1106 from the envelope conveyance passage 1105.

The flap opening roller pair 124, the third vertical conveying roller pair 131, and the fourth vertical conveying roller pair 132 rotate in a direction in which the envelope E is conveyed in the −Z direction. As a result, the envelope E is conveyed from the envelope entry passage 1107 to the envelope conveyance passage 1105.

Figure 10:
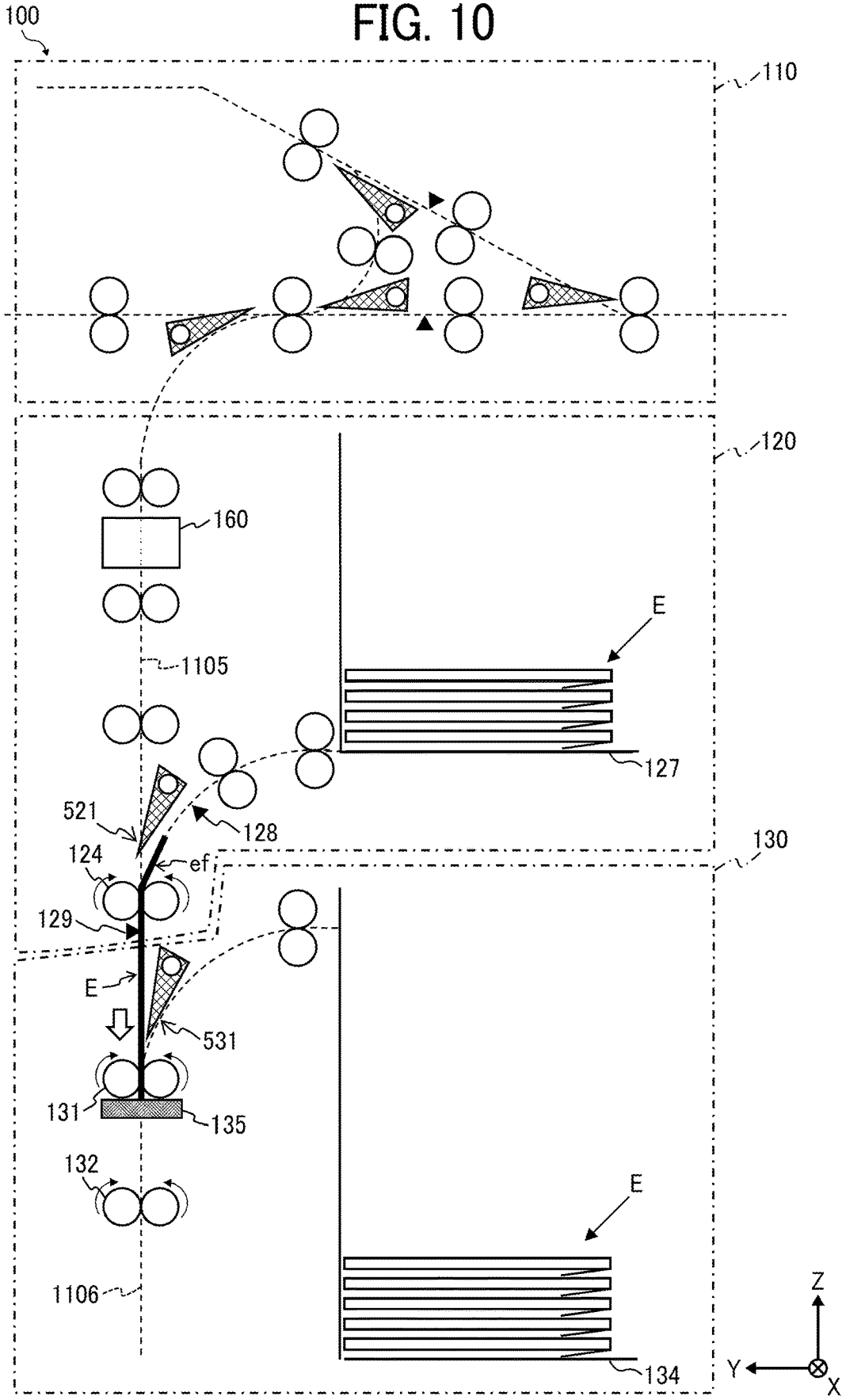
FIG. 10 is a cross-sectional view of the envelope processing apparatus, illustrating one step of an enclosing operation performed by the envelope processing apparatus, subsequent to FIG. 9.

Subsequently, as illustrated in FIG. 10, when the envelope E completely passes through the flap opening roller pair 124, the flap ef is being opened. The flap opening roller pair 124, the third vertical conveying roller pair 131, and the fourth vertical conveying roller pair 132 continue to rotate.

Figure 11:
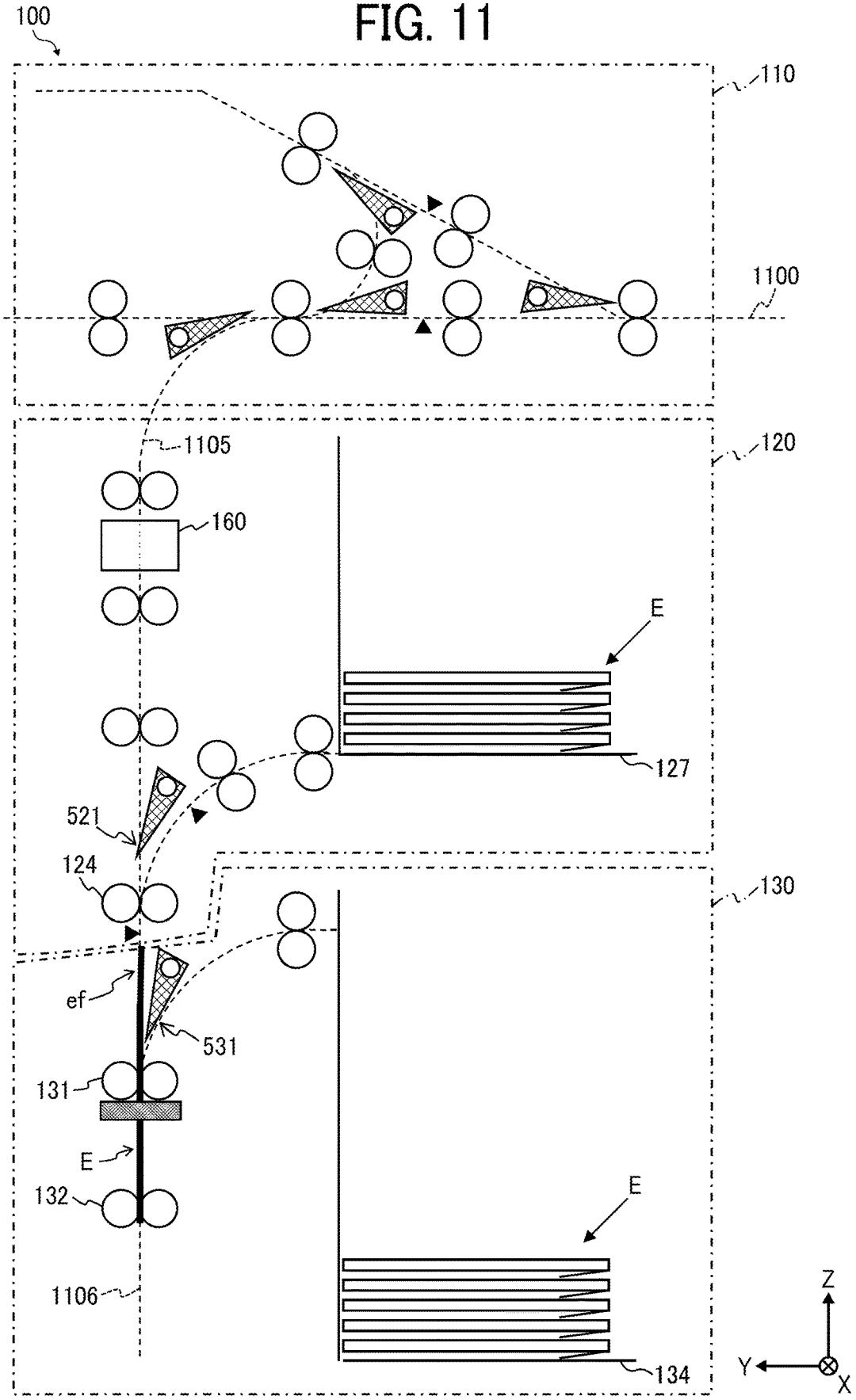
FIG. 11 is a cross-sectional view of the envelope processing apparatus, illustrating one step of an enclosing operation performed by the envelope processing apparatus, subsequent to FIG. 10.

As illustrated in FIG. 11, when the end of the flap ef has passed through the flap opening detection sensor 129, the rotation of the flap opening roller pair 124, the third vertical conveying roller pair 131, and the fourth vertical conveying roller pair 132 is temporarily stopped. Thus, the envelope E is switched back and conveyed in the envelope conveyance passage 1105.

With reference to FIG. 12, a description is given of the outline of the operation of the flap opening mechanism 180 and the calculation processing of the envelope length in the conveyance operation of the envelope E leading to FIGS. 9, 10, and 11. Note that the flap opening mechanism 180 is not illustrated in FIGS. 9 to 11.

Figure 12A:
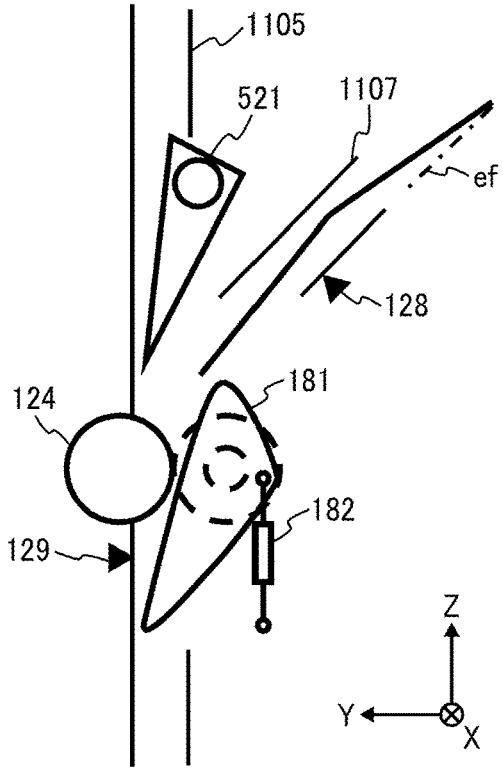
FIGS. 12A to 12D are diagrams illustrating an operation of a flap opening mechanism in an enclosing operation of the envelope processing apparatus.

First, as illustrated in FIG. 12A, the leading end of the envelope E conveyed toward the flap opening roller pair 124 is detected by the separation sensor 128 on the way to the nip of the flap opening roller pair 124.

Figure 12B:
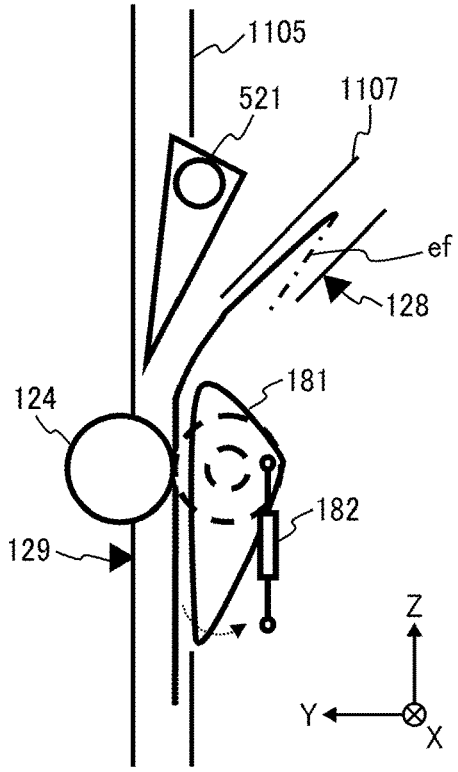

Subsequently, as illustrated in FIG. 12B, when the leading end of the envelope E in the conveyance direction passes through the nip of the flap opening roller pair 124 and moves in the −Z direction, the leading end of the envelope E in the conveyance direction contacts the flap scooping member 181 placed at the normal position, at which the flap scooping member 181 blocks the envelope conveyance passage 1105, and presses the flap scooping member 181. At this time, the flap scooping member 181 is pressed by the end of the envelope E in the conveyance direction to rotate, thus enabling the envelope E to travel along the envelope conveyance passage 1105. As a result, the envelope E is conveyed to the envelope conveyance passage 1105.

Figure 12C:
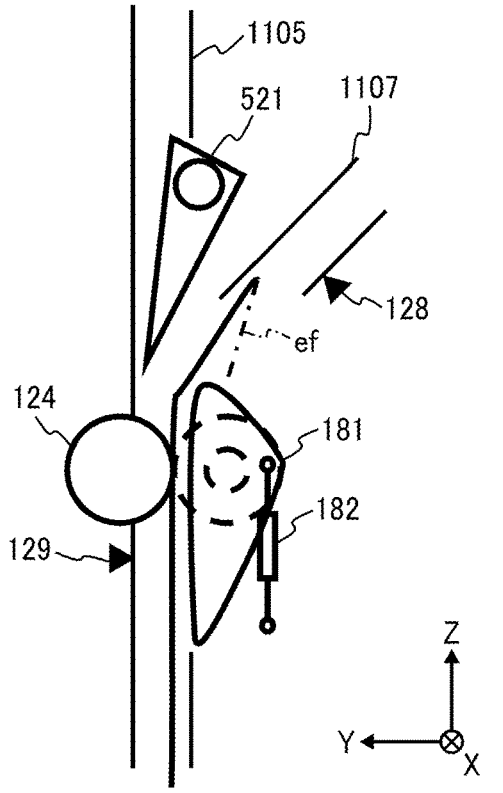

On the way that the entire length of the envelope E reaches the envelope conveyance passage 1105, as illustrated in FIG. 12C, the trailing end of the envelope E in the conveyance direction is also detected when the envelope E passes through the separation sensor 128. In other words, the first envelope length (corresponding to the body length) as the envelope length when the flap ef is closed can be calculated based on, for example, the time from when the leading end of the envelope E in the conveyance direction is detected by the separation sensor 128 to when the trailing end of the envelope E in the conveyance direction is detected by the separation sensor 128 (i.e., the difference between the detection times of the ends in the conveyance direction), the conveyance speed of the envelope E, or the number of rotations of the envelope conveying roller pair 126.

Atop portion corresponding to a part of the flap scooping member 181 pressed and rotated by the leading end of the envelope E in the conveyance direction slightly pushes up the envelope E conveyed in the envelope entry passage 1107. Thus, the envelope E is brought into a state of being slightly curved in the envelope entry passage 1107. As a result, the flap ef of the envelope E is slightly opened. When the envelope E is further conveyed in this state, the end of the flap ef is caught by the top portion of the flap scooping member 181.

Figure 12D:
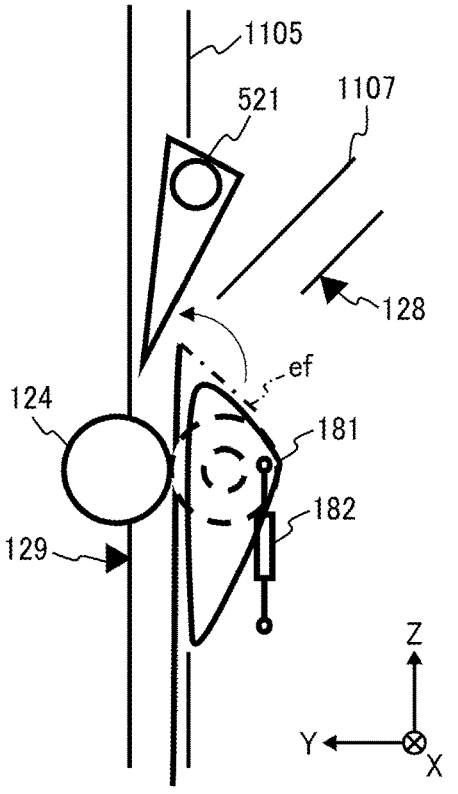

When the envelope E is conveyed by the flap opening roller pair 124, as illustrated in FIG. 12D, the end of the flap ef contacts the top portion of the flap scooping member 181, and rotates and opens with the conveyance of the envelope E. The envelope E with the flap ef opened is further conveyed to the enclosing position. A state subsequent to the state illustrated in FIG. 12D corresponds to the state of FIG. 11.

Figure 13:
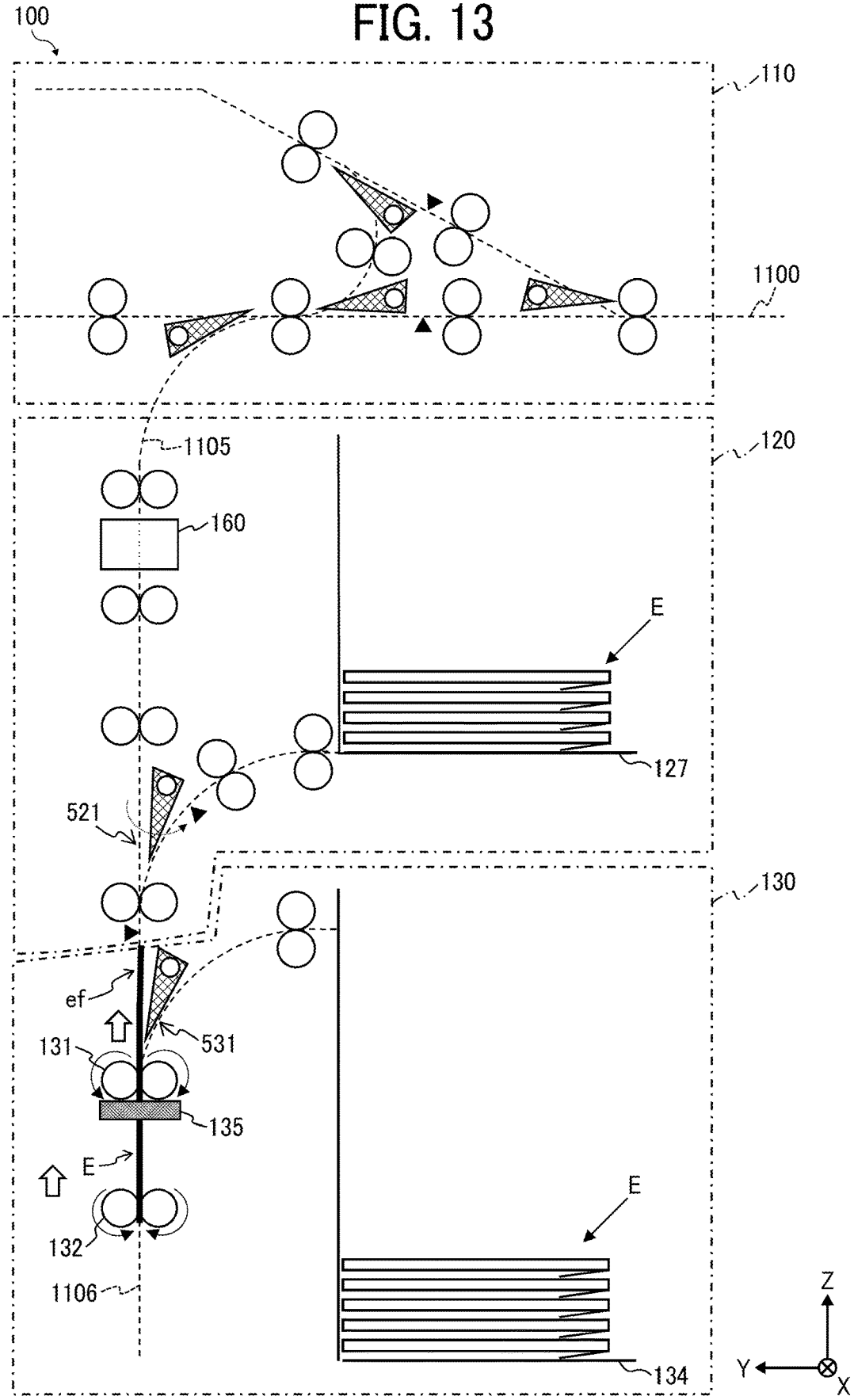
FIG. 13 is a cross-sectional view of the envelope processing apparatus, illustrating one step of an enclosing operation performed by the envelope processing apparatus, subsequent to FIG. 11.

Subsequently to FIG. 11, as illustrated in FIG. 13, after the flap ef of the envelope E is being opened and reaches a position where the flap ef has passed through the flap opening roller pair 124, the third vertical conveying roller pair 131 and the fourth vertical conveying roller pair 132 are rotated in reverse. The envelope E is conveyed in the +Z direction in the sealing conveyance passage 1106 and the envelope conveyance passage 1105 by the above-described reverse rotation. This conveyance is referred to as "switchback conveyance". The envelope switchback switching member 521 rotates in a direction illustrated by a dashed arrow in FIG. 13 before switchback conveyance of the envelope E starts or simultaneously with switchback conveyance. As a result, the envelope E turns into the state in which the envelope E can be conveyed upward in the envelope conveyance passage 1105.

Figure 14:
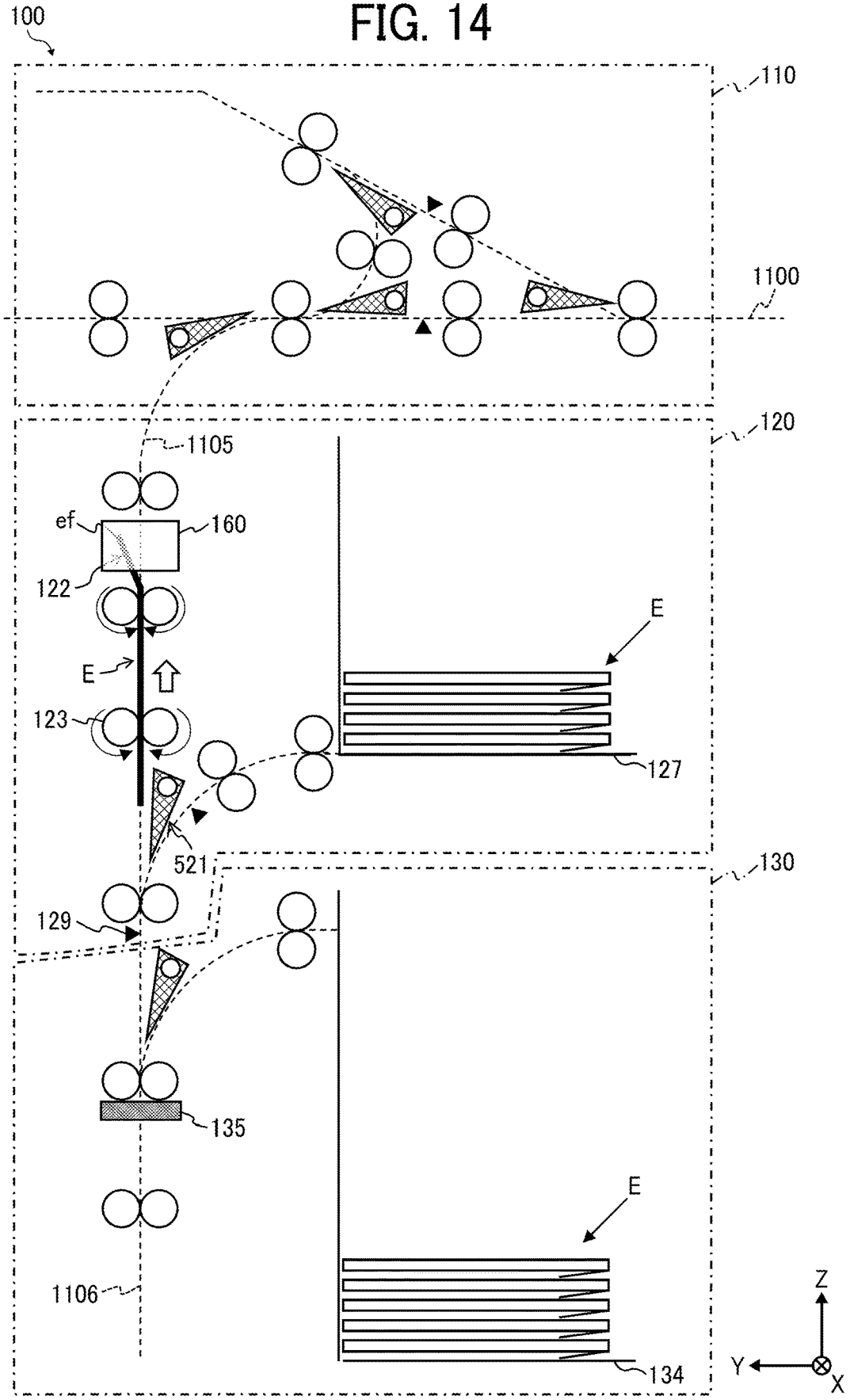
FIG. 14 is a cross-sectional view of the envelope processing apparatus, illustrating one step of an enclosing operation performed by the envelope processing apparatus, subsequent to FIG. 13.

As illustrated in FIG. 14, the envelope E is conveyed to an enclosing position as a specified position of the enclosing device 120 by switchback conveyance. The end (the trailing end in the conveyance direction) of the opened flap ef of the envelope E being conveyed in a switchback manner is detected by the flap opening detection sensor 129 before the envelope E reaches the sealing position. Subsequently, the bottom (the leading end in the conveyance direction) of the envelope E is detected by the flap opening detection sensor 129 with the switchback conveyance. When the envelope E is conveyed in the switchback manner, the end of the flap ef is the top in the conveyance direction. However, in the following descriptions, the end of the flap ef is referred to as "the trailing end in the conveyance direction" regardless of the actual movement direction (conveyance direction) of the envelope E in order to unify the expression. The bottom side of the envelope E is referred to as the "leading end in the conveyance direction".

Accordingly, both of the end (the trailing end in the conveyance direction) of the flap ef and the bottom (the leading end in the conveyance direction) of the envelope E are detected by the flap opening detection sensor 129 by the time when the flap ef reaches the first vertical conveying roller pair 122. The time from when the trailing end in the conveyance direction (the end of the flap ef) is detected by the flap opening detection sensor 129 to when the leading end in the conveyance direction (the bottom of the envelope E) is detected by the flap opening detection sensor 129 can be calculated based on the detection results of the flap open detection sensor 129. The envelope length (second envelope length) when the flap ef is open can also be calculated by the conveyance speed of the envelope E or by the number of rotations of the third vertical conveying roller pair 131 and the fourth vertical conveying roller pair 132.

The length of the flap ef (flap length) can be calculated by subtracting the envelope length when the flap ef is closed (first envelope length) from the envelope length when the flap ef is open (second envelope length). In other words, the body length and the flap length are calculated by arithmetic processing executed by the envelope processing controller 150 based on the detection results of the separation sensor 128 and the flap opening detection sensor 129. Accordingly, the separation sensor 128, the flap opening detection sensor 129, and the envelope processing controller 150 constitute a flap length detector and a body length detector.

The envelope E is conveyed by the second vertical conveying roller pair 123 and the first vertical conveying roller pair 122 until the envelope E reaches the enclosing position corresponding to the flap length. When the flap ef has reached a position, corresponding to the flap length, where the flap ef passes through the first vertical conveying roller pair 122, the rotations of the second vertical conveying roller pair 123 and the first vertical conveying roller pair 122 are stopped, and then, the enclosing standby operation is started.

In the control that conveys the envelope E to the position for entering the enclosure standby operation, the envelope processing controller 150 may calculate the conveyance amount of the envelope E from the rotation amount of each conveying roller pair after the envelope separation roller pair 125 takes out the envelope E, and may determine the position of the envelope E in the envelope conveyance passage 1105 based on the conveyance amount and the length of the conveyance path.

Figure 15:
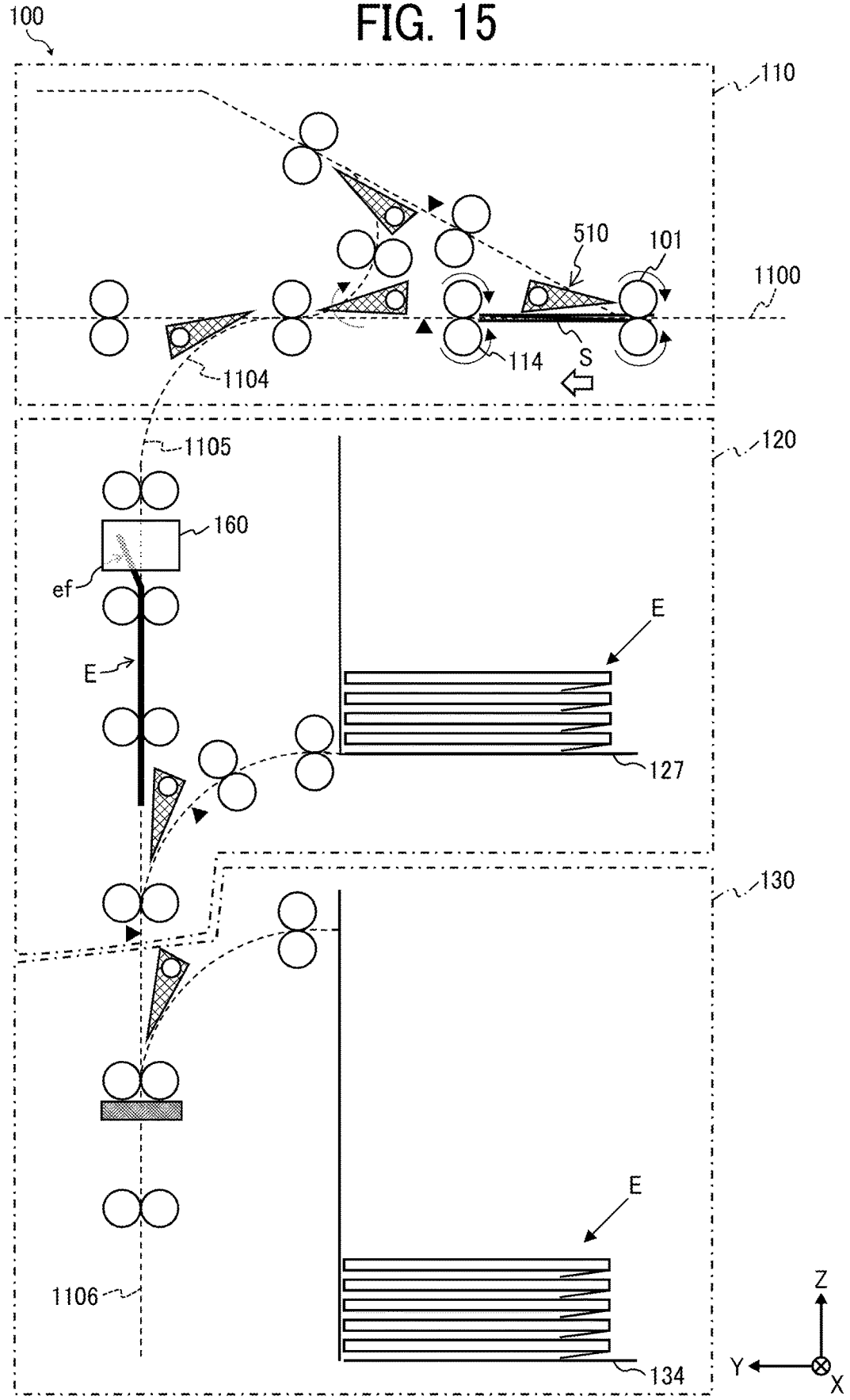
FIG. 15 is a cross-sectional view of the envelope processing apparatus, illustrating one step of an enclosing operation performed by the envelope processing apparatus, subsequent to FIG. 14.

Subsequently, as illustrated in FIG. 15, in a state where the envelope E is held at the enclosing position, the envelope processing apparatus 100 receives the folded sheet Sf from the upstream apparatus (the folding apparatus 300) by the entrance roller pair 101 and conveys the folded sheet Sf to the first conveyance passage 1101.

Figure 16:
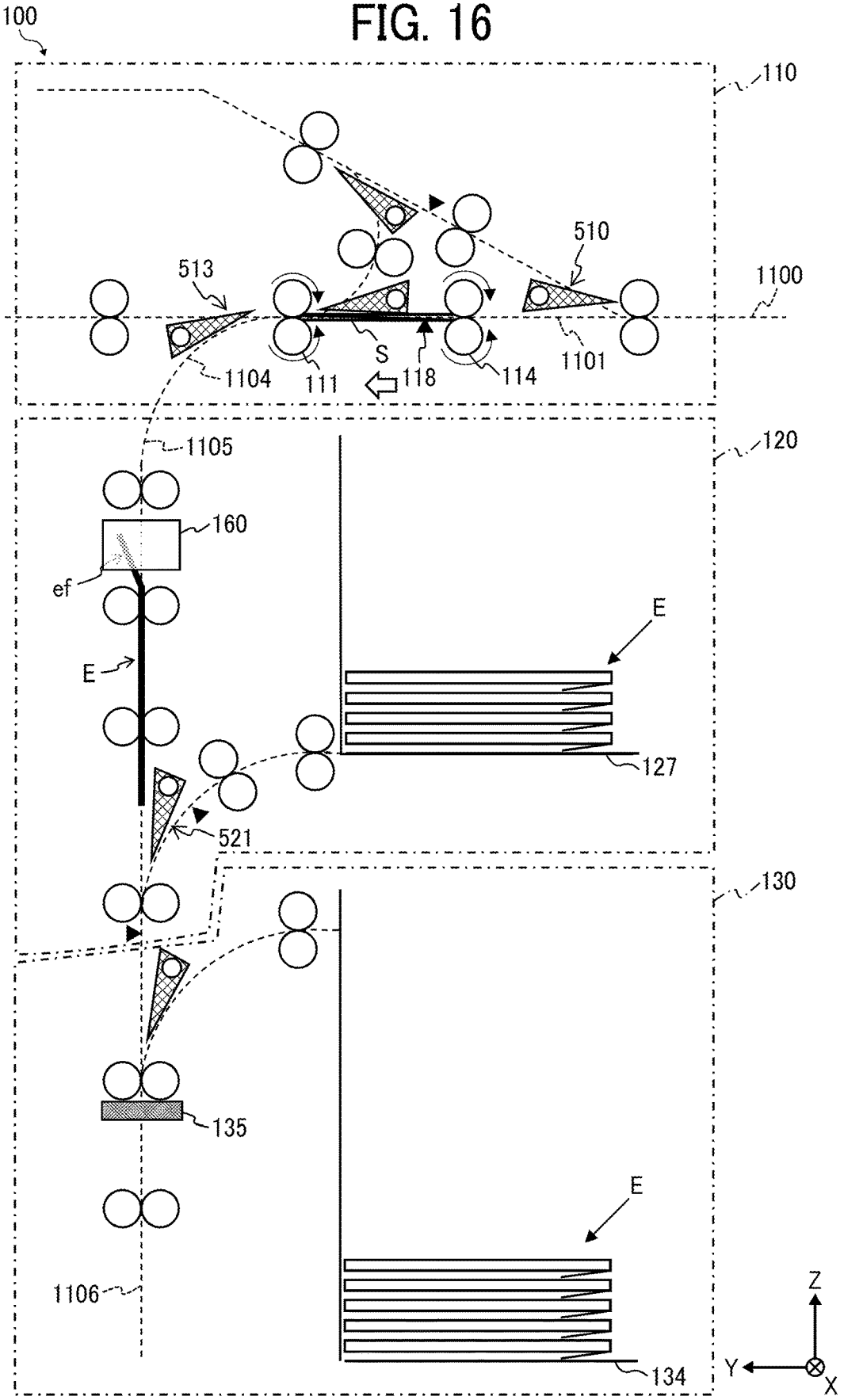
FIG. 16 is a cross-sectional view of the envelope processing apparatus, illustrating one step of an enclosing operation performed by the envelope processing apparatus, subsequent to FIG. 15.

Subsequently, as illustrated in FIG. 16, a first intermediate conveying roller pair 114 and a first conveying roller pair 111 convey the folded sheet Sf downstream in the sheet conveyance direction. At this time, a first switching member 510 and a third switching member 513 are positioned as illustrated in FIG. 16. The folded sheet Sf is conveyed from the first conveyance passage 1101 to the enclosing conveyance passage 1104.

Figure 17:
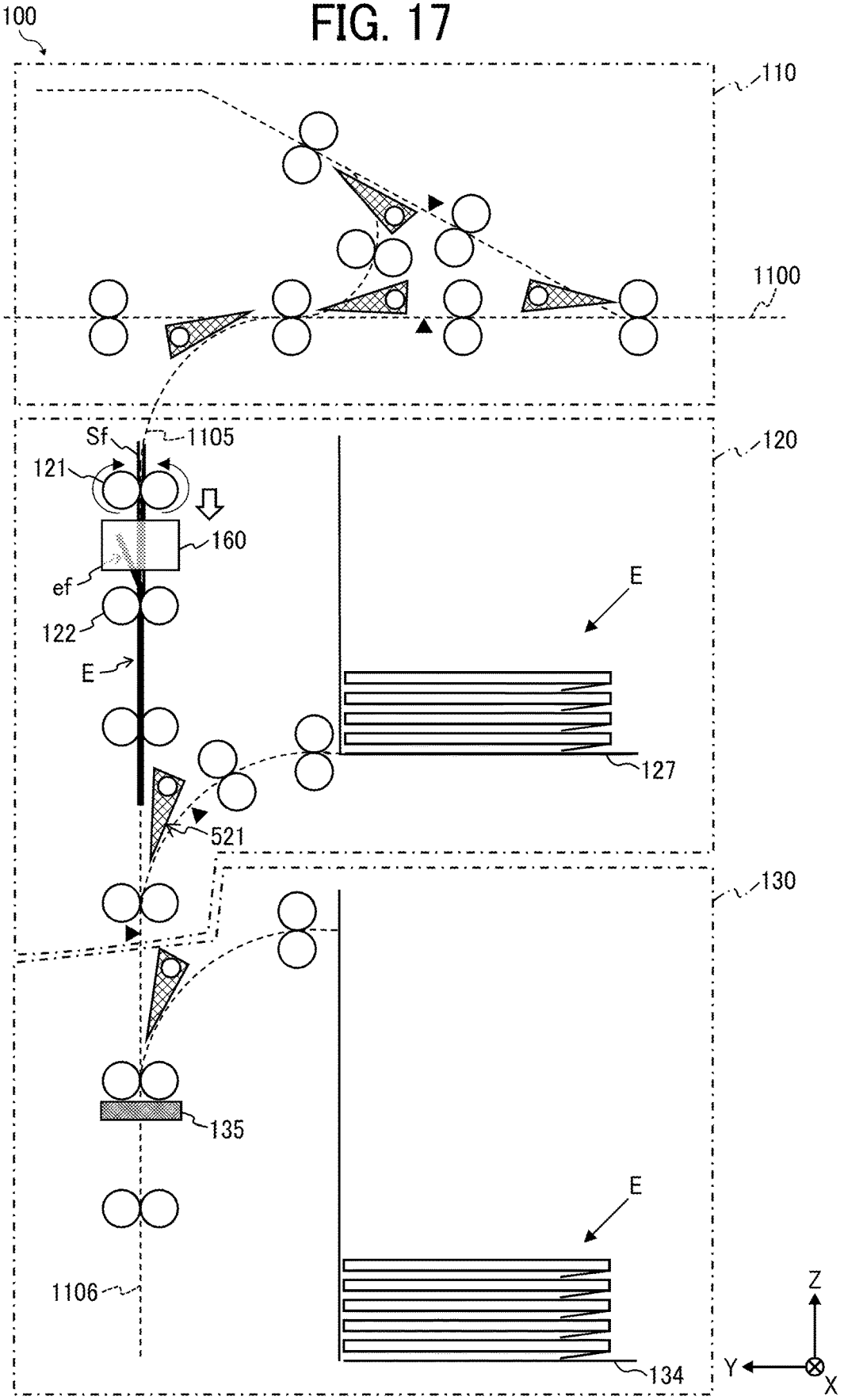
FIG. 17 is a cross-sectional view of the envelope processing apparatus, illustrating one step of an enclosing operation performed by the envelope processing apparatus, subsequent to FIG. 16.

Then, as illustrated in FIG. 17, the enclosing roller pair 121 conveys the folded sheet Sf conveyed from the enclosing conveyance passage 1104 to the envelope conveyance passage 1105 farther in the −Z direction. As a result, the first vertical conveying roller pair 122 holds the folded sheet Sf at the specified enclosing position in the envelope conveyance passage 1105. The folded sheet Sf is enclosed into the envelope E in the enclosing standby state.

Figure 18:
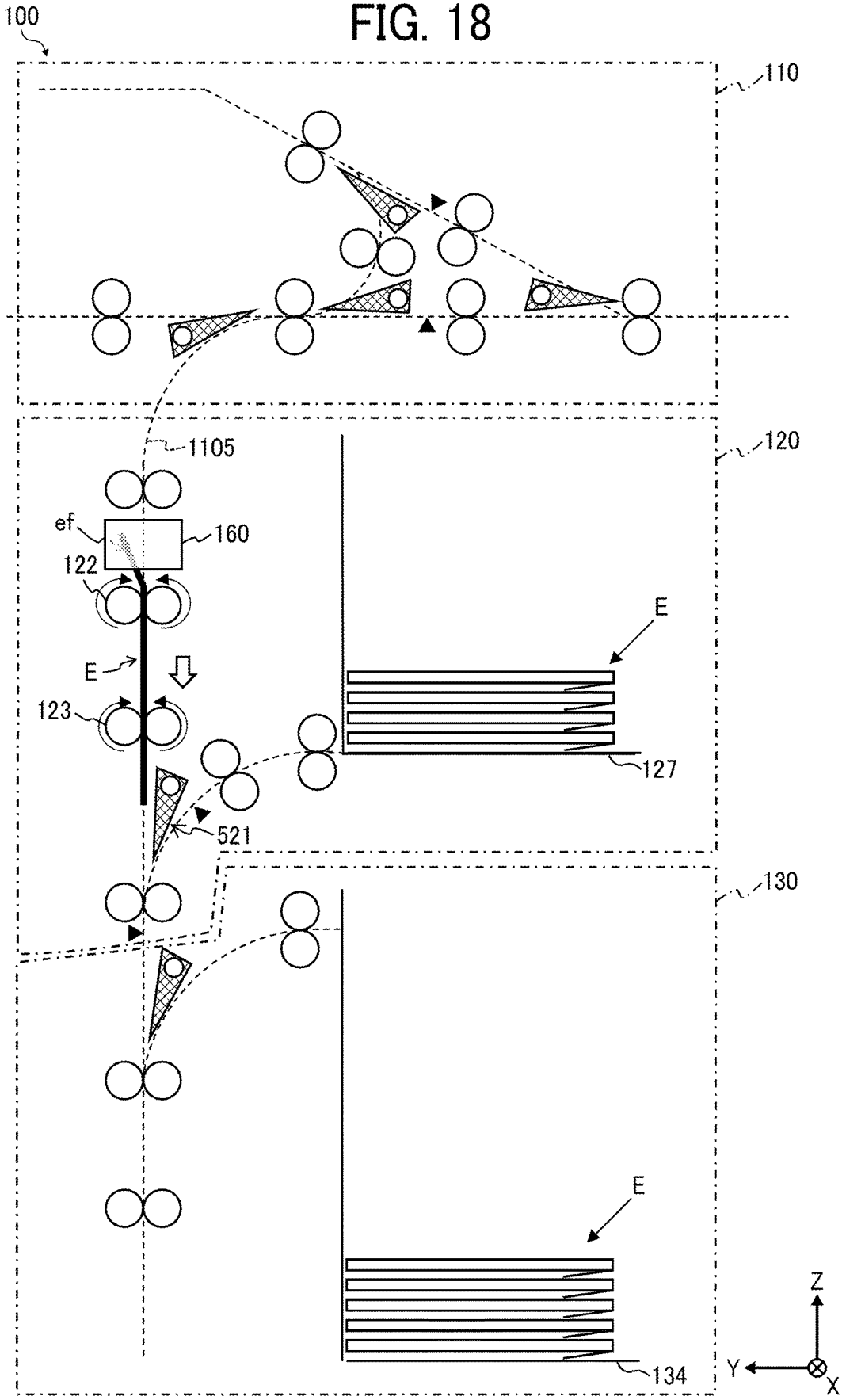
FIG. 18 is a cross-sectional view of the envelope processing apparatus, illustrating one step of an enclosing operation performed by the envelope processing apparatus, subsequent to FIG. 17.
Figure 21:
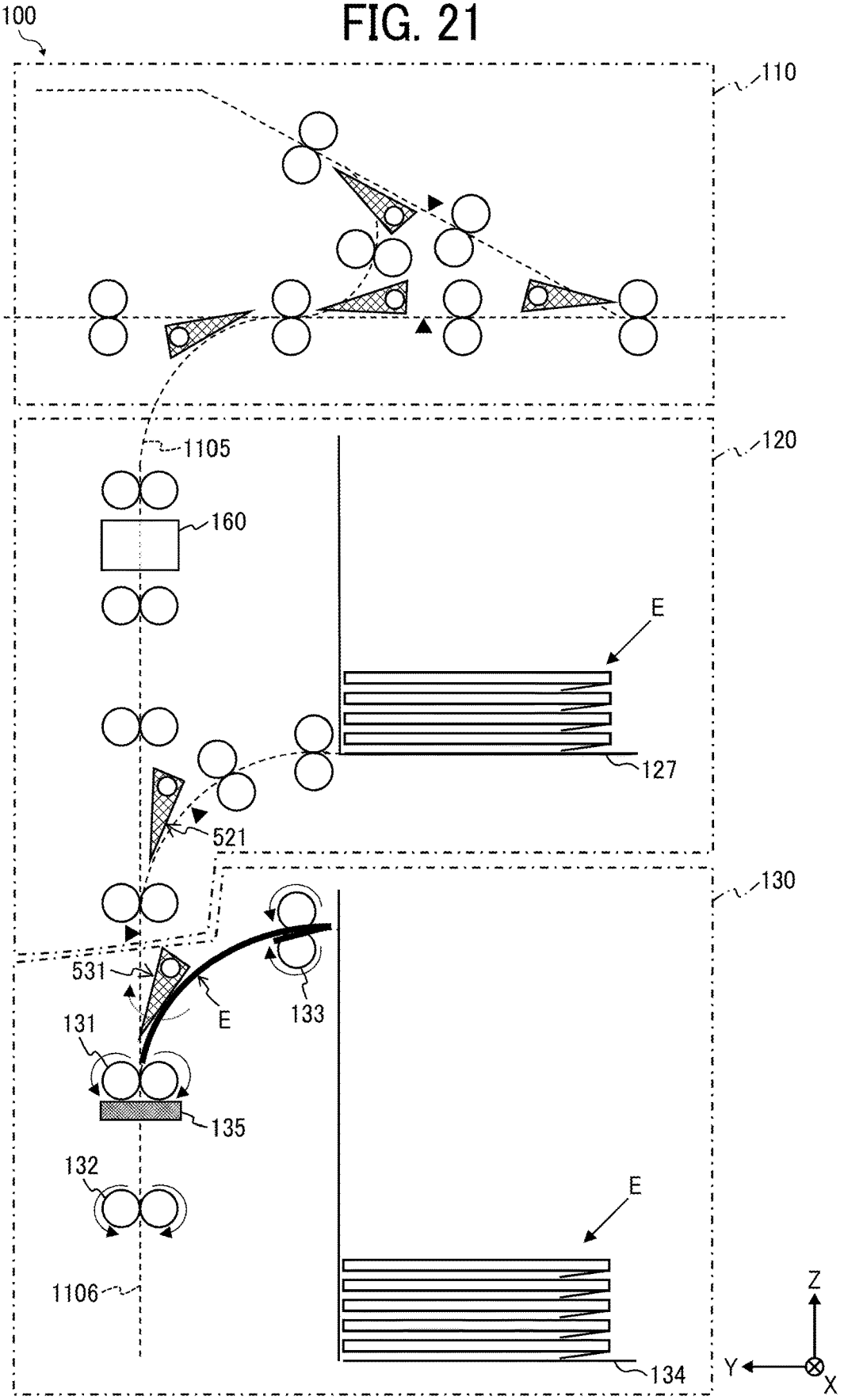
FIG. 21 is a cross-sectional view of the envelope processing apparatus, illustrating one step of an enclosing operation performed by the envelope processing apparatus, subsequent to FIG. 20.

Then, as illustrated in FIG. 18, the first vertical conveying roller pair 122 and the second vertical conveying roller pair 123 rotate to convey the envelope E downward to the fourth vertical conveying roller pair 132 as illustrated in FIG. 21. The envelope E with the folded sheet Sf enclosed therein is conveyed to a past position where the flap ef is past the envelope ejection switching member 531.

Figure 19:
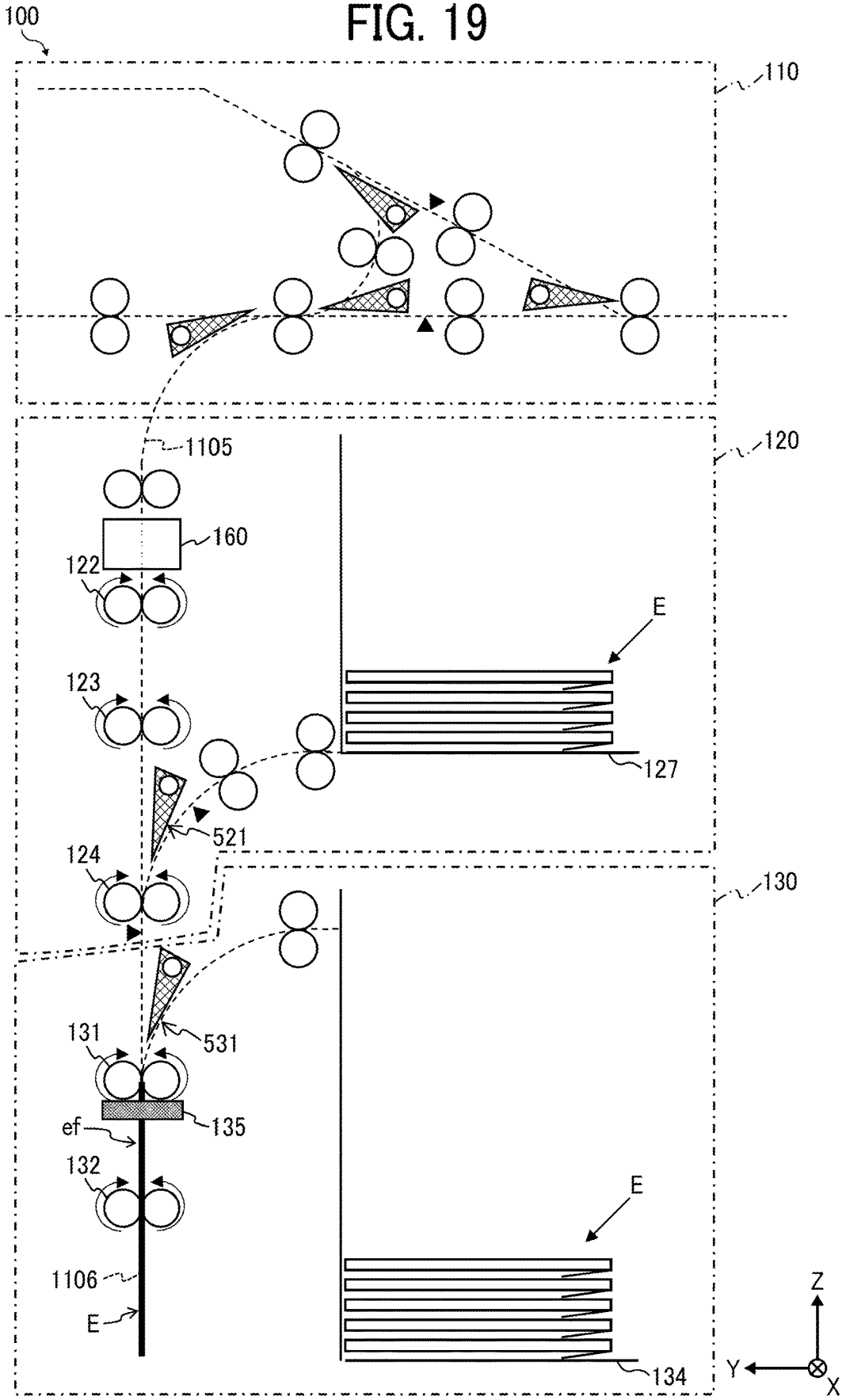
FIG. 19 is a cross-sectional view of the envelope processing apparatus, illustrating one step of an enclosing operation performed by the envelope processing apparatus, subsequent to FIG. 18.

Subsequently, as illustrated in FIG. 19, the flap ef is closed by the sealing device 135 between the third vertical conveying roller pair 131 and the fourth vertical conveying roller pair 132 to seal the envelope E.

Figure 20:
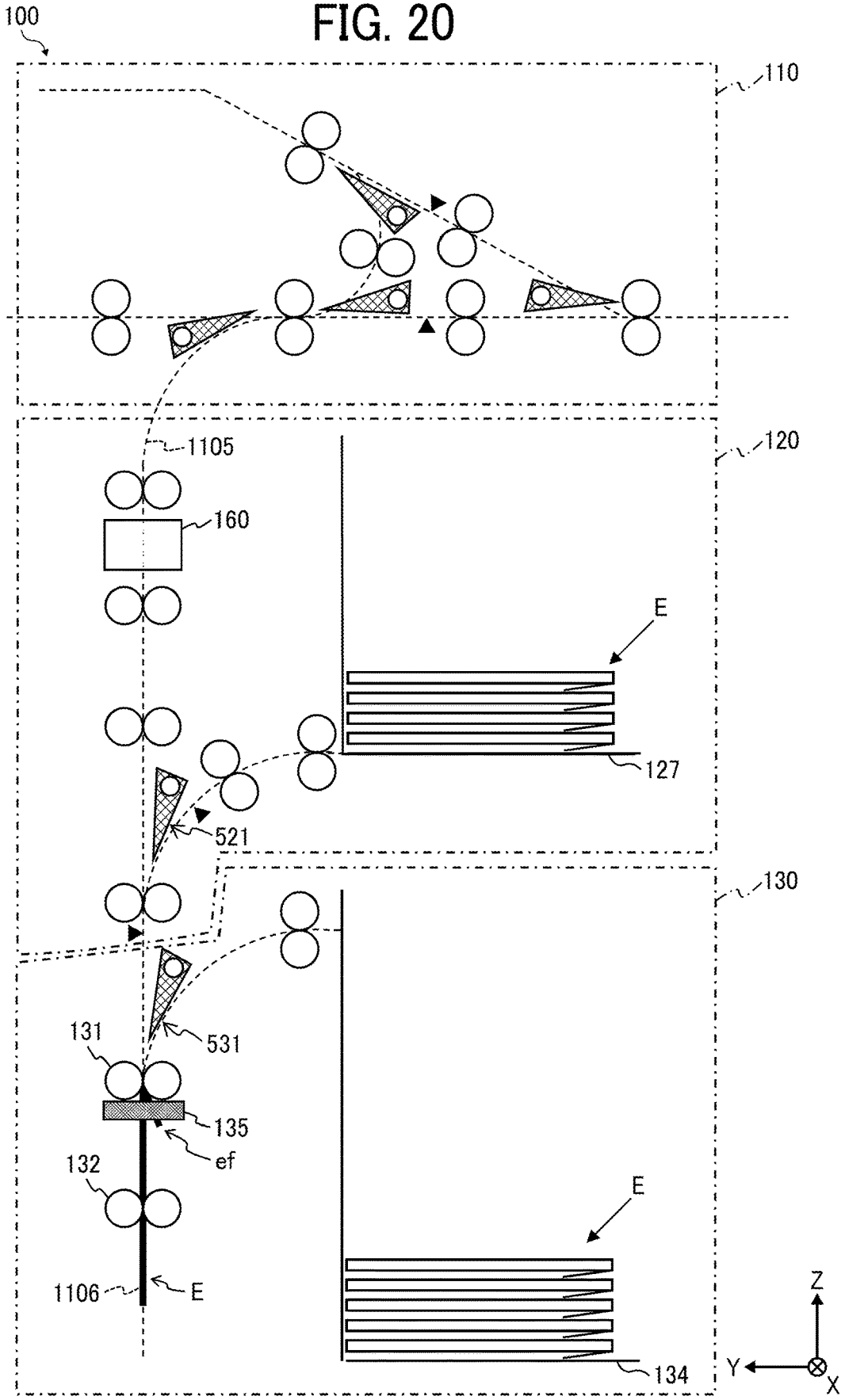
FIG. 20 is a cross-sectional view of the envelope processing apparatus, illustrating one step of an enclosing operation performed by the envelope processing apparatus, subsequent to FIG. 19.

Then, as illustrated in FIG. 20, the third vertical conveying roller pair 131 and the fourth vertical conveying roller pair 132 rotate in reverse to convey the sealed envelope E with switchback manner. Before the third vertical conveying roller pair 131 and the fourth vertical conveying roller pair 132 rotate in reverse, the envelope ejecting switching member 531 is rotated into a state illustrated in FIG. 21. Accordingly, the enclosed envelope E is conveyed from the enclosing conveyance passage 1104 to the envelope ejection passage 1108.

Figure 22:
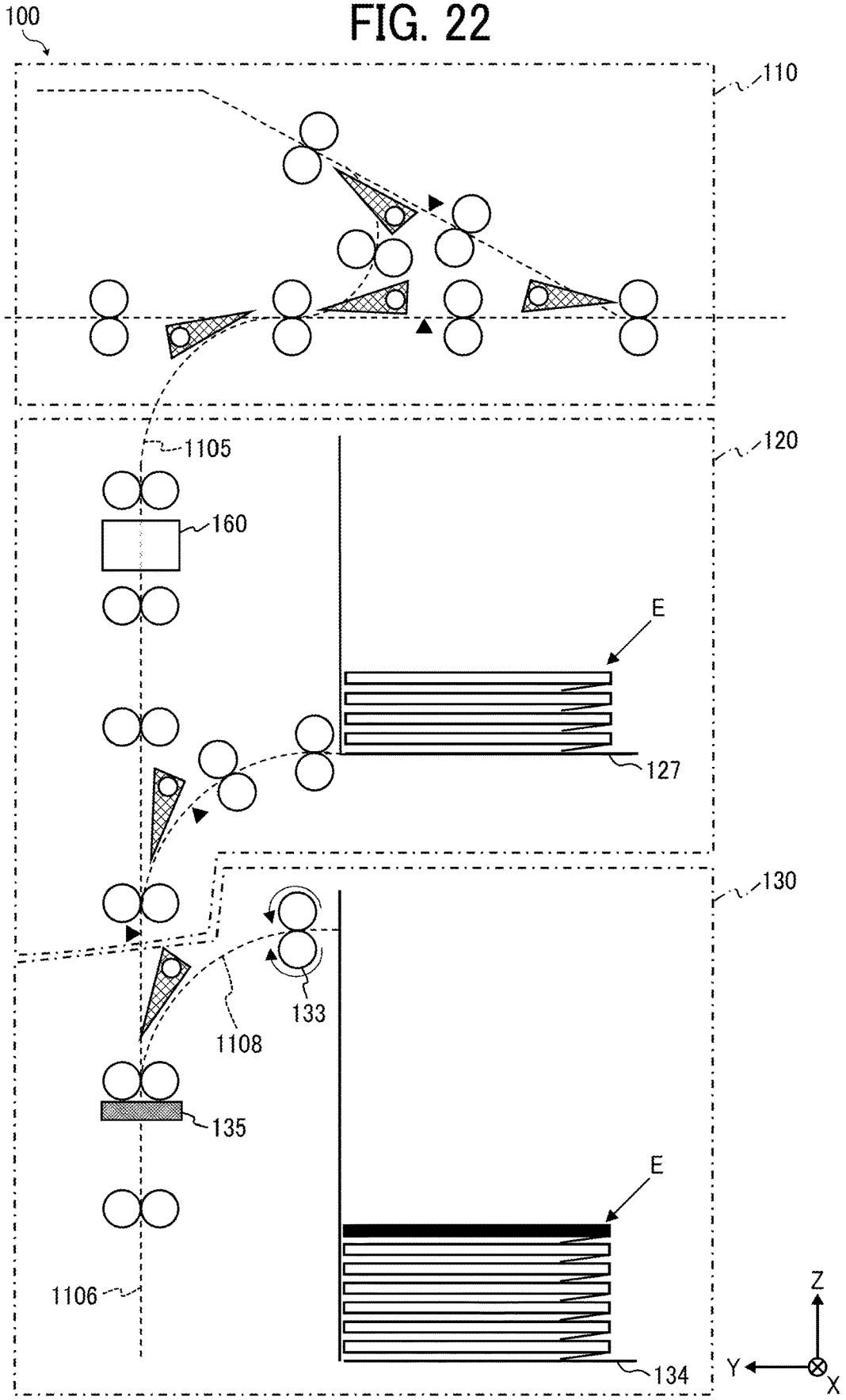
FIG. 22 is a cross-sectional view of the envelope processing apparatus, illustrating one step of an enclosing operation performed by the envelope processing apparatus, subsequent to FIG. 21.

As a result, as illustrated in FIG. 22, the envelope ejection roller pair 133 ejects the sealed envelope E onto the envelope ejection tray 134.

Next, a description is given of an enclosing support operation for inserting an enclosure into the envelope E in more detail. The enclosing support operation executed by the enclosing device 120 according to the present embodiment corresponds to an operation of adjusting the opening amount of the envelope E depending on the envelope E and supporting smoother enclosing operation. Here, the term "depending on the envelope E" means that the flap ef is relatively shorter or longer depending on, for example, the type of the envelope E. The body length of the envelope E is also relatively shorter or longer depending on the type of the envelope E. In other words, the envelope E is broadly classified into the following types: "the flap ef is short and the body length is also short", "the flap ef is short and the body length is long", "the flap ef is long and the body length is short", and "the flap ef is long and the body length is also long". The terms "long" and "short" are relative terms and do not define "long" and "short" using specific dimensions as threshold values.

The term "depending on the envelope E" is also an index used for determining whether the dimension of the enclosure inserted into the opening of the envelope E is "large" or "small" in the types (dimension types) broadly classified as described above. For example, the thickness of the folded sheet Sf (corresponding to the height when entering the opening of the envelope E) increases as the number of creases in the folded sheet Sf increases. Thus, adjusting the opening of the envelope E is desired in order to cope with above-described increasing. In other words, adjustment of the opening amount of the envelope E in relation to the size of the enclosure is also included in the term "depending on the envelope E".

The enclosing support operation according to the present embodiment is an example of the enclosing support operation assuming that "the flap ef is short and the body length is also short". As described with reference to FIGS. 13 and 14, the envelope E is conveyed to the enclosing position in the state in which the flap ef is opened, is held in the state in which the flap ef is opened by the enclosing support 160, and then is on standby in the state in which the enclosure can be inserted into the envelope E. The opening of the envelope E is opened, and an enclosure is inserted into the envelope E. This series of operations is referred to as a "enclosing support operation".

The enclosing support operation includes an operation of conveying the envelope E by the second vertical conveying roller pair 123 and the first vertical conveying roller pair 122 until the envelope E reaches the enclosing position. As described with reference to FIG. 14, when the position of the flap ef in the Z direction has passed through the first vertical conveying roller pair 122, in other words, when the envelope E has reached the enclosing position, the rotations of the second vertical conveying roller pair 123 and the first vertical conveying roller pair 122 are stopped to hold the envelope E at the enclosing position.

Figure 23:
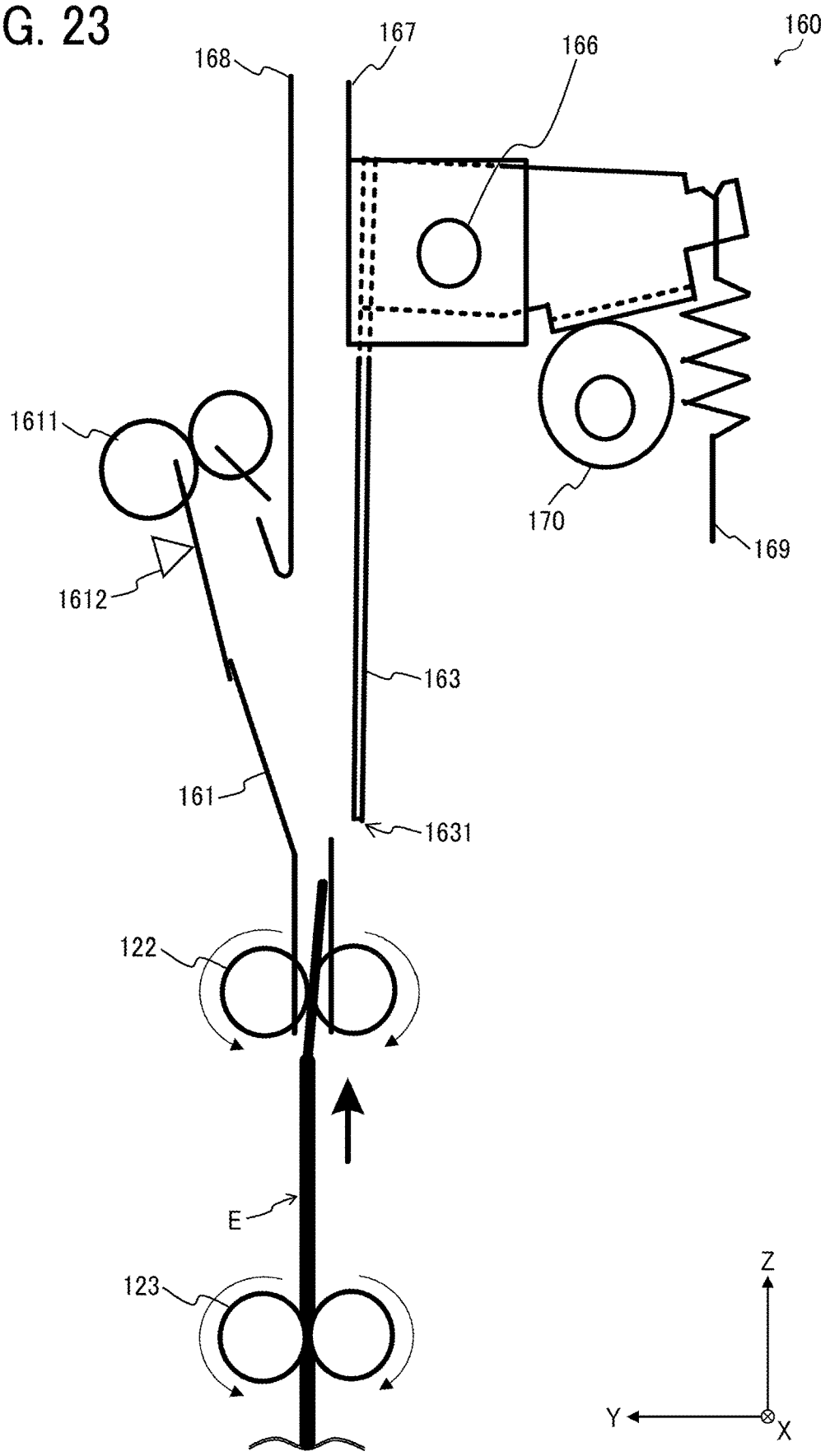
FIG. 23 is a diagram illustrating an operation of an enclosing support of the envelope processing apparatus, according to an embodiment of the present disclosure.

FIG. 23 illustrates a state that is a little bit in the past in time series with respect to the state illustrated in FIG. 14. FIG. 23 illustrates a state in which the envelope E has been conveyed through the envelope conveyance passage 1105 in the +Z direction and has not yet reached the first vertical conveying roller pair 122. At this time, a drive cam 170 is stopped and is in a position to press up an enclosing guide member 163 against an enclosing guide spring 169. As a result, a tip portion 1631 of the enclosing guide member 163 is placed at a position separated from a flap guide plate 161.

Figure 24:
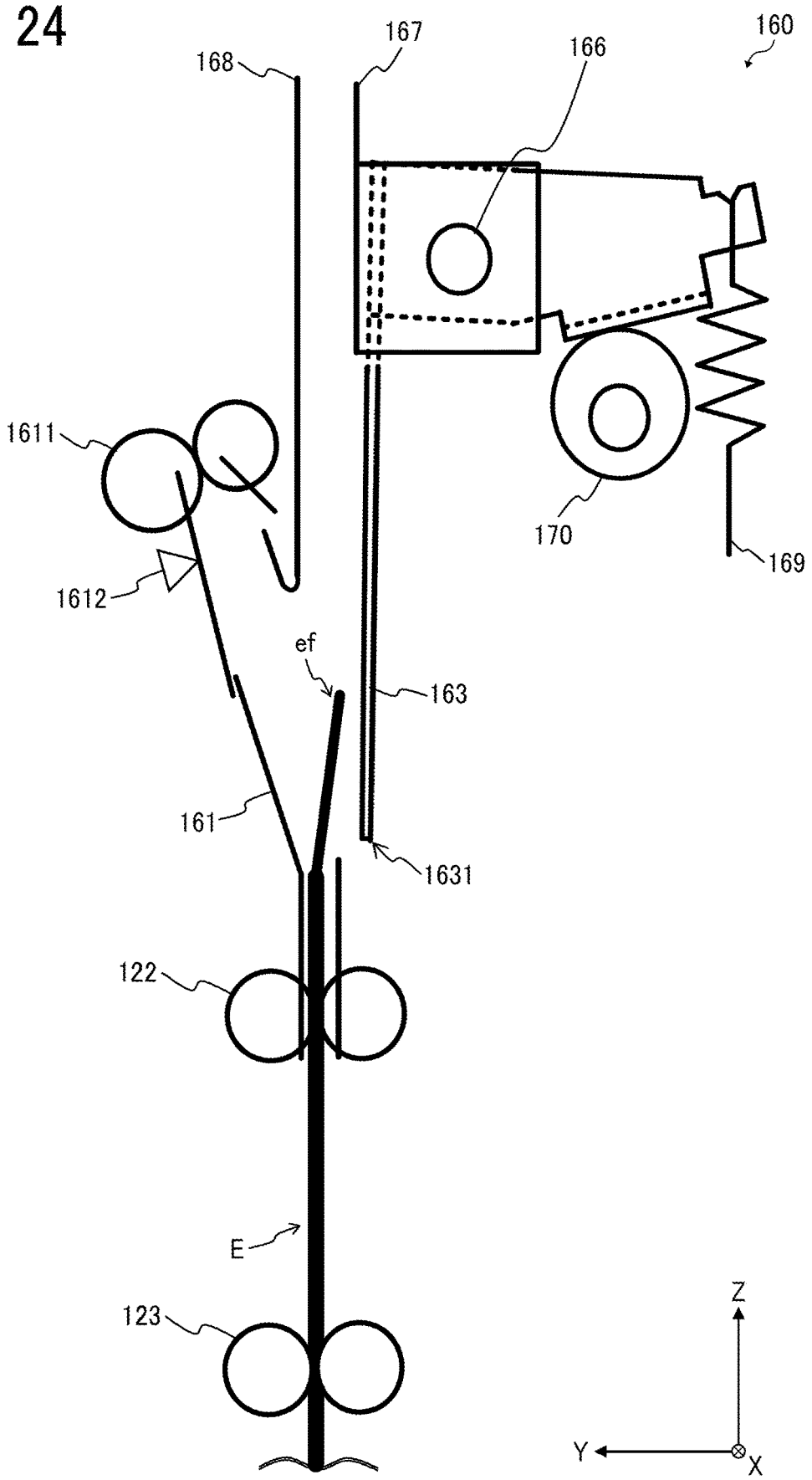
FIG. 24 is a diagram illustrating an operation of the enclosing support of the envelope processing apparatus, subsequent to FIG. 23.

Subsequently, as illustrated in FIG. 24, when the leading end of the flap ef has reached a position further in the +Z direction than the tip portion 1631 of the enclosing guide member 163 by the conveyance of the envelope E, in other words, when the leading end of the flap ef has reached a position beyond the tip portion 1631, which is the tip of the enclosing guide member 163, the rotations of the second vertical conveying roller pair 123 and the first vertical conveying roller pair 122 are temporarily stopped, and then, the conveyance of the envelope E is stopped. The position of the envelope E at this time corresponds to a "specified position". The envelope processing controller 150 executes the conveyance stop control of the envelope E based on the "flap length" and the "body length" calculated up to this stage and the rotation amount of each conveying roller pair rotated for the conveyance operation of the envelope E in the envelope conveyance passage 1105. For example, the envelope processing controller 150 calculates the conveyance amount of the envelope E from the rotation amount of each conveying roller pair and controls the conveyance of the envelope E by comparison with the distance that the envelope E moves until the envelope E reaches the stop position based on the flap length. Thus, the envelope processing controller 150 can execute the stop control that stops the envelope E at the specified position.

Figure 25:
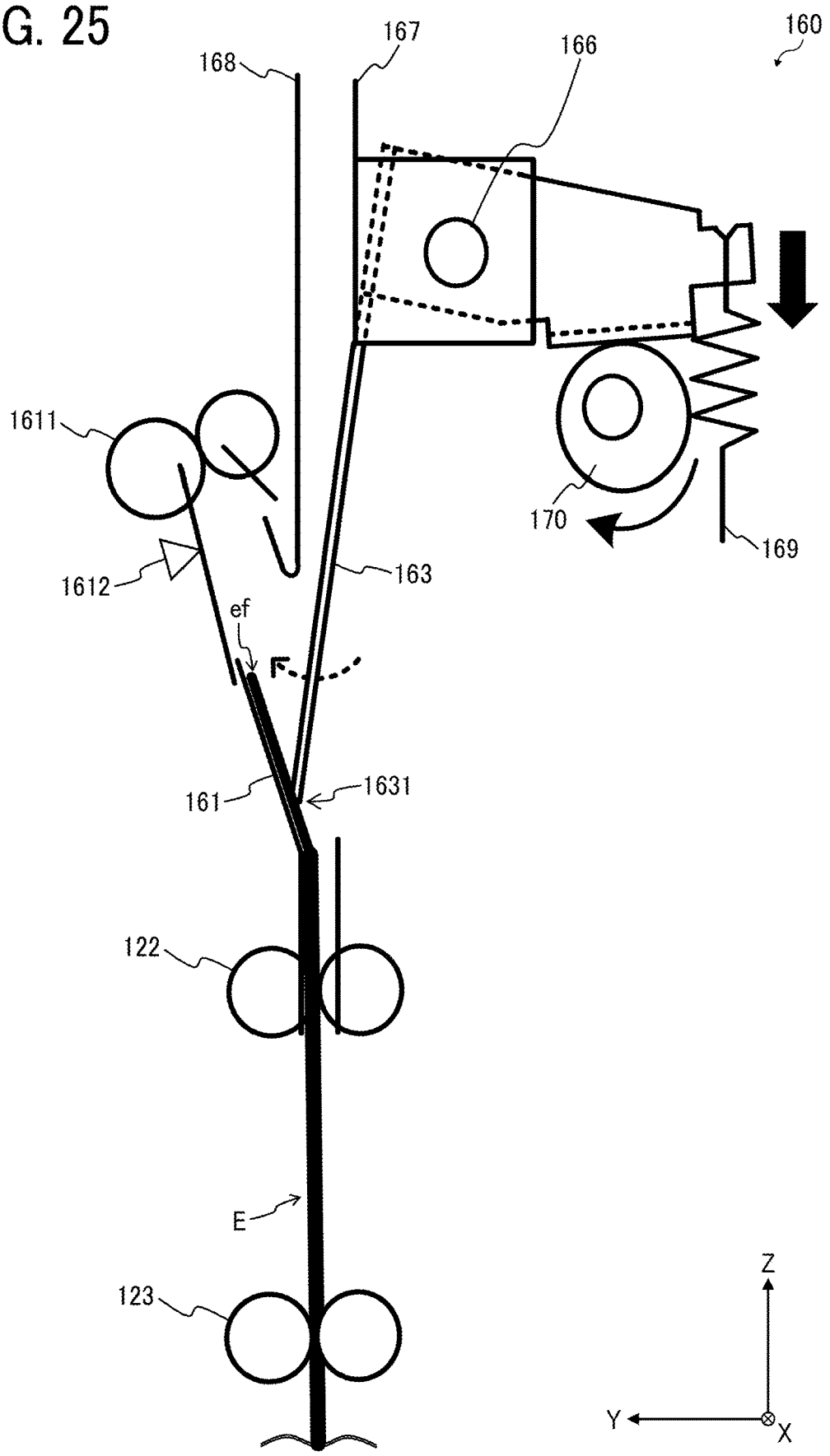
FIG. 25 is a diagram illustrating an operation of the enclosing support of the envelope processing apparatus, subsequent to FIG. 24.

Subsequently, as illustrated in FIG. 25, the envelope processing controller 150 rotates the drive cam 170 by a specified angle. The cam surface that pushes up the enclosing guide member 163 by the drive cam 170 is displaced downward by the rotation of the drive cam 170, so that the bottom surface of the enclosing guide member 163 is moved downward by the biasing force of the enclosing guide spring 169. As a result, the enclosing guide member 163 rotates in the direction indicated by a broken line arrow in FIG. 25. In other words, the enclosing guide member 163 rotates such that the tip portion 1631 of the enclosing guide member 163 is pressed against the flap guide plate 161.

When the tip portion 1631 of the enclosing guide member 163 rotates toward the flap guide plate 161, the flap ef of the envelope E placed at the specified position contacts the tip portion 1631 of the enclosing guide member 163. Thus, the flap ef is pressed in the rotation direction of the enclosing guide member 163. As a result, the flap ef is pinched between the tip portion 1631 of the enclosing guide member 163 and the flap guide plate 161.

In other words, when the envelope E has reached the specified position (the position at which the flap ef overlaps with the tip portion 1631 of the enclosing guide member 163), the flap ef is directed toward the flap guide plate 161 by the enclosing guide member 163.

Figure 26:
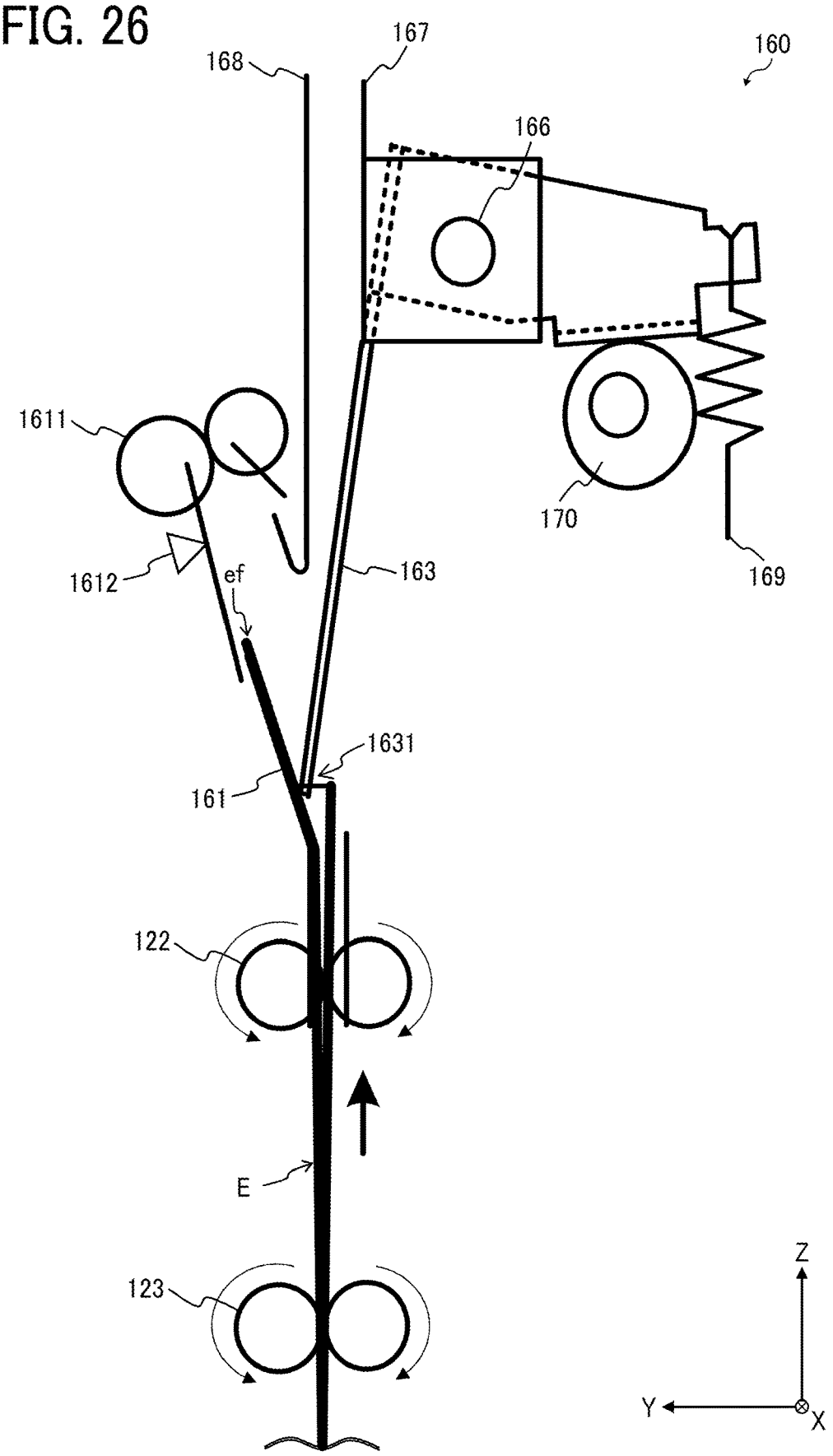
FIG. 26 is a diagram illustrating an operation of the enclosing support of the envelope processing apparatus, subsequent to FIG. 25.

Subsequently, as illustrated in FIG. 26, the envelope processing controller 150 restarts the rotation of the second vertical conveying roller pair 123 and the first vertical conveying roller pair 122. As a result, the envelope E further moves in the +Z direction while the flap ef remains pressed against the flap guide plate 161. At this time, the envelope E is conveyed against the biasing force of the enclosing guide member 163, and the tip portion 1631 of the enclosing guide member 163 is inserted into the frontage of the envelope E. Since the flap ef is conveyed in a state of being pressed toward the flap guide plate 161 by the enclosing guide member 163, the flap ef is turned into a state of being conveyed in a direction different from the conveyance direction of the frontage of the envelope E. As a result, the envelope E is slightly deformed, so that the frontage of the envelope E is expanded by the conveyance of the flap ef. The enclosing guide member 163 enters the expanded frontage of the envelope E.

Figure 27:
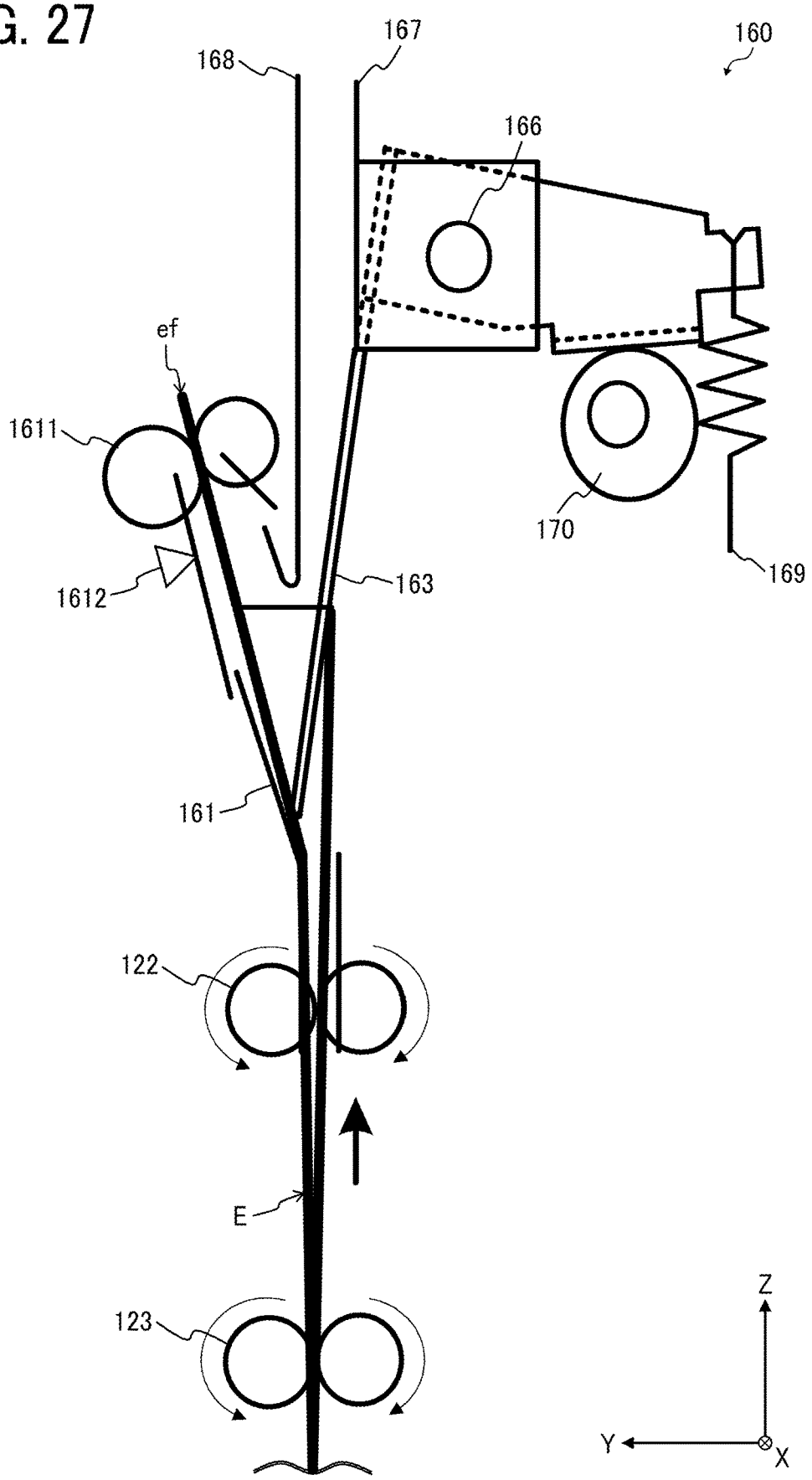
FIG. 27 is a diagram illustrating an operation of the enclosing support of the envelope processing apparatus, subsequent to FIG. 26.

Subsequently, as illustrated in FIG. 27, as the envelope E is further conveyed in the +Z direction by the rotation of the first vertical conveying roller pair 122, the flap ef is conveyed toward a flap conveyance passage formed by the flap guide plate 161 and is held by a flap holding roller pair 1611 as a flap holder. The flap guide plate 161 is provided with a flap detection sensor 1612. Accordingly, when the flap detection sensor 1612 has detected the flap ef, the envelope processing controller 150 determines that the flap ef has been held by the flap holding roller pair 1611 and stops the conveyance of the envelope E again. At this time, the enclosing guide member 163 is inserted deeper into the envelope E, so that the opening of the envelope E is open wider.

At this stage, the entering amount of the enclosing guide member 163 into the envelope E is larger than the entering amount indicated in FIG. 26. The flap ef is formed by the flap guide plate 161, is conveyed toward the flap conveyance passage, and is in a state of being held by the flap holding roller pair 1611. Accordingly, one side of the opening corresponding to the upper end of the body portion of the envelope E is moved to a position extending outward from the envelope conveyance passage 1105 along the outer inclined surface of the enclosing guide member 163.

Figure 28:
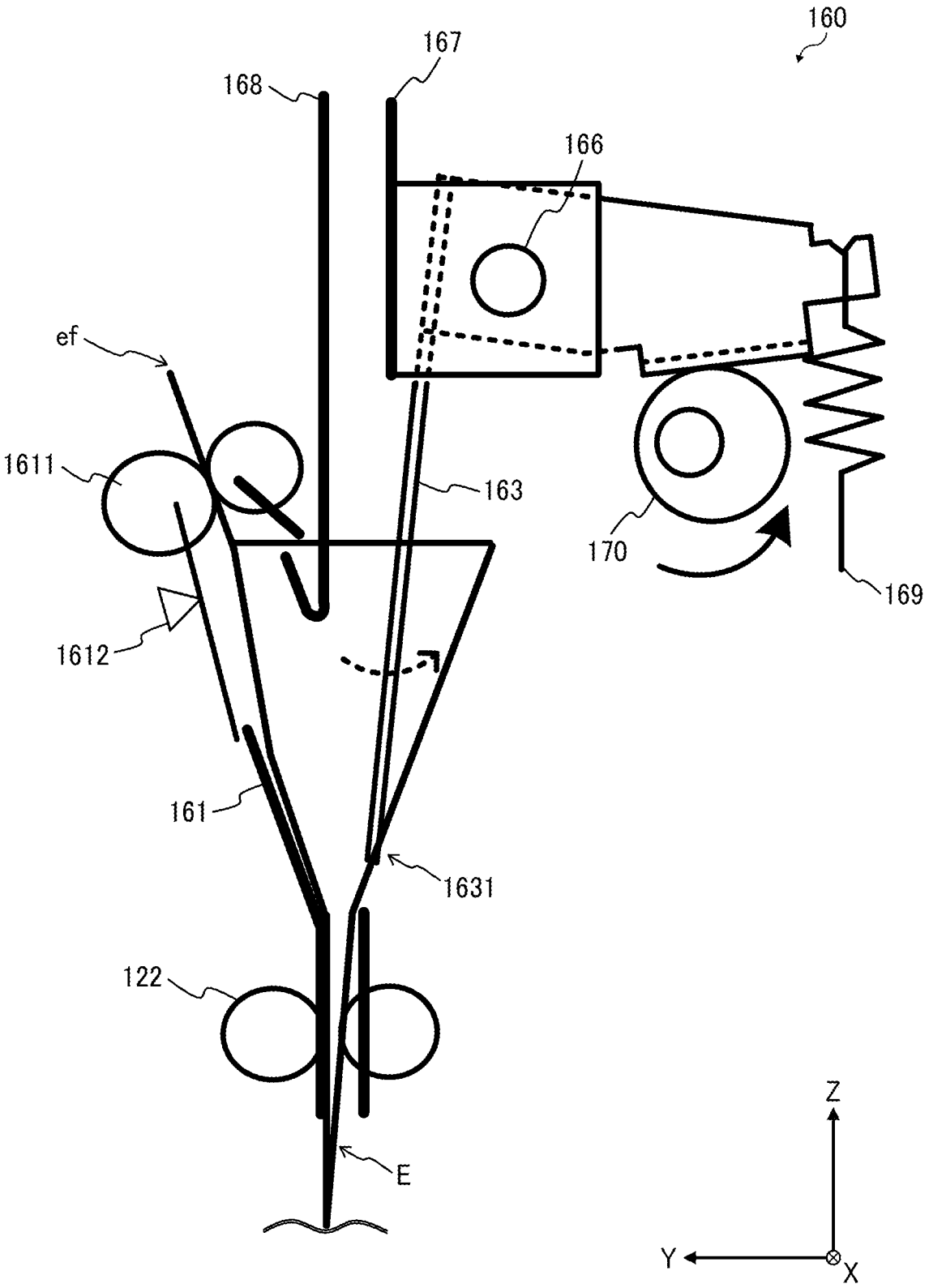
FIG. 28 is a diagram illustrating an operation of the enclosing support of the envelope processing apparatus, subsequent to FIG. 27.

Subsequently, as illustrated in FIG. 28, the envelope processing controller 150 rotates the drive cam 170. With this operation, the tip portion 1631 rotates in a direction away from the flap guide plate 161. Then, the inside of the envelope E is pushed outward. In other words, the opening of the envelope E is further enlarged by the rotation of the enclosing guide member 163.

After the envelope E reaches the state illustrated in FIG. 28, the flap ef is held in the opened state by the enclosing support 160 until the envelope E reaches the state described above with reference to FIGS. 15 to 18.

Figure 29:
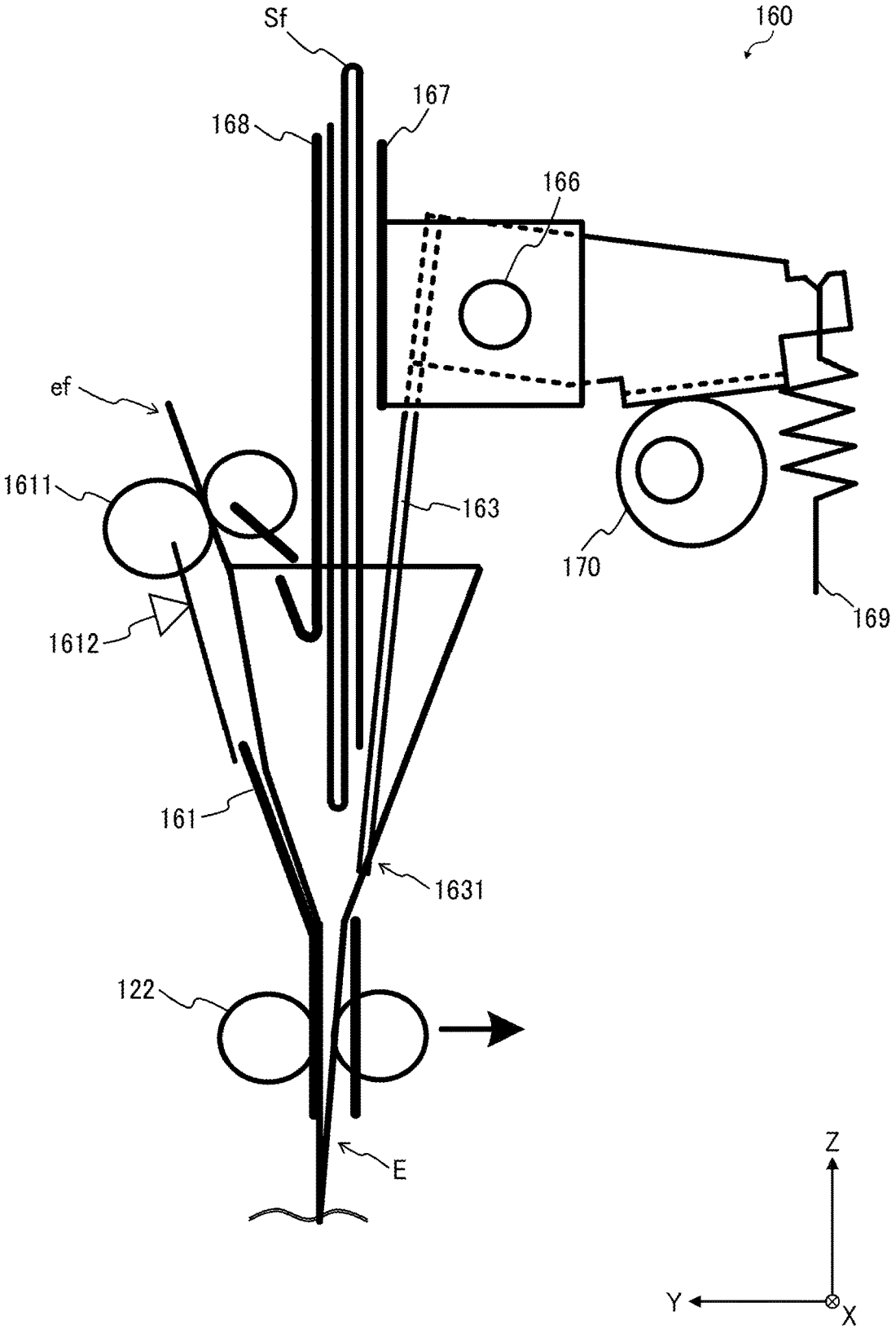
FIG. 29 is a diagram illustrating an operation of the enclosing support of the envelope processing apparatus, subsequent to FIG. 28.

FIG. 29 is an enlarged view of the enclosing support 160 in a state corresponding to FIG. 17. As illustrated in FIG. 29, with respect to the envelope E in the standby state, the folded sheet Sf, which is the enclosure conveyed through the enclosing conveyance passage 1104, passes through between an enclosing-member opposing guide plate 168 and an enclosing-member fixing guide plate 167. Then, the folded sheet Sf is guided toward the inside of the envelope E along the inclined surface of the enclosing guide member 163.

At this time, the first vertical conveying roller pair 122 evacuates to the position where the opposing rollers are placed apart (the rollers are separated from each other) and the folded sheet Sf does not interfere with the enclosing of the envelope E. Even if the state in which the envelope E is nipped by the first vertical conveying roller pair 122 is released to enable the envelope E to enclose, the flap ef is still nipped by the flap holding roller pairs 1611. As a result, the envelope E can be continuously held at the enclosing position.

Figure 30:
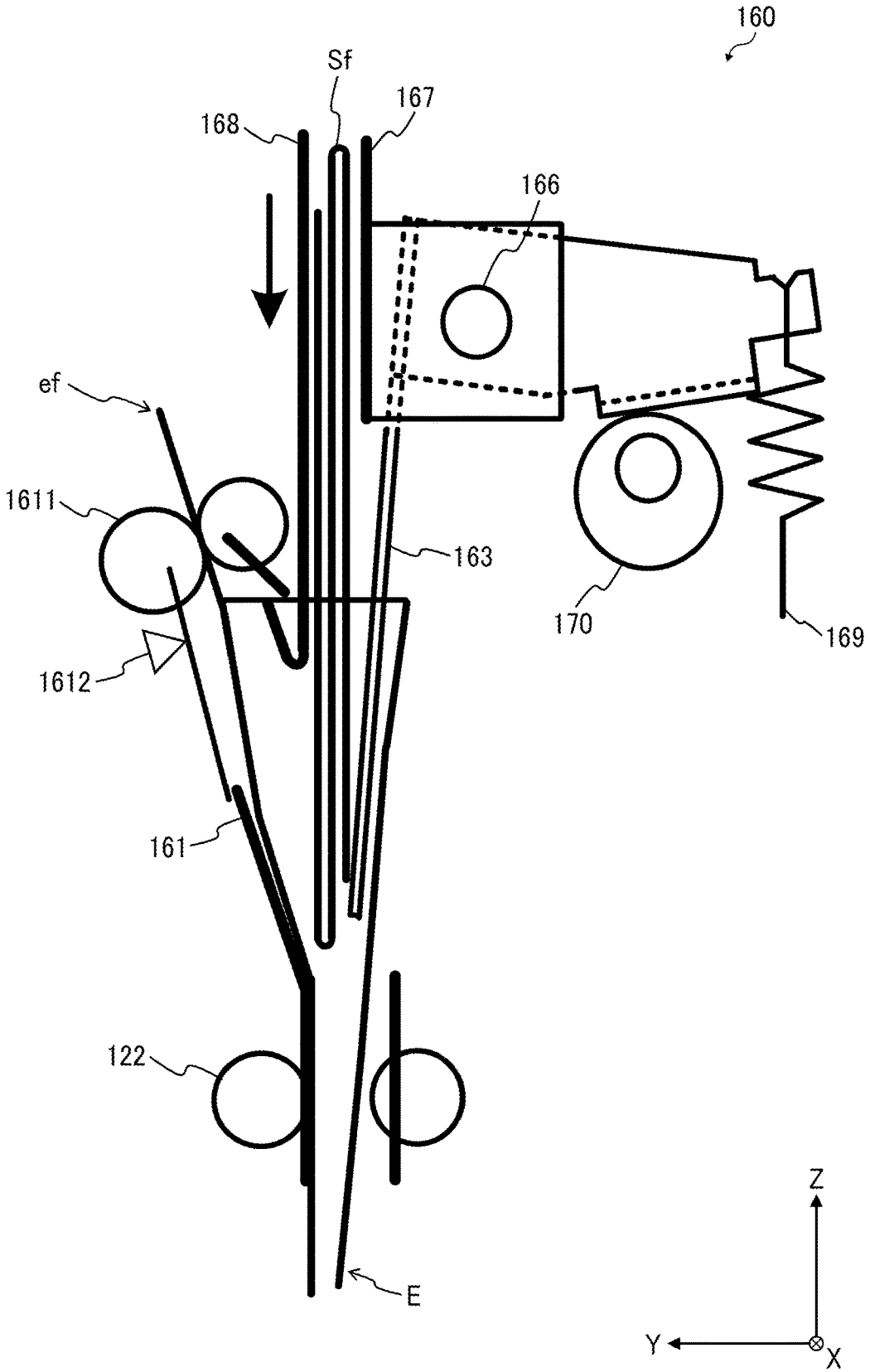
FIG. 30 is a diagram illustrating an operation of the enclosing support of the envelope processing apparatus, subsequent to FIG. 29.

Subsequently, as illustrated in FIG. 30, as the folded sheet Sf is conveyed into the envelope E, the enclosing guide member 163 pressed by the folded sheet Sf rotates around an enclosing guide shaft 166 and moves out of the path of the folded sheet Sf. As a result, the folded sheet Sf is sequentially conveyed from the frontage to the inside of the envelope E.

The enclosing guide member 163 is biased in a direction toward the flap guide plate 161 by the enclosing guide spring 169. However, the folded sheet Sf is conveyed against the biasing force. Then, the folded sheet Sf is further conveyed toward the bottom of the envelope E by another member and is enclosed.

The enclosing support operation according to the first embodiment described above is an example of an operation on an envelope E having a relatively short flap ef and a relatively short body length. When the opening of the envelope E is adjusted in the enclosing support operation, as described above, the conveyance amount by which the envelope E is conveyed to the position at which the flap ef is held by the flap holding roller pair 1611 is determined by the length of the flap ef. At this time, the envelope E is conveyed in a state in which the enclosing guide member 163 enters the opening. Accordingly, as described with reference to FIG. 28, the amount by which the opening is enlarged by the outer side surface of the enclosing guide member 163 (opening amount) varies with the conveyance amount determined by the length of the flap ef. In other words, the opening amount of the envelope E may be adjusted by adjusting the conveyance amount of the envelope E determined depending on the length of the flap ef in order to achieve preferable opening amount of the envelope E.

Figure 31A:
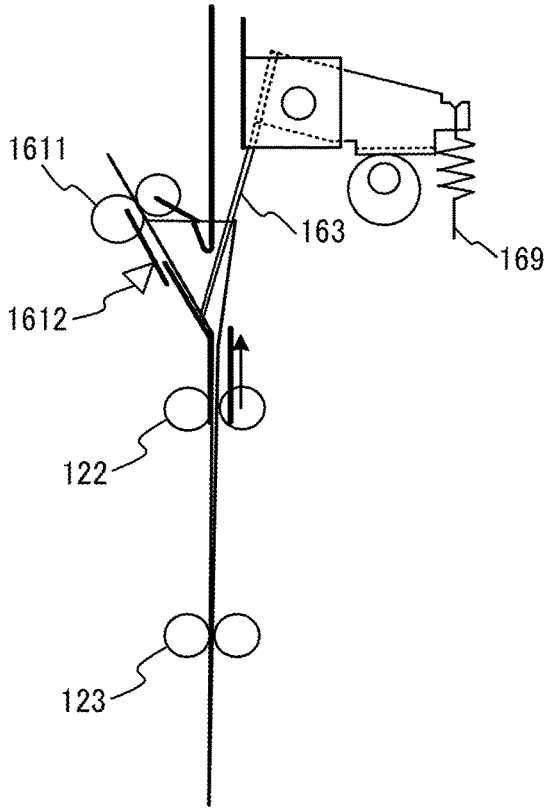
FIGS. 31A and 31B are diagrams illustrating an adjustment operation of the opening amount of a frontage of an envelope in the enclosing support according to a second embodiment.
Figure 31B:
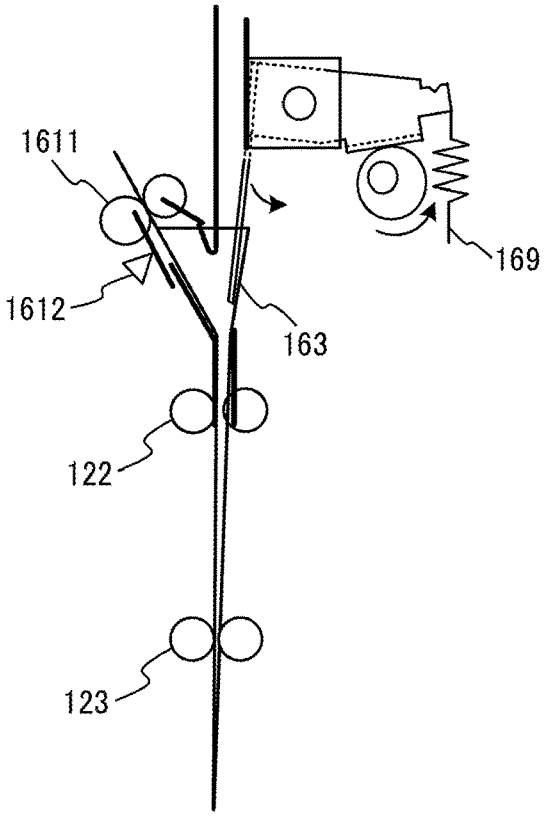

Next, with reference to FIGS. 31A and 31B, a description is given of an enclosing support operation according to a second embodiment. The present embodiment corresponds to the enclosing support operation in which the opening of the envelope E is adjusted by adjusting the amount of rotation of the enclosing guide member 163 in the case where "the flap ef is short and the body length is long" in the envelope E. The operation from when the envelope E is conveyed to the enclosing position to when the flap ef is pushed and directed toward the flap guide plate 161 by the enclosing guide member 163 (see FIG. 26) is the same as the operation described above.

As illustrated in FIG. 31A, in the state in which the enclosing guide member 163 is inserted into the opening of the envelope E, the envelope E is conveyed until the flap ef is held by the flap holding roller pair 1611, so that the opening amount of the envelope E increases.

As illustrated in FIG. 31B, when the flap ef is brought into a state of being held by the flap holding roller pair 1611, the conveyance of the envelope E is stopped and the enclosing guide member 163 is rotated. As compared with the case (first embodiment) where "the flap ef is short and the body length is also short" illustrated in FIG. 28, the amount of rotation at this time is adjusted to be smaller. In other words, in the case where "the flap ef is short and the body length is long" in the envelope E, the rotation amount of the enclosing guide member 163 (the enclosing member rotation amount) is set to be smaller than the rotation amount in the case where "the flap ef is short and the body length is also short" in the envelope E.

As described above, in the case where the body length is relatively long, friction with the end (opening portion) of the envelope E when the enclosure is inserted is small, even if the enclosing member rotation amount is decreased. Thus, the conveyance load can be reduced.

Figure 32A:
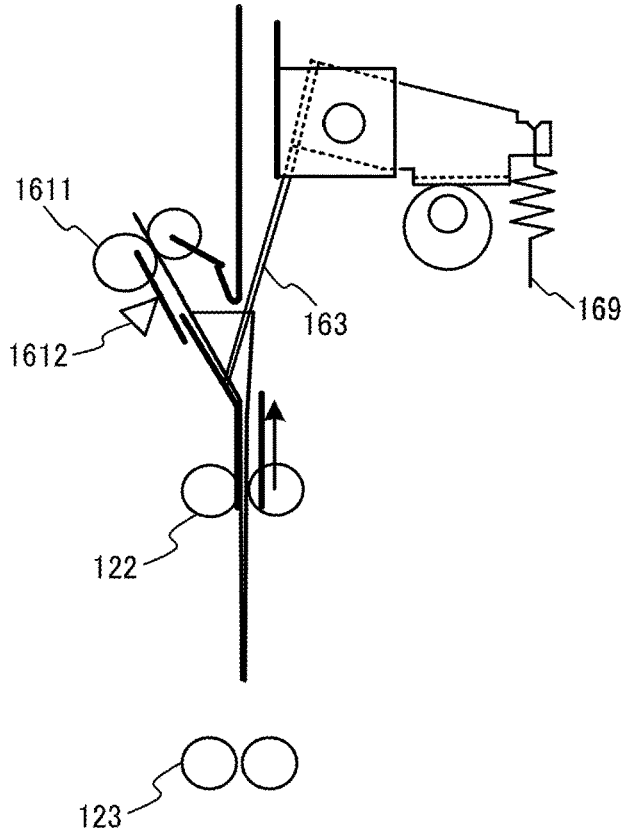
FIGS. 32A and 32B are diagrams illustrating an adjustment operation of the opening amount of a frontage of an envelope in the enclosing support according to a third embodiment.
Figure 32B:
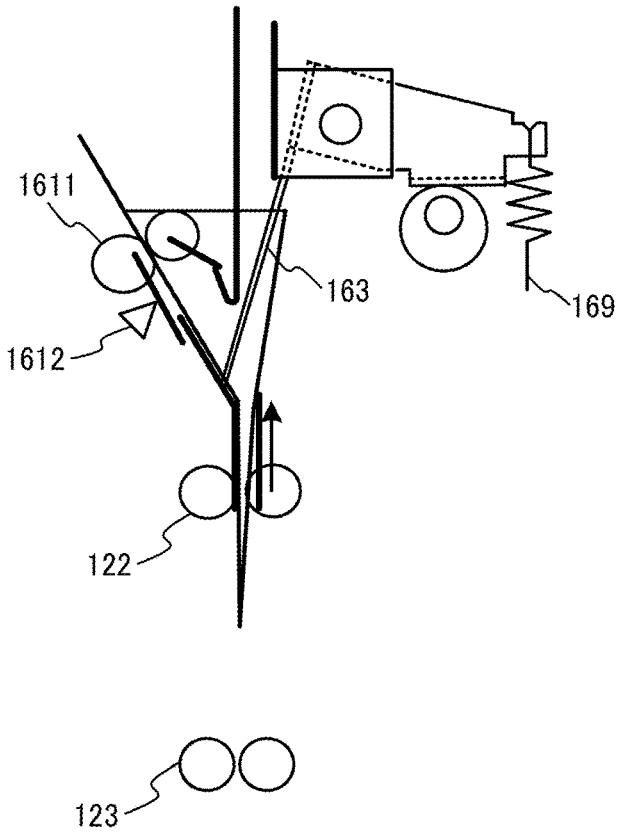

Next, a description is given of an enclosing support operation according to a third embodiment with reference to FIGS. 32A and 32B. The present embodiment is an enclosing support operation in a case where "the flap ef is short and the body length is short" in the envelope E, and corresponds to an operation of adjusting the opening amount of the envelope E by using conveying roller pairs. The operation from when the envelope E is conveyed to the enclosing position to when the flap ef is pushed and directed toward the flap guide plate 161 by the enclosing guide member 163 (see FIG. 26) is the same as the operation described above.

First, as illustrated in FIG. 32A, in the state where the enclosing guide member 163 is inserted into the opening of the envelope E, the envelope E is conveyed so that the flap ef is held by the flap holding roller pair 1611. Thus, the opening amount of the envelope E increases.

Subsequently, as illustrated in FIG. 32B, even after the flap ef is held by the flap holding roller pair 1611, the first vertical conveying roller pair 122 is rotated to move the envelope E further in the +Z direction. This conveying operation causes one side of the opening of the envelope E to move along the outer side surface of the enclosing guide member 163, so that the envelope E reaches a state in which the opening of the envelope E is opened wider.

In other words, in the present embodiment, the envelope processing controller 150 controls the rotation amount of the first vertical conveying roller pair 122 to adjust the opening of the envelope E. The control of the rotation amount of the first vertical conveying roller pair 122 may be triggered by detection of the leading end of the flap ef by the flap detection sensor 1612. In other words, the envelope processing controller 150 adjusts the rotation amount of the first vertical conveying roller pair 122 from the time when the flap detection sensor 1612 detects the leading end of the flap ef to adjust the opening amount of the envelope E.

Figure 33A:
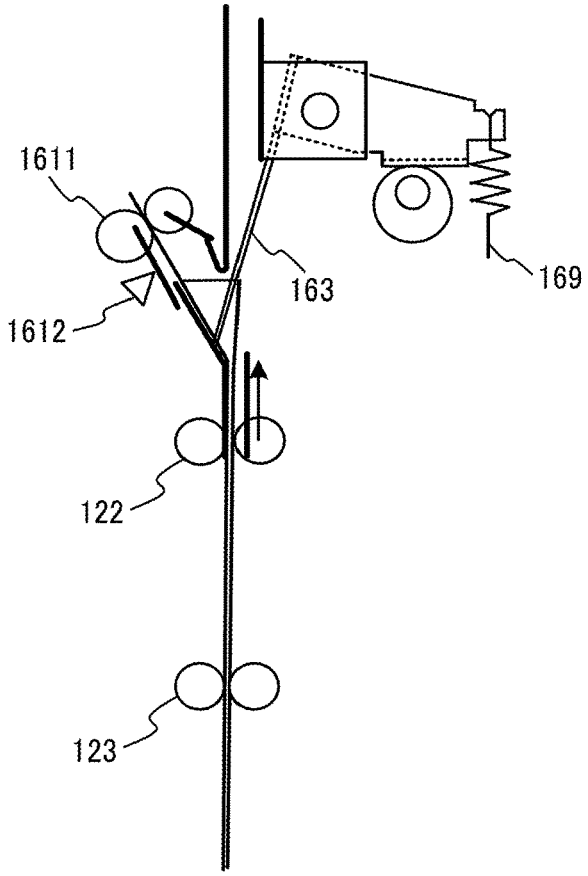
FIGS. 33A and 33B diagrams illustrating an adjustment operation of the opening amount of a frontage of an envelope in the enclosing support according to a fourth embodiment.
Figure 33B:
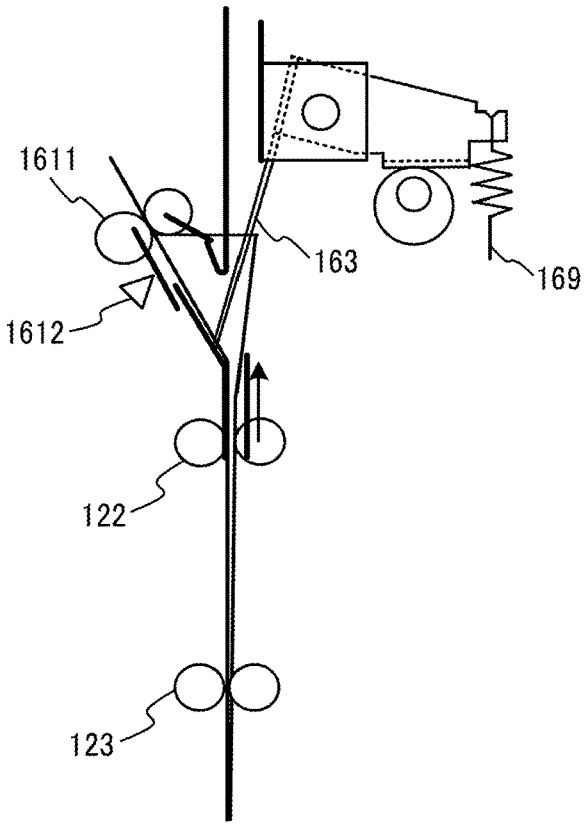

Next, a description is given of an enclosing support operation according to a fourth embodiment with reference to FIGS. 33A and 33B. The present embodiment is an enclosing support operation in a case where "the flap ef is short and the body length is long" of the envelope E, and corresponds to an operation of adjusting the opening amount of the envelope E by using conveying roller pairs. The operation from when the envelope E is conveyed to the enclosing position to when the flap ef is pushed and directed toward the flap guide plate 161 by the enclosing guide member 163 (see FIG. 26) is the same as the operation described above.

First, as illustrated in FIG. 33A, in the state where the enclosing guide member 163 is inserted into the opening of the envelope E, the envelope E is conveyed so that the flap ef is held by the flap holding roller pair 1611. Thus, the opening amount increases.

Subsequently, as illustrated in FIG. 33B, even after the flap ef is held by the flap holding roller pair 1611, the first vertical conveying roller pair 122 and the second vertical conveying roller pair 123 are rotated to move the envelope E further in the +Z direction. This conveying operation causes one side of the opening of the envelope E to move along the outer side surface of the enclosing guide member 163, so that the envelope E reaches a state in which the opening of the envelope E is opened wider.

In other words, in the present embodiment, the envelope processing controller 150 controls the rotation amount of the first vertical conveying roller pair 122 and the second vertical conveying roller pair 123 to adjust the opening of the envelope E. The control of the rotation amount of the first vertical conveying roller pair 122 and the second vertical conveying roller pair 123 may be triggered by detection of the leading end of the flap ef by the flap detection sensor 1612. The rotation amounts of the first vertical conveying roller pair 122 and the second vertical conveying roller pair 123 may be smaller than the rotation amounts according to the third embodiment described with reference to FIG. 32.

In other words, the opening amount of the envelope E can be adjusted by adjusting the amount of rotation of the first vertical conveying roller pair 122 and the second vertical conveying roller pair 123 from the time when the flap detection sensor 1612 detects the leading end of the flap ef.

Figure 34A:
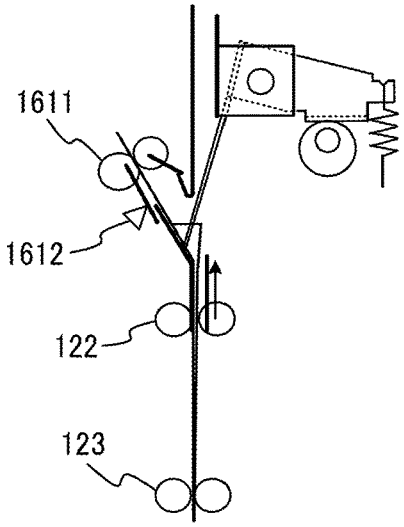
FIGS. 34A to 34C diagrams illustrating an adjustment operation of the opening amount of a frontage of an envelope in the enclosing support according to a fifth embodiment.

Next, a description is given of an enclosing support operation according to a fifth embodiment with reference to FIG. 34. The present embodiment corresponds to an enclosing support operation in which the opening of the envelope E is adjusted by adjusting the amount of rotation of the enclosing guide member 163 in a case where "the flap ef is long and the body length is short" in the envelope E. The operation from when the envelope E is conveyed to the enclosing position to when the envelope E reaches a state in which the flap ef is held by the flap holding roller pair 1611 (see FIG. 34A) is the same as the operation described above.

The opening amount of the envelope E in the state of FIG. 34A is smaller than in a case where the flap ef is relatively short (see FIG. 27).

Figure 34B:
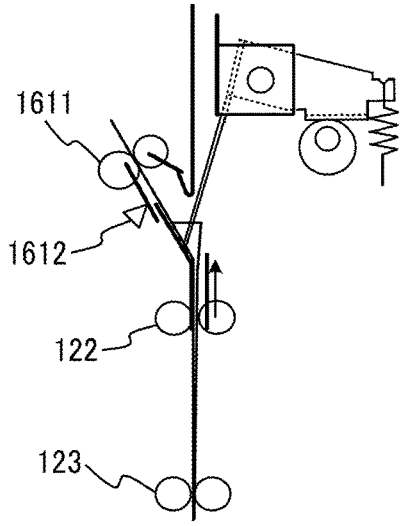

Subsequently, as illustrated in FIG. 34B, in the state where the enclosing guide member 163 is inserted into the opening of the envelope E and the flap ef is held by the flap holding roller pair 1611, the first vertical conveying roller pair 122 and the second vertical conveying roller pair 123 are rotated. Accordingly, the envelope E further moves in the +Z direction. This movement increases the opening amount of the envelope E.

Figure 34C:
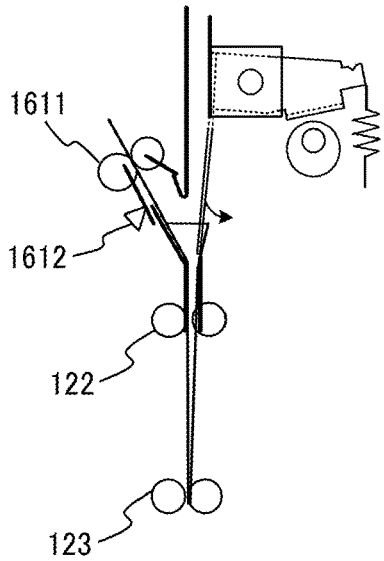

Subsequently, as illustrated in FIG. 34C, the conveyance of the envelope E is stopped, and the enclosing guide member 163 is rotated. The rotation amount at this time is adjusted to be smaller than in a case where "the flap ef is short". In other words, in a case where the envelope E has a "the flap ef is long and the body length is short", the entry of an enclosure into the envelope E can be smoothly performed even if the rotation amount of the enclosing guide member 163 (the rotation amount of the enclosing member) is smaller than in a case where "the flap ef is short" in the envelope E.

As described above, in a case where the length of the flap ef is relatively long, friction with the end (opening portion) of the envelope E when the enclosure is inserted is small, even if the amount of rotation of the enclosing member is decreased. Thus, the conveyance load can be reduced.

Figure 35A:
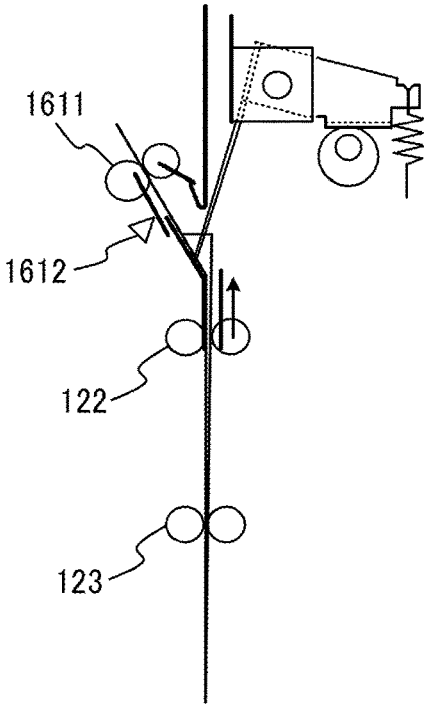
FIGS. 35A and 35B diagrams illustrating an adjustment operation of the opening amount of a frontage of an envelope in the enclosing support according to a sixth embodiment.
Figure 35B:
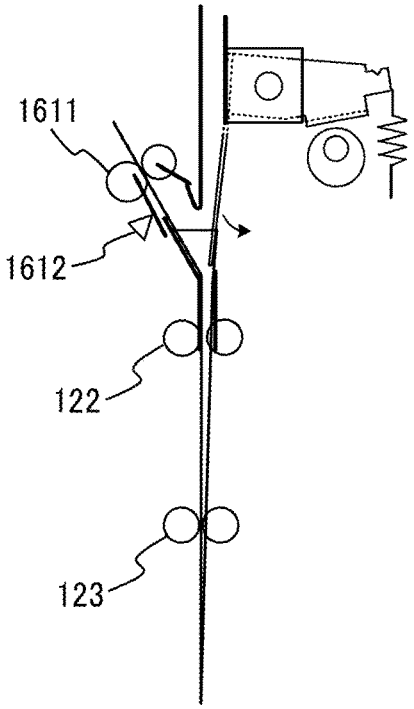

Next, a description is given of an enclosing support operation according to a sixth embodiment with reference to FIGS. 35A and 35B. The present embodiment corresponds to an enclosing support operation in which the opening of the envelope E is adjusted by adjusting the amount of rotation of the enclosing guide member 163 in a case where "the flap ef is long and the body length is also long" in the envelope E. The operation from when the envelope E is conveyed to the enclosing position to when the envelope E reaches a state in which the flap ef is held by the flap holding roller pair 1611 (see FIG. 34A) is the same as the operation described above.

First, as illustrated in FIG. 35A, in a state where the enclosing guide member 163 is inserted into the opening of the envelope E and the flap ef is held by the flap holding roller pair 1611, the first vertical conveying roller pair 122 and the second vertical conveying roller pair 123 are rotated. Accordingly, the envelope E further moves in the +Z direction. This movement increases the opening amount of the envelope E.

Subsequently, as illustrated in FIG. 35B, the conveyance of the envelope E is stopped, and the enclosing guide member 163 is rotated. The rotation amount at this time is adjusted to be smaller than in a case where "the flap ef is short". In other words, in a case where "the flap ef is long and the body length is also long" in the envelope E, the opening amount of the envelope E is already reduced at a time point when the enclosing guide member 163 is rotated. Thus, the opening amount of the envelope E can be reduced as compared with a case where "the flap ef is short and the body length is long".

Figure 36A:
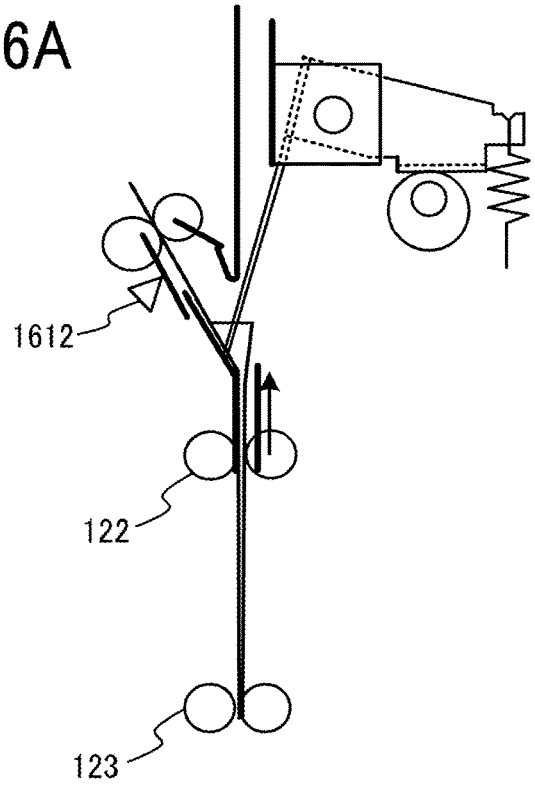
FIGS. 36A and 36B diagrams illustrating an adjustment operation of the opening amount of a frontage of an envelope in the enclosing support according to a seventh embodiment.
Figure 36B:
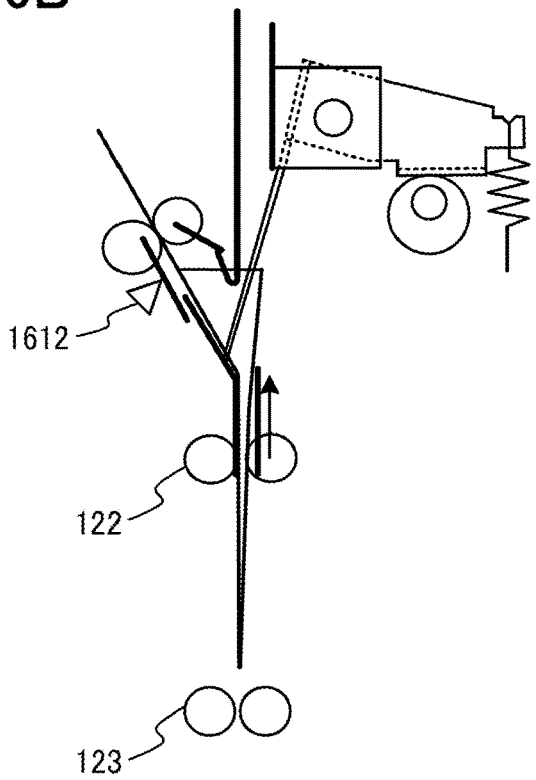

Next, a description is given of an enclosing support operation according to a seventh embodiment with reference to FIGS. 36A and 36B. The present embodiment is an enclosing support operation in a case where "the flap ef is long and the body length is short" of the envelope E, and corresponds to an operation of adjusting the opening amount of the envelope E by using conveying roller pairs. The operation from when the envelope E is conveyed to the enclosing position to when the envelope E reaches a state in which the flap ef is held by the flap holding roller pair 1611 (see FIG. 34A) is the same as the operation described above.

First, as illustrated in FIG. 36A, in a state where the enclosing guide member 163 is inserted into the opening of the envelope E, the envelope E is conveyed so that the flap ef is held by the flap holding roller pair 1611. Thus, the opening amount increases.

Subsequently, as illustrated in FIG. 36B, even after the flap ef is held by the flap holding roller pair 1611, the first vertical conveying roller pair 122 is rotated to move the envelope E further in the +Z direction. This conveying operation causes one side of the opening of the envelope E to move along the outer side surface of the enclosing guide member 163, so that the envelope E reaches a state in which the opening of the envelope E is opened wider.

In other words, in the present embodiment, the envelope processing controller 150 controls the rotation amount of the first vertical conveying roller pair 122 to adjust the opening of the envelope E. The control of the rotation amount of the first vertical conveying roller pair 122 may be triggered by detection of the leading end of the flap ef by the flap detection sensor 1612. In other words, the envelope processing controller 150 adjusts the rotation amount of the first vertical conveying roller pair 122 from the time when the flap detection sensor 1612 detects the leading end of the flap ef to adjust the opening amount of the envelope E.

In the state illustrated in FIG. 36A, the opening amount of the envelope E is reduced as compared with a case where "the flap ef is short". As a result, a specified opening amount of the envelope E can be obtained even if the rotation amount of the first vertical conveying roller pair 122 is reduced.

Next, a description is given of an enclosing support operation according to an eighth embodiment with reference to FIG. 37. The present embodiment is an enclosing support operation in a case where "the flap ef is long and the body length is also long" in the envelope E, and corresponds to an operation of adjusting the opening amount of the envelope E by using conveying roller pairs. The operation from when the envelope E is conveyed to the enclosing position to when the envelope E reaches a state in which the flap ef is held by the flap holding roller pair 1611 (see FIG. 34A) is the same as the operation described above.

Figure 37A:
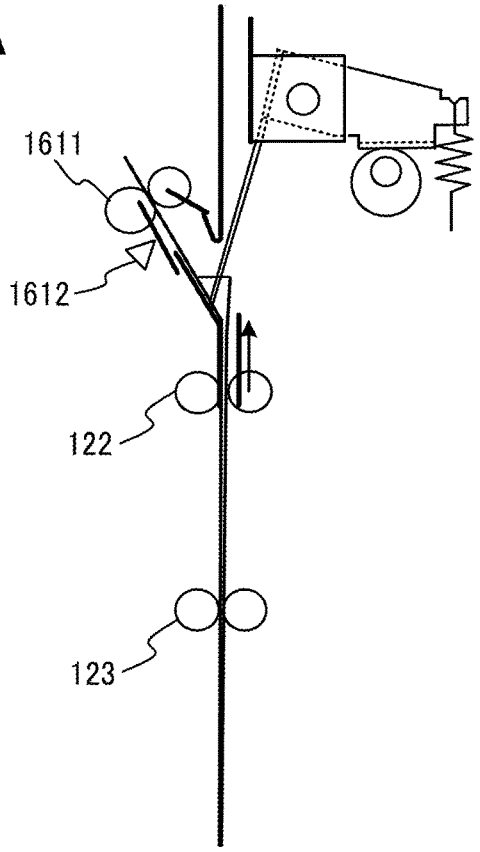
FIGS. 37A and 37B are diagrams illustrating an adjustment operation of the opening amount of a frontage of an envelope in the enclosing support according to an eighth embodiment.

First, as illustrated in FIG. 37A, in a state where the enclosing guide member 163 is inserted into the opening of the envelope E, the envelope E is conveyed so that the flap ef is held by the flap holding roller pair 1611. Thus, the amount of opening increases.

Figure 37B:
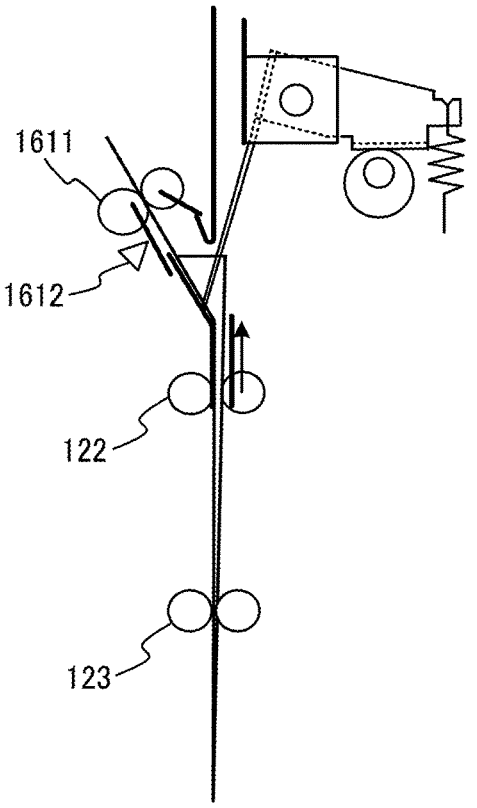

Subsequently, as illustrated in FIG. 37B, even after the flap ef is held by the flap holding roller pair 1611, the first vertical conveying roller pair 122 and the second vertical conveying roller pair 123 are rotated to move the envelope E further in the +Z direction. This conveying operation causes one side of the opening of the envelope E to move along the outer side surface of the enclosing guide member 163, so that the envelope E reaches a state in which the opening of the envelope E is opened wider.

In other words, in the present embodiment, the envelope processing controller 150 controls the rotation amount of the first vertical conveying roller pair 122 and the second vertical conveying roller pair 123 to adjust the opening of the envelope E. The control of the rotation amount of the first vertical conveying roller pair 122 and the second vertical conveying roller pair 123 may be triggered by detection of the leading end of the flap ef by the flap detection sensor 1612. In other words, the opening amount of the envelope E can be adjusted by adjusting the amount of rotation of the first vertical conveying roller pair 122 and the second vertical conveying roller pair 123 from the time when the flap detection sensor 1612 detects the leading end of the flap ef.

In the state illustrated in FIG. 37A, the opening amount of the envelope E is reduced as compared with a case where "the flap ef is short". As a result, a specified opening amount of the envelope E can be obtained even if the rotation amounts of the first vertical conveying roller pair 122 and the second vertical conveying roller pair 123 are reduced.

Next, a description is given of the relationship between the "opening adjustment amount" for adjusting the opening amount of the envelope E in the enclosing support operation and the "state of the enclosure" to be inserted into the envelope E with reference to FIGS. 38A to 41C.

Note that the "state of the enclosure" includes, for example, the type of folding processing performed on the folded sheet Sf as an enclosure, the folding height of the folded sheet Sf, the sheet thickness of the folded sheet Sf, and the stacking number of folded sheets Sf. The "state of the enclosure" corresponds to information as a factor for adjusting the amount of opening when the enclosure is inserted into the envelope E. The envelope processing controller 150 executes processing for correcting, depending on the state of the enclosure, the opening amount of the envelope E determined according to whether the flap length or the body length of the envelope E is relatively "long" or "short".

Figure 38A:
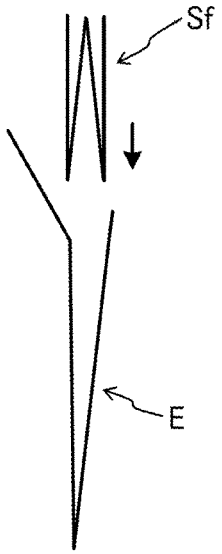
FIGS. 38A to 38C are diagrams illustrating an example of the relationship between a state of an enclosure and an opening of a frontage of an envelope.
Figure 38B:
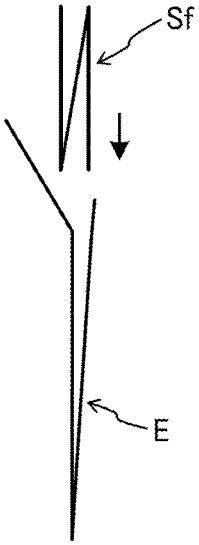
Figure 38C:
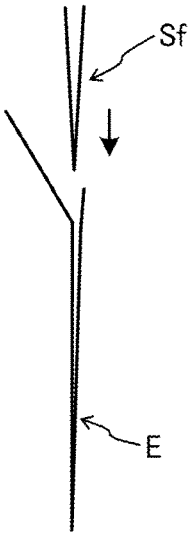

FIGS. 38A to 38C illustrate a series of open states of the envelope E depending on the number of times of folding processing performed on the folded sheet Sf as an enclosure in folding processing. FIG. 38A illustrates an opening amount of the envelope E for a folded sheet Sf having been subjected to four folding. FIG. 38B illustrates an opening amount of the envelope E for a folded sheet Sf having been subjected to three folding. FIG. 38C illustrates an opening amount of the envelope E for a folded sheet Sf having been subjected to two folding. As illustrated in FIGS. 38A to 38C, as the number of times of folding increases, the opening amount of the envelope E is increased.

Figure 39A:
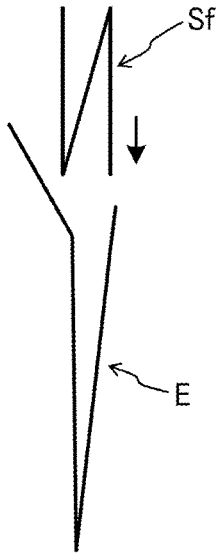
FIGS. 39A to 39C are diagrams illustrating another example of the relationship between a state of an enclosure and an opening of a frontage of an envelope.
Figure 39B:
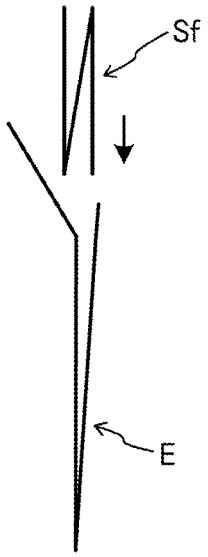
Figure 39C:
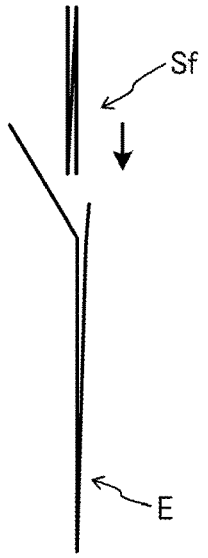

FIGS. 39A to 39C illustrate a series of open states of the envelope E depending on the folding heights of the folded sheet Sf as an enclosure. FIG. 39A illustrates an opening amount of the envelope E for a folded sheet Sf having a high folding height. FIG. 39B illustrates an opening amount of the envelope E for a folded sheet Sf having a normal folding height. FIG. 39C illustrates an opening amount of the envelope E for a folded sheet Sf having a low folding height. As illustrated in FIGS. 39A to 39C, as the folding height increases, the opening amount of the envelope E is increased.

The folding height turns to be lower as the number of times of the additional folding processing (the number of times of additional folding) by the additional folding mechanism described with reference to FIG. 6 increases. Accordingly, when the opening amount of the envelope E is adjusted and corrected depending on the folding height, a more accurate opening adjustment amount can be obtained by adding a correction based on the number of times of additional folding.

Figure 40A:
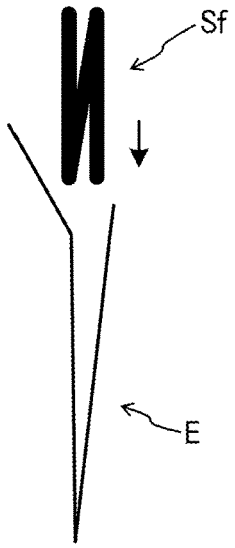
FIGS. 40A to 40C are diagrams illustrating still another example of the relationship between a state of an enclosure and an opening of a frontage of an envelope.
Figure 40B:
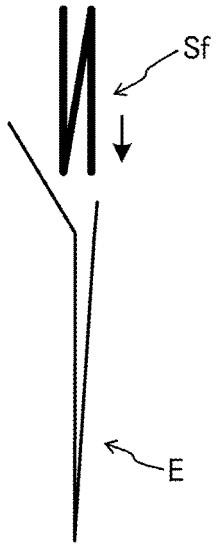
Figure 40C:
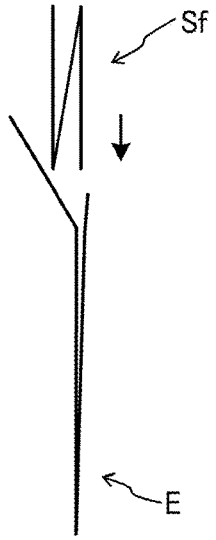

FIGS. 40A to 40C illustrate a series of open states of the envelope E depending on the sheet thickness of the folded sheet Sf as an enclosure. FIG. 40A illustrates an opening amount of the envelope E for a thick folded sheet Sf FIG. 40B illustrates an opening amount of the envelope E for a folded sheet Sf having a normal thickness. FIG. 40C illustrates an opening amount of the envelope E for a thin folded sheet Sf. As illustrated in FIGS. 40A to 40C, as the sheet thickness increases, the opening amount of the envelope E is increased.

Figure 41A:
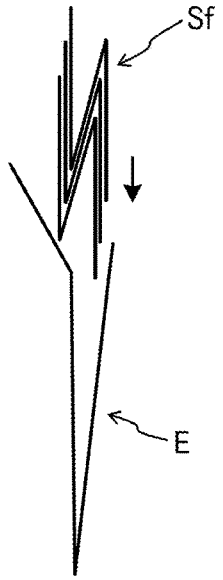
FIGS. 41A to 41C are diagrams illustrating still yet another example of the relationship between a state of an enclosure and an opening of a frontage of an envelope.
Figure 41B:
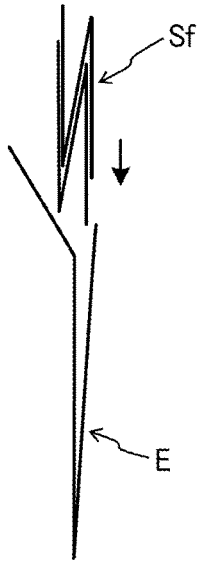
Figure 41C:
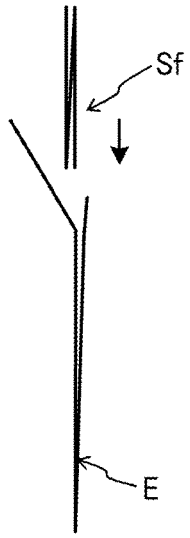

FIGS. 41A to 41C illustrate a series of open states of the envelope E depending on the number of stacks of the folded sheet Sf as an enclosure. FIG. 41A illustrates an opening amount of the envelope E for a three-ply folded sheet Sf FIG. 41B illustrates an opening amount of the envelope E for a two-ply folded sheet Sf FIG. 41C illustrates an opening amount of the envelope E for a single folded sheet Sf.

As illustrated in FIG. 41, as the number of sheets to be stacked increases, the opening amount of the envelope E is increased. In the multi-folding processing, the total folding height also turns to be lower as the number of times of the additional folding processing (the number of times of additional folding) by the additional folding mechanism described with reference to FIG. 6 increases. Accordingly, when the opening amount is adjusted and corrected depending on the number of overlaid sheets, a more accurate opening adjustment amount can be obtained by adding a correction based on the number of times of additional folding.

Here, a description is given of "pre-processing" executed before a print job is performed in the printer system 1 according to the present embodiment. The print job includes processing of forming an enclosure to be inserted into an envelope E in the enclosing support operation, is a group of instructions defining the contents of the image forming processing and the folding processing on a sheet S, and is mainly executed by the printer controller 260. Based on a series of processing contents included in the print job, a processing instruction to be executed and parameters to be used for the processing in the envelope processing apparatus 100 are notified as "various adjustment values" from the printer controller 260 to the envelope processing controller 150.

Figure 42:
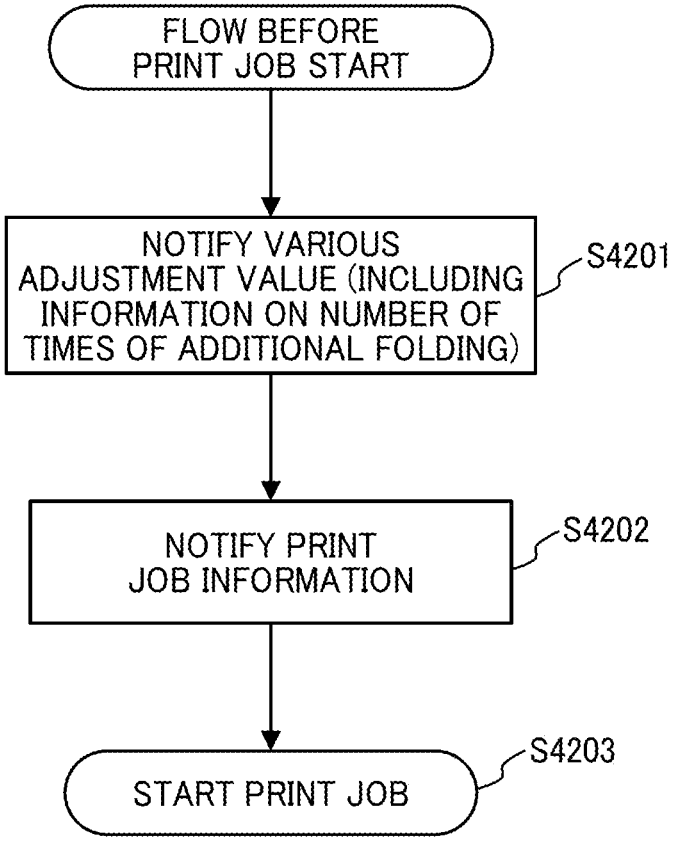
FIG. 42 is a flowchart of pre-processing of a print job according to an embodiment of the present disclosure.

FIG. 42 is a flowchart of a flow of processing (pre-print-job-start processing) executed before a print job is executed.

First, when a print job is performed, various adjustment values are notified to the apparatuses via the communication lines (207, 105, and 403) from the printer controller 260 of the image forming apparatus 200 (in step S4201 of FIG. 42). The envelope processing controller 150 stores the notified various adjustment values in the storage area.

Here, a description is further given of the "various adjustment values". The various adjustment values notified from the printer controller 260 to the envelope processing controller 150 include information indicating the type of folding processing performed in the folding apparatus 300, information indicating the folding height of the folded sheet Sf formed in each type of folding processing, information indicating the number of times of execution of additional folding processing, information indicating the variation of the folding height of the folded sheet Sf due to the execution of additional folding processing, information indicating the thickness of the sheet S used for the folded sheet Sf, and information indicating the number of times of multi-folding processing of the folded sheet Sf.

Initial values of the various adjustment values are held by the printer controller 260 included in the image forming apparatus 200. The initial values can also be changed (updated) by a user via the operation unit 220. When the initial values are changed, various adjustment values after changing are notified to the respective controllers via the communication lines 207, 105, and 403. The latest various adjustment values may be notified each time a print job is started, may be notified in initial processing performed after the operating power of the printer system 1 is turned on, or may not be notified unless an update operation is performed afterwards.

After the notification of the various adjustment values, the image forming apparatus 200 notifies the respective controllers of print job information via the communication lines 207, 105, and 403 (in step S4202 of FIG. 42). With this notification, the print job is started (in step S4203 of FIG. 42). The print job information includes, for example, a sheet type, a sheet thickness, a folding processing type, the number of sheets on which images are formed, and the number of times of enclosing processing.

Figure 43:
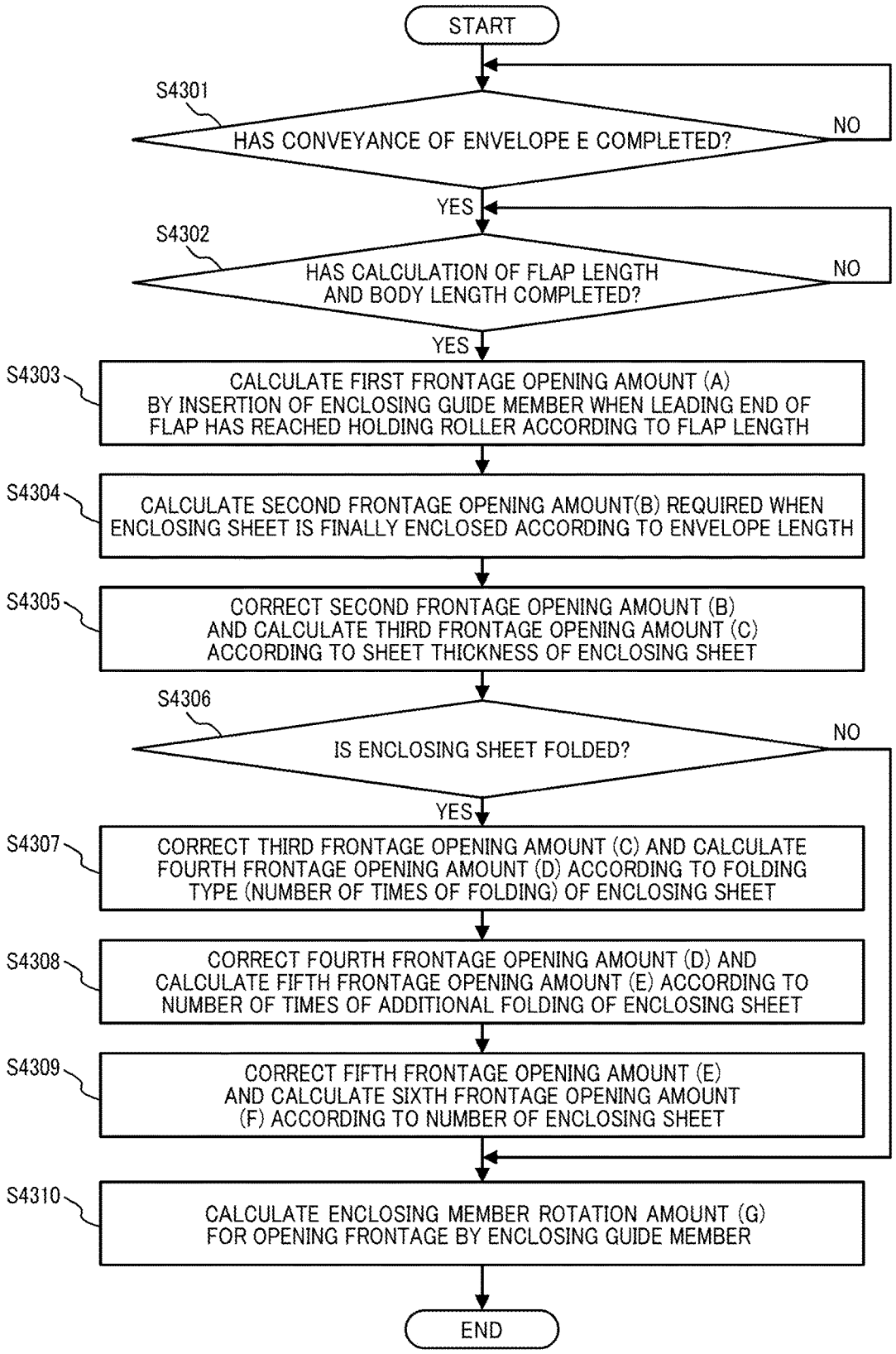
FIG. 43 is a flowchart of opening adjustment amount calculation processing according to an embodiment of the present disclosure.

Next, with reference to the flowchart of FIG. 43, a description is given of opening adjustment amount calculation processing used for control processing of the enclosing support operation executed in the envelope processing apparatus according to an embodiment of the present disclosure. The enclosing support operation is as described above. The envelope processing controller 150 adjusts the opening amount of the envelope E depending on the flap length and body length of the envelope E and the condition of the enclosure and controls the operation of the enclosing support 160 to achieve the adjusted opening amount.

A description is given of calculation processing of an opening adjustment amount for adjusting the rotation amount of the enclosing guide member 163 as a first embodiment.

First, the envelope processing controller 150 executes processing for conveying the envelope E to the enclosing position (in step S4301 of FIG. 43). The envelope processing controller 150 loops the processing until the envelope E has reached the enclosing position (NO in step S4301 of FIG. 43). When the envelope E has reached the enclosing position (YES in step S4301 of FIG. 43), the envelope processing controller 150 proceeds to the next processing.

Subsequently, the envelope processing controller 150 determines whether the calculation of the flap length and the body length of the envelope E is completed (in step S4302 of FIG. 43). The envelope processing controller 150 loops the processing until the calculation of the flap length and the body length of the envelope E is completed (NO in step S4302 of FIG. 43). When the calculation is completed (YES in step S4302 of FIG. 43), the envelope processing controller 150 proceeds to the next processing.

Subsequently, in step S4303 of FIG. 43, the envelope processing controller 150 calculates a first frontage opening amount A depending on the flap length calculated in step S4302 of FIG. 43. The first opening amount A corresponds to an amount by which the opening expands as the envelope E is conveyed until the flap ef is held by the flap holding roller pair 1611 after the enclosing guide member 163 is inserted into the opening (frontage) of the envelope E (see FIGS. 26 and 27).

Subsequently, in step S4304 of FIG. 43, the envelope processing controller 150 calculates a second frontage opening amount B depending on the body length of the envelope E calculated in step S4302 of FIG. 43. The second frontage opening amount B corresponds to a frontage opening amount that is finally required by rotating the enclosing guide member 163 when the enclosure is inserted into the envelope E (see FIG. 28).

The second frontage opening amount B has a larger value than the value of the first frontage opening amount A. A value obtained by subtracting the first frontage opening amount A from the second frontage opening amount B corresponds to a frontage opening amount of the envelope E due to the rotation of the enclosing guide member 163. In a case where the body length is long, the second frontage opening amount B is desirably set to be a small value in order to restrict a conveyance load of the envelope end when the enclosure is inserted into the envelope E.

Subsequently, as described with reference to FIGS. 38A to 41C, the frontage opening amount for inserting the enclosure into the envelope E varies depending on the condition of the enclosure. Thus, the envelope processing controller 150 corrects the second frontage opening amount B and calculates the third frontage opening amount C depending on the condition of the enclosure acquired by various adjustment values (in step S4305 of FIG. 43). In step S4305 of FIG. 43, in a case where the thickness of the enclosure is relatively large, the envelope processing controller 150 corrects the second frontage opening amount B so that the opening amount of the envelope E is increased. In a case where the thickness of the enclosure is relatively small, the envelope processing controller 150 corrects the second frontage opening amount B so that the opening amount is decreased.

Subsequently, the envelope processing controller 150 determines whether the enclosure is folded based on the condition of the enclosure (in step S4306 of FIG. 43). In a case where the enclosure is folded (Yes in step S4306 of FIG. 43), the envelope processing controller 150 corrects the third frontage opening amount C depending on the type of folding (the number of times of folding) and calculates the fourth frontage opening amount D (in step S4307 of FIG. 43). In a case of a folding type in which the number of times of folding is relatively large, the envelope processing controller 150 increases the opening amount of the envelope E. In a case of a folding type in which the number of times of folding is relatively small, the envelope processing controller 150 decreases the opening amount of the envelope E.

Subsequently, the envelope processing controller 150 corrects the fourth frontage opening amount D depending on the number of times of additional folding, and calculates a fifth frontage opening amount E (in step S4308 of FIG. 43). When the folding height is relatively high, the envelope processing controller 150 increases the opening amount of the envelope E. When the folding height is relatively low, the envelope processing controller 150 decreases the opening amount of the envelope E. The envelope processing controller 150 corrects the fifth frontage opening amount E depending on the number of sheets of the enclosure, and calculates a sixth frontage opening amount F (in step S4309 of FIG. 43). When the number of sheets to be folded is relatively large, the envelope processing controller 150 increases the opening amount of the envelope E. When the number of sheets to be folded is relatively small, the envelope processing controller 150 decreases the opening amount of the envelope E.

In the calculation of the sixth frontage opening amount F that is a finally required frontage opening amount, the order of the processing from the step S4307 to the step S4309 may be changed.

Finally, the envelope processing controller 150 subtracts the first frontage opening amount A from the sixth frontage opening amount F obtained by correcting the second frontage opening amount B and calculates an enclosing member rotation amount G as a rotation amount of the enclosing guide member 163 (in step S4310 of FIG. 43).

If the enclosure is not subjected to folding processing (NO in step S4306 of FIG. 43), the envelope processing controller 150 moves to the processing in step S4310 of FIG. 43 without performing various correction processing. In this case, the envelope processing controller 150 subtracts the first frontage opening amount A from the second frontage opening amount B to calculate the enclosing member rotation amount G as the rotation amount of the enclosing guide member 163 (in step S4310 of FIG. 43).

Figure 44:
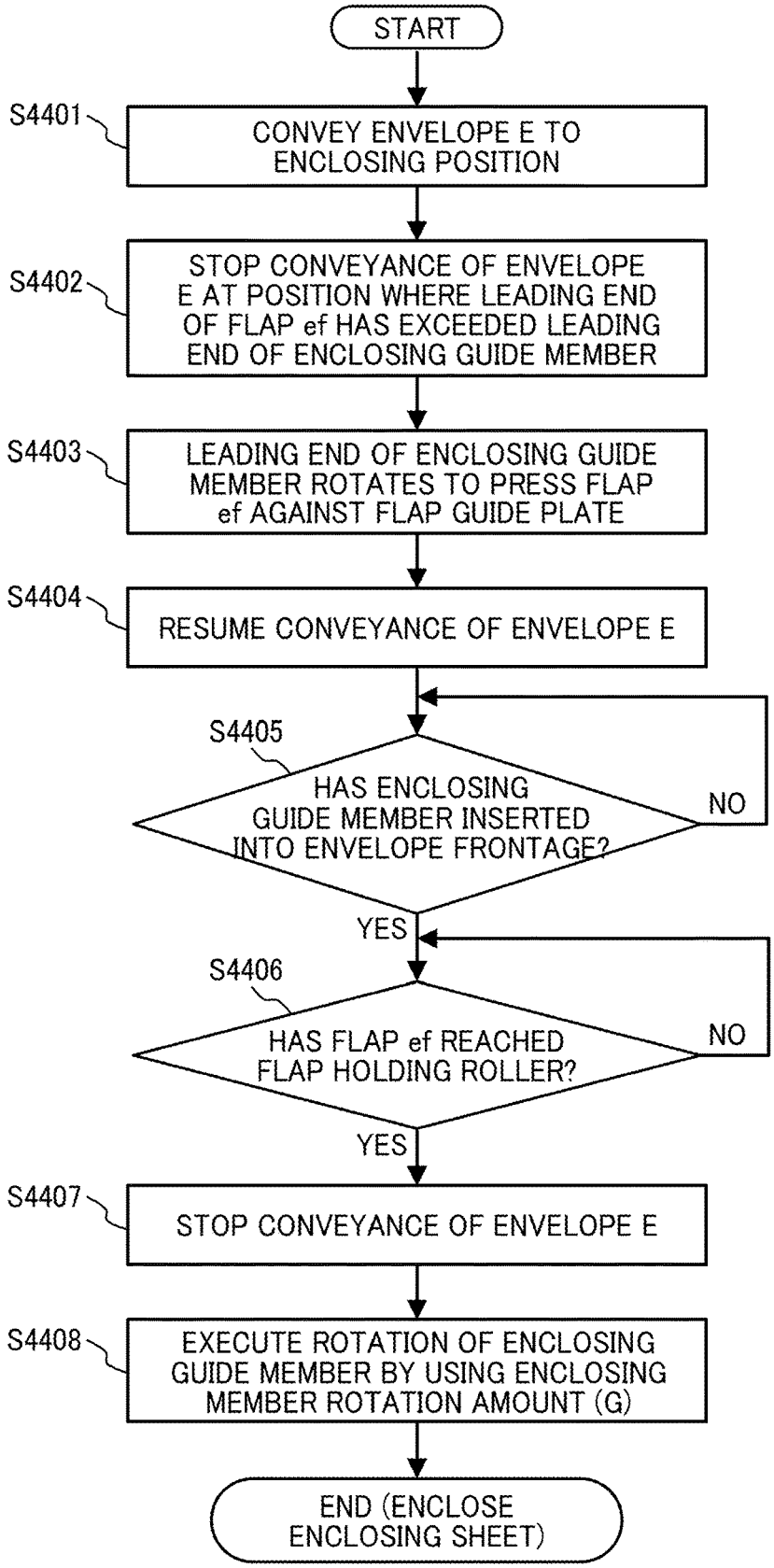
FIG. 44 is a flowchart of opening adjustment processing according to an embodiment of the present disclosure.

Next, a description is given of a control flow in the enclosing support operation for adjusting the rotation amount of the enclosing guide member 163 with reference to a flowchart of FIG. 44. First, the envelope processing controller 150 executes processing for conveying the envelope E to the enclosing position (in step S4401 of FIG. 44, see FIG. 23).

Subsequently, when the leading end of the flap ef has reached a position beyond the tip of the enclosing guide member 163, in other words, when the envelope E has reached the enclosing position, the conveyance of the envelope E is temporarily stopped (in step S4402 of FIG. 44, see FIG. 24).

Subsequently, the envelope processing controller 150 rotates the enclosing guide member 163 to press the flap ef against the flap guide plate 161 (in step S4403 of FIG. 44, see FIG. 25).

Subsequently, the envelope processing controller 150 restarts the conveyance of the envelope E (in step S4404 of FIG. 44, see FIG. 26). The envelope processing controller 150 continues processing until the tip of the enclosing guide member 163 is inserted in the opening (frontage) of the envelope E (NO in step S4405 of FIG. 44). When the tip of the enclosing guide member 163 is inserted into the envelope E, the envelope processing controller 150 proceeds to the next processing (Yes in step S4405 of FIG. 44). Subsequently, the envelope processing controller 150 continues conveying the envelope E until the leading end of the flap ef has reached a position held by the flap holding roller pair 1611 (No in step S4405 of FIG. 44). When the leading end of the flap ef is held by the flap holding roller pair 1611 (Yes in step S4405 of FIG. 44), the envelope processing controller 150 stops the conveyance of the envelope E (in step S4407 of FIG. 44, see FIG. 27).

Finally, the envelope processing controller 150 rotates the enclosing guide member 163 (in step S4408 of FIG. 44) by using the enclosing member rotation amount G. The envelope processing controller 150 rotates the enclosing guide member 163 by the adjusted amount, so that the opening amount of the frontage of the envelope E is also adjusted. Then, as described with reference to FIGS. 29 and 30, an enclosure is inserted into the envelope E.

Figure 45:
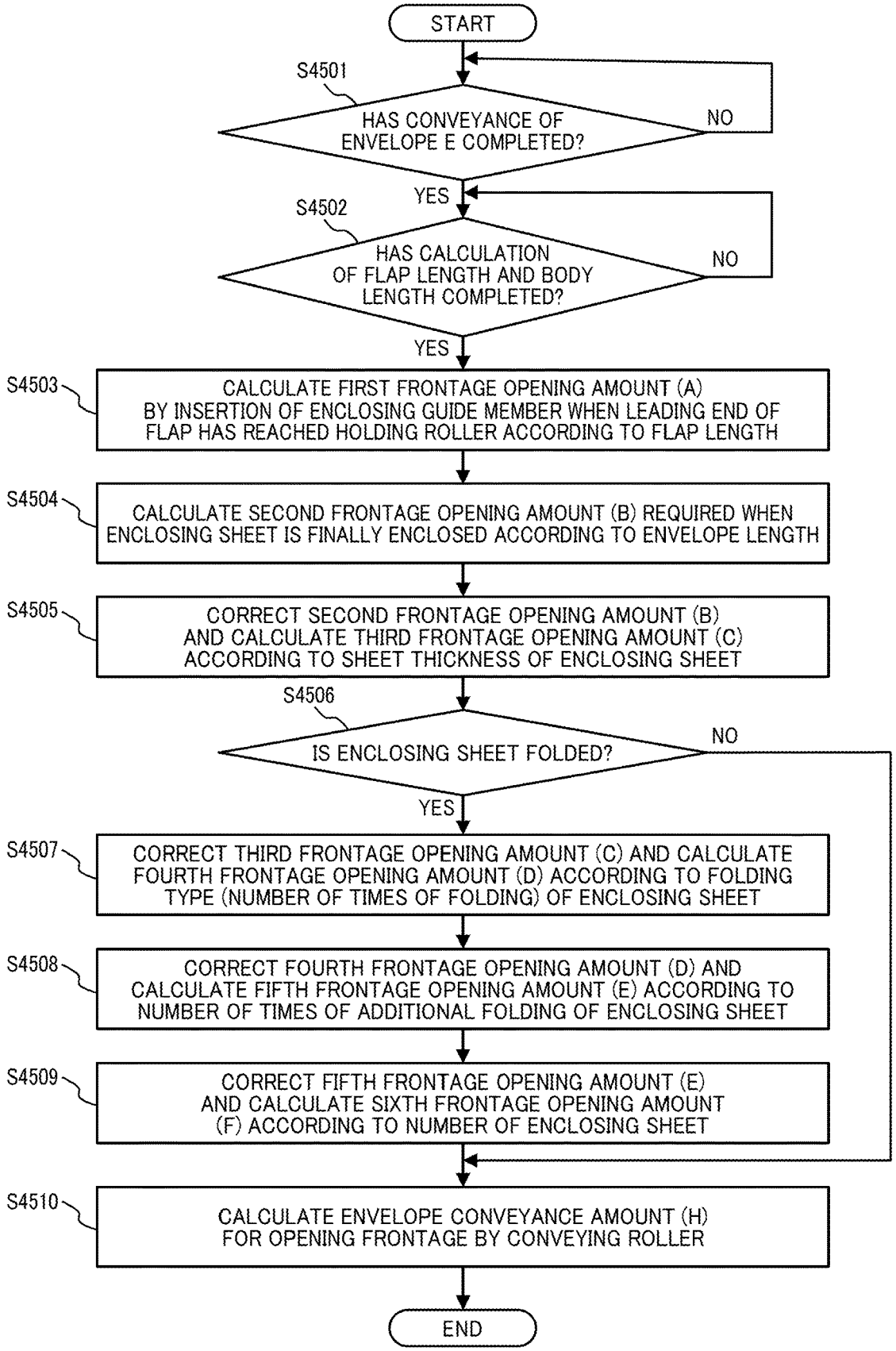
FIG. 45 is a flowchart of opening adjustment amount calculation processing according to an embodiment of the present disclosure.

Next, with reference to the flowchart of FIG. 45, a description is given of opening adjustment amount calculation processing used for control processing of the enclosing support operation executed in the envelope processing apparatus according to an embodiment of the present disclosure. The enclosing support operation is as described above. The envelope processing controller 150 adjusts the opening amount of the envelope E depending on the flap length and body length of the envelope E and the condition of the enclosure and controls the operation of the enclosing support 160 to achieve the adjusted opening amount.

A description is given of calculation processing of an opening adjustment amount for adjusting the rotation amount of the first vertical conveying roller pair 122 and the second vertical conveying roller pair 123 as a second embodiment.

First, the envelope processing controller 150 executes processing for conveying the envelope E to the enclosing position (in step S4501 of FIG. 45). The envelope processing controller 150 loops the processing until the envelope E has reached the enclosing position (NO in step S4501 of FIG. 45). When the envelope E has reached the enclosing position (YES in step S4501 of FIG. 45), the envelope processing controller 150 proceeds to the next processing. Hereinafter, since a series of processing from step S4502 to step S4509 of FIG. 45 is the same as the processing from S4302 to S4309 in the first embodiment, description thereof is omitted.

Finally, the envelope processing controller 150 subtracts the first frontage opening amount A from the sixth frontage opening amount F obtained by correcting the second frontage opening amount B and calculates an envelope conveyance amount H as a rotation amount of the first vertical conveying roller pair 122 and the second vertical conveying roller pair 123 (in step S4510 of FIG. 45).

Figure 46:
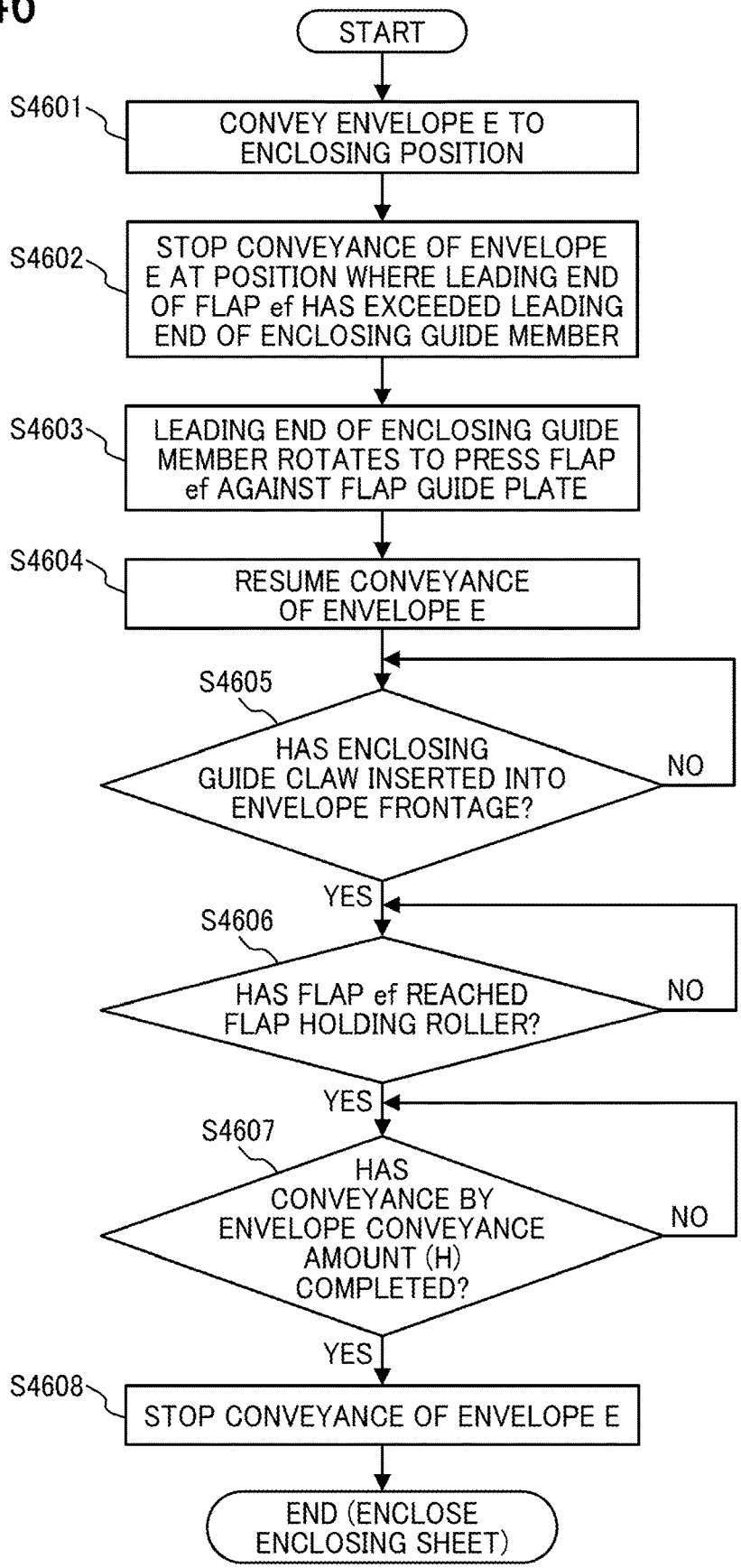
FIG. 46 is a flowchart of opening adjustment processing according to an embodiment of the present disclosure.

Next, a description is given of a control procedure in the enclosing support operation for adjusting the drive amount of the first vertical conveying roller pair 122 and the second vertical conveying roller pair 123 with reference to a flowchart of FIG. 46. First, the envelope processing controller 150 executes processing for conveying the envelope E to the enclosing position (in step S4601 of FIG. 46, see FIG. 23).

Subsequently, when the leading end of the flap ef has reached a position beyond the tip of the enclosing guide member 163, in other words, when the envelope E has reached the enclosing position, the conveyance of the envelope E is temporarily stopped (in step S4402 of FIG. 44, see FIG. 24). Since a series of processing from step S4603 to step S4606 is the same as the processing already described from step S4403 to step S4406, the detailed description thereof is omitted.

When the envelope E is conveyed and the leading end of the flap ef is held by the flap holding roller pair 1611 (Yes in step S4606 of FIG. 46), the envelope processing controller 150 determines whether the conveyance amount of the envelope E up to this point corresponds to the envelope conveyance amount H (in step S4607 of FIG. 46). In other words, the envelope processing controller 150 loops the processing until the drive amounts of the first vertical conveying roller pair 122 and the second vertical conveying roller pair 123 have reached a drive amount corresponding to the adjusted envelope conveyance amount H (NO in step S4607 of FIG. 46).

When the conveyance amount of the envelope E has reached the envelope conveyance amount H (YES in step S4607 of FIG. 46), the driving of the first vertical conveying roller pair 122 and the second vertical conveying roller pair 123 is stopped, and the envelope processing controller 150 ends the processing (in step S4608 of FIG. 46, see FIG. 27).

Finally, the envelope processing controller 150 conveys the envelope E by the adjusted amount, so that the opening amount of the frontage of the envelope E is also adjusted. Then, as described with reference to FIGS. 29 and 30, an enclosure is inserted into the envelope E.

As described above, in the adjustment processing of the frontage opening amount according to the first embodiment and the second embodiment, the frontage opening amount of the envelope E is adjusted to be as small as possible depending on the body length and the flap length of the envelope E and the condition of the enclosure. The envelope processing controller 150 adjusts the frontage opening amount to the optimum amount in terms of the correlation between the envelope E and the enclosure to reduce a conveyance load when the enclosure is inserted into the envelope E. Thus, the envelope processing controller 150 can stably execute the enclosing operation.

Aspects of the present disclosure are, for example, as follows.

First Aspect

In a first aspect, an enclosing device (e.g., the enclosing device 120) that inserts an enclosure into an envelope (e.g., the envelope E) conveyed to an enclosing position includes an envelope conveyor (e.g., the first vertical conveying roller pair 122 and the second vertical conveying roller pair 123) and an enclosing unit (e.g., the enclosing support 160). The envelope conveyor (e.g., the first vertical conveying roller pair 122 and the second vertical conveying roller pair 123) conveys the envelope (e.g., the envelope E) to the enclosing position. The enclosing unit (e.g., the enclosing support 160) opens a frontage of the envelope (e.g., the envelope E) such that the enclosure is inserted into the envelope (e.g., the envelope E) that has reached the enclosing position and includes an opening amount adjuster to adjust an opening amount of the frontage when the enclosure is inserted into the envelope (e.g., the envelope E). The opening amount adjuster adjusts the opening amount depending on a flap length, which is a length of a flap (e.g., the flap ef) of the envelope (e.g., the envelope E) in a conveyance direction when the envelope (e.g., the envelope E) is conveyed to the enclosing position, and a body length, which is a length of a body portion of the envelope (e.g., the envelope E) in the conveyance direction.

Second Aspect

In a second aspect, in the enclosing device (e.g., the enclosing device 120) according to the first aspect, the enclosing unit (e.g., the enclosing support 160) includes an enclosing member to widen the frontage of the envelope (e.g., the envelope E). The opening amount adjuster adjusts a rotation amount of the enclosing member.

Third Aspect

In a third aspect, the enclosing device (e.g., the enclosing device 120) according to the second aspect further includes a flap length detector (e.g., the separation sensor 128 and the flap opening detection sensor 129) to detect the flap length of the envelope (e.g., the envelope E). The opening amount adjuster adjusts the rotation amount of the enclosing member, depending on the flap length.

Fourth Aspect

In a fourth aspect, the enclosing device (e.g., the enclosing device 120) according to the second or third aspect further includes a body length detector (e.g., the separation sensor 128 and the flap opening detection sensor 129) to detect the body length of the envelope (e.g., the envelope E). The opening amount adjuster adjusts the rotation amount of the enclosing member, depending on the body length.

Fifth Aspect

In a fifth aspect, in the enclosing device (e.g., the enclosing device 120) according to the first aspect, the enclosing unit (e.g., the enclosing support 160) further includes a flap holder (e.g., the flap holding roller pair 1611) to hold the flap (e.g., the flap ef) of the envelope (e.g., the envelope E). The opening amount adjuster adjusts a drive amount of the flap holder (e.g., the flap holding roller pair 1611) and the envelope conveyor (e.g., the first vertical conveying roller pair 122 and the second vertical conveying roller pair 123) to adjust the opening amount of the frontage of the envelope (e.g., the envelope E).

Sixth Aspect

In a sixth aspect, the enclosing device (e.g., the enclosing device 120) according to the fifth aspect further includes a flap length detector (e.g., the separation sensor 128 and the flap opening detection sensor 129) to detect the flap length of the envelope (e.g., the envelope E). The opening amount adjuster adjusts the drive amount of the flap holder (e.g., the flap holding roller pair 1611) and the envelope conveyor (e.g., the first vertical conveying roller pair 122 and the second vertical conveying roller pair 123) to adjust the opening amount of the frontage of the envelope (e.g., the envelope E), depending on the flap length of the envelope (e.g., the envelope E).

Seventh Aspect

In a seventh aspect, the enclosing device (e.g., the enclosing device 120) according to the fifth or sixth aspect further includes a body length detector (e.g., the separation sensor 128 and the flap opening detection sensor 129) to detect the body length of the envelope (e.g., the envelope E). The opening amount adjuster adjusts the drive amount of the flap holder (e.g., the flap holding roller pair 1611) and the envelope conveyor (e.g., the first vertical conveying roller pair 122 and the second vertical conveying roller pair 123) to adjust the opening amount of the frontage of the envelope (e.g., the envelope E), depending on the body length of the envelope (e.g., the envelope E).

Eighth Aspect

In an eighth aspect, in the enclosing device (e.g., the enclosing device 120) according to any one of the first to seventh aspects, the opening amount adjuster adjusts the opening amount of the frontage of the envelope (e.g., the envelope E), depending on a number of enclosures inserted into the envelope (e.g., the envelope E).

Ninth Aspect

In a ninth aspect, in the enclosing device (e.g., the enclosing device 120) according to any one of the first to eighth aspects, the opening amount adjuster adjusts the opening amount of the frontage of the envelope (e.g., the envelope E), depending on thickness of the enclosure inserted into the envelope (e.g., the envelope E).

Tenth Aspect

In a tenth aspect, in the enclosing device (e.g., the enclosing device 120) according to any one of the first to ninth aspects, the opening amount adjuster adjusts the opening amount of the frontage of the envelope (e.g., the envelope E), depending on shape of the enclosure inserted into the envelope (e.g., the envelope E).

Eleventh Aspect

In an eleventh aspect, an envelope processing apparatus (e.g., the envelope processing apparatus 100) includes the enclosing device (e.g., the enclosing device 120) according to any one of the first to tenth aspects to insert the enclosure into the envelope and a sealer (e.g., the sealer 130) to seal the envelope (e.g., the envelope E) in which the enclosure has been inserted.

Twelfth Aspect

In a twelfth aspect, an image forming system (e.g., the printer system 1) includes an image forming apparatus (e.g., the image forming apparatus 200) to form an image on a sheet medium and the enclosing device (e.g., the enclosing device 120) according to any one of the first to tenth aspects to insert the sheet medium, on which the image has been formed, as the enclosure into the envelope (e.g., the envelope E).

Thirteenth Aspect

In a thirteenth aspect, an image forming system (e.g., the printer system 1) includes an image forming apparatus (e.g., the image forming apparatus 200) to form an image on a sheet medium and the envelope processing apparatus (e.g., the envelope processing apparatus 100) according to the eleventh aspect to insert the sheet medium, on which the image has been formed, as the enclosure into the envelope (e.g., the envelope E) and seal the envelope (e.g., the envelope E).

Fourteenth Aspect

In a fourteenth aspect, an image forming system (e.g., the printer system 1) includes a folding processing device (e.g., the sheet folding device 310) and the enclosing device (e.g., the enclosing device 120) according to any one of the first to tenth aspect. The folding processing device (e.g., the sheet folding device 310) performs folding processing on the enclosure to be enclosed into the envelope (e.g., the envelope E), includes a folding position adjuster to adjust a folding position of the enclosure in the folding processing, and changes a shape of the enclosure based on a folding position adjusted in the folding position adjuster. The enclosing device (e.g., the enclosing device 120) inserts the enclosure having been subjected to the folding processing into the envelope (e.g., the envelope E).

Fifteenth Aspect

In a fifteenth aspect, in the image forming system (e.g., the printer system 1) according to the fourteenth aspect, the folding processing device (e.g., the sheet folding device 310) includes an additional folding device (e.g., the additional folding roller 73) to perform additional folding processing on a crease formed on the enclosure. The shape of the enclosure is changed based on a number of times of the additional folding processing on the crease of the enclosure in the additional folding device (e.g., the additional folding roller 73).

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The invention claimed is:

1. An enclosing device to insert an enclosure into an envelope conveyed to an enclosing position, the enclosing device comprising:

an envelope conveyor to convey the envelope to the enclosing position; and an enclosing unit to open a frontage of the envelope such that the enclosure is inserted into the envelope that has reached the enclosing position, the enclosing unit including an opening amount adjuster to adjust an opening amount of the frontage when the enclosure is inserted into the envelope, the opening amount adjuster to adjust the opening amount, depending on a flap length and a body length, the flap length being a length of a flap of the envelope in a conveyance direction in which the envelope is conveyed to the enclosing position, the body length being a length of a body of the envelope in the conveyance direction.

2. The enclosing device according to claim 1, wherein the enclosing unit includes an enclosing member to widen the frontage of the envelope, and wherein the opening amount adjuster is to adjust a rotation amount of the enclosing member.

3. The enclosing device according to claim 2, further comprising a flap length detector to detect the flap length of the envelope, wherein the opening amount adjuster is to adjust the rotation amount of the enclosing member, depending on the flap length of the envelope.

4. The enclosing device according to claim 2, further comprising a body length detector to detect the body length of the envelope, wherein the opening amount adjuster is to adjust the rotation amount of the enclosing member, depending on the body length of the envelope.

5. The enclosing device according to claim 1, wherein the enclosing unit further includes a flap holder to hold the flap of the envelope, and wherein the opening amount adjuster is to adjust a drive amount of the flap holder and the envelope conveyor to adjust the opening amount of the frontage of the envelope.

6. The enclosing device according to claim 5, further comprising a flap length detector to detect the flap length of the envelope, wherein the opening amount adjuster is to adjust the drive amount of the flap holder and the envelope conveyor to adjust the opening amount of the frontage of the envelope, depending on the flap length of the envelope.

7. The enclosing device according to claim 5, further comprising a body length detector to detect the body length of the envelope, wherein the opening amount adjuster is to adjust the drive amount of the flap holder and the envelope conveyor to adjust the opening amount of the frontage of the envelope, depending on the body length of the envelope.

8. The enclosing device according to claim 1, wherein the opening amount adjuster is to adjust the opening amount of the frontage of the envelope, depending on number of the enclosure inserted into the envelope.

9. The enclosing device according to claim 1, wherein the opening amount adjuster is to adjust the opening amount of the frontage of the envelope, depending on thickness of the enclosure inserted into the envelope.

10. The enclosing device according to claim 1, wherein the opening amount adjuster is to adjust the opening amount of the frontage of the envelope, depending on shape of the enclosure inserted into the envelope.

11. An envelope processing apparatus, comprising:

the enclosing device according to claim 1 to enclose the enclosure into the envelope; and a sealer to seal the envelope in which the enclosure has been inserted.

12. An image forming system comprising:

an image forming apparatus to form an image on a sheet medium; and the enclosing device according to claim 1 to insert the sheet medium, on which the image is formed, as the enclosure into the envelope.

13. An image forming system comprising:

an image forming apparatus to form an image on a sheet medium; and the envelope processing apparatus according to claim 11 to insert the sheet medium, on which the image is formed, as the enclosure into the envelope and seal the envelope.

14. An image forming system comprising:

a folding processing device to perform folding processing on the enclosure to be enclosed into the envelope, the folding processing device including a folding position adjuster to adjust a folding position of the enclosure in the folding processing, the folding processing device to change a shape of the enclosure based on a folding position adjusted in the folding position adjuster; and the enclosing device according to claim 1 to insert the enclosure having been subjected to the folding processing into the envelope.

15. The image forming system according to claim 14, wherein the folding processing device includes an additional folding device to perform additional folding processing on a crease of the enclosure, and wherein the additional folding device is to change the shape of the enclosure based on number of times of the additional folding processing on the crease of the enclosure in the additional folding device.

* * * * *